US010441870B2

(12) United States Patent
Corrigan

(10) Patent No.: US 10,441,870 B2
(45) Date of Patent: Oct. 15, 2019

(54) PROTECTIVE ARTICLES AND METHODS THEREOF

(71) Applicant: Aexos Inc., Waterloo, Ontario (CA)

(72) Inventor: Charles Ryan Corrigan, Waterloo (CA)

(73) Assignee: AEXOS INC., Waterloo, Ontario (CA)

( * ) Notice: Subject to any disclaimer, the term of this patent is extended or adjusted under 35 U.S.C. 154(b) by 0 days.

(21) Appl. No.: 15/997,516

(22) Filed: Jun. 4, 2018

(65) Prior Publication Data

US 2018/0318693 A1 Nov. 8, 2018

Related U.S. Application Data

(63) Continuation of application No. PCT/CA2018/000088, filed on May 4, 2018.
(Continued)

(51) Int. Cl.
*A63B 71/12* (2006.01)
*A41D 13/05* (2006.01)
(Continued)

(52) U.S. Cl.
CPC ..... *A63B 71/12* (2013.01); *A41D 13/0506* (2013.01); *A41D 13/0512* (2013.01); *A41D 13/0518* (2013.01); *A41D 13/0525* (2013.01); *A41D 13/0531* (2013.01); *A41D 13/0537* (2013.01); *A41D 13/0543* (2013.01); *A41D 13/06* (2013.01); *A41D 13/08* (2013.01); *A41D 13/0007* (2013.01); *A41D 13/0015* (2013.01);
(Continued)

(58) Field of Classification Search
CPC ... F41H 1/02; A41D 13/0506; A41D 13/0518; A41D 13/0525; A41D 13/0531; A41D 13/0537; A41D 13/0543; A41D 13/06; A41D 13/08; A41D 13/0007; A41D 13/0015; A41D 13/0153; A41D 13/055; A41D 2300/20; A41D 2500/50; A41D 2600/10; A63B 71/12
See application file for complete search history.

(56) References Cited

U.S. PATENT DOCUMENTS 3,756,226 A * 9/1973 Calabrese ..... A61F 5/055 128/DIG. 23
5,140,995 A 8/1992 Uhl
(Continued)

FOREIGN PATENT DOCUMENTS

AU 2004293118 B2 2/2009
AU 2011201521 B2 3/2012
(Continued)

OTHER PUBLICATIONS

D30 Materials. Available at https://www.d3o.com/what-is-d3o/materials/ (4 pgs) (2018).
(Continued)

*Primary Examiner* — Anna K Kinsaul
(74) *Attorney, Agent, or Firm* — Wilson Sonsini Goodrich & Rosati

(57) ABSTRACT

Disclosed herein are wearable articles and methods for the manufacture and use thereof. The wearable articles can comprise compression elements, gripping elements, and support elements containing a rate-sensitive materials which can operate to prevent injury.

26 Claims, 67 Drawing Sheets

Related U.S. Application Data

(60) Provisional application No. 62/543,854, filed on Aug. 10, 2017, provisional application No. 62/502,254, filed on May 5, 2017.

(51) Int. Cl.

| | |
|---|---|
| ***A41D 13/06*** | (2006.01) |
| ***A41D 13/08*** | (2006.01) |
| *A41D 13/00* | (2006.01) |
| *A41D 13/015* | (2006.01) |
| *F41H 1/02* | (2006.01) |

(52) U.S. Cl.

CPC ..... *A41D 13/0153* (2013.01); *A41D 13/055* (2013.01); *A41D 2300/20* (2013.01); *A41D 2500/50* (2013.01); *A41D 2600/10* (2013.01); *F41H 1/02* (2013.01)

(56) References Cited

U.S. PATENT DOCUMENTS

| | | | | |
|---|---|---|---|---|
| 5,328,447 | A | 7/1994 | Kapounek et al. | |
| 5,498,233 | A | 3/1996 | Stojanovic | |
| 6,047,406 | A * | 4/2000 | Dicker | A41D 13/0015 2/115 |
| 6,067,665 | A | 5/2000 | Depalma et al. | |
| 6,427,695 | B1 | 8/2002 | Zanetti et al. | |
| 7,090,201 | B2 | 8/2006 | Brucker | |
| 7,299,507 | B1 | 11/2007 | Hermoso et al. | |
| 7,381,460 | B2 | 6/2008 | Palmer et al. | |
| 7,794,827 | B2 | 9/2010 | Palmer et al. | |
| 7,846,117 | B2 | 12/2010 | Leatt et al. | |
| 7,861,326 | B2 | 1/2011 | Harty | |
| 7,979,922 | B2 | 7/2011 | Ronco | |
| 7,993,293 | B2 | 8/2011 | Leatt et al. | |
| 8,002,723 | B2 | 8/2011 | Leatt et al. | |
| 8,048,014 | B2 | 11/2011 | Brown | |
| 8,281,419 | B2 | 10/2012 | Rietdyk et al. | |
| 8,347,422 | B2 | 1/2013 | Kalaam et al. | |
| 8,370,968 | B2 | 2/2013 | Kerr | |
| 8,468,613 | B2 | 6/2013 | Harty | |
| 8,474,067 | B2 | 7/2013 | Reimer | |
| 8,484,768 | B2 | 7/2013 | Leatt et al. | |
| 8,562,551 | B2 | 10/2013 | Leatt | |
| 8,615,819 | B2 | 12/2013 | Kerr | |
| 8,708,940 | B2 | 4/2014 | Jenkins, III | |
| 8,832,863 | B2 | 9/2014 | Yang | |
| 8,834,394 | B2 | 9/2014 | Ghajar | |
| 8,905,956 | B2 | 12/2014 | Waeger | |
| 8,910,319 | B2 | 12/2014 | Dainese et al. | |
| 8,943,617 | B2 | 2/2015 | Harty | |
| 9,119,707 | B2 | 9/2015 | Brown | |
| 9,168,167 | B2 | 10/2015 | Brown | |
| D746,552 | S | 1/2016 | Brown | |
| 9,414,954 | B2 | 8/2016 | Brown et al. | |
| 9,517,401 | B2 | 12/2016 | Kerr et al. | |
| D780,406 | S | 3/2017 | Brown | |
| 9,700,094 | B2 | 7/2017 | Nagely et al. | |
| D798,027 | S | 9/2017 | Brown | |
| 9,854,853 | B2 | 1/2018 | Musciacchio et al. | |
| 2003/0050581 | A1 | 3/2003 | Berns | |
| 2004/0193085 | A1 | 9/2004 | Mazzarolo et al. | |
| 2004/0255368 | A1 | 12/2004 | Baker | |
| 2006/0192190 | A1 | 8/2006 | Brucker | |
| 2006/0272071 | A1 * | 12/2006 | Mickle | A41D 13/0512 2/69 |
| 2007/0145341 | A1 | 6/2007 | Brucker | |
| 2008/0072367 | A1 | 3/2008 | Mazzarolo | |
| 2008/0201831 | A1 | 8/2008 | Ronco | |
| 2009/0062702 | A1 | 3/2009 | Sojka et al. | |
| 2009/0062704 | A1 | 3/2009 | Brown et al. | |
| 2010/0088808 | A1 | 4/2010 | Rietdyk et al. | |
| 2010/0122404 | A1 | 5/2010 | Bowlus et al. | |
| 2010/0192290 | A1 | 8/2010 | Husain | |
| 2010/0251467 | A1 | 10/2010 | Leatt et al. | |
| 2010/0263111 | A1 | 10/2010 | Leatt et al. | |
| 2011/0010829 | A1 | 1/2011 | Norman | |
| 2011/0185468 | A1 | 8/2011 | Olesnicky | |
| 2012/0131736 | A1 | 5/2012 | Reimer | |
| 2012/0291189 | A1 | 11/2012 | Chambers et al. | |
| 2013/0055492 | A1 | 3/2013 | Husain | |
| 2013/0205480 | A1 | 8/2013 | Nagely et al. | |
| 2014/0224849 | A1 | 8/2014 | Hiemenz et al. | |
| 2014/0245529 | A1 | 9/2014 | Beckman | |
| 2014/0289939 | A1 | 10/2014 | Omer | |
| 2015/0016885 | A1 * | 1/2015 | Barron | E01C 11/005 404/78 |
| 2015/0128334 | A1 | 5/2015 | Mazzarolo et al. | |
| 2015/0133843 | A1 | 5/2015 | Turrini et al. | |
| 2015/0257461 | A1 | 9/2015 | Conolly et al. | |
| 2016/0309808 | A1 | 10/2016 | Armour et al. | |
| 2016/0345652 | A1 | 12/2016 | Harty | |
| 2017/0013905 | A1 | 1/2017 | Cook | |
| 2017/0056753 | A1 | 3/2017 | Kerr | |
| 2017/0172224 | A1 | 6/2017 | Joseph | |
| 2017/0318889 | A1 | 11/2017 | Nagely et al. | |
| 2017/0348133 | A1 | 12/2017 | Corrigan | |

FOREIGN PATENT DOCUMENTS

| | | | |
|---|---|---|---|
| AU | 2007310441 | C1 | 7/2012 |
| AU | 2008277318 | B9 | 11/2012 |
| BR | PI0718004 | A2 | 11/2013 |
| BR | PI0416971 | B1 | 9/2015 |
| CA | 2547855 | A1 | 6/2005 |
| CA | 2829541 | A1 | 5/2012 |
| CN | 101594840 | B | 7/2012 |
| CN | 1886101 | B | 12/2013 |
| DE | 202006013732 | U1 | 2/2007 |
| DK | 1696842 | T3 | 6/2010 |
| EA | 010815 | B1 | 12/2008 |
| EP | 2062487 | A2 | 5/2009 |
| EP | 2091475 | A1 | 8/2009 |
| EP | 1696842 | B1 | 3/2010 |
| EP | 2170231 | A2 | 4/2010 |
| EP | 1838398 | B1 | 1/2011 |
| EP | 1838399 | B1 | 1/2011 |
| EP | 2113231 | B1 | 11/2011 |
| EP | 2632284 | A2 | 9/2013 |
| EP | 2643065 | B1 | 3/2016 |
| ES | 2342402 | T3 | 7/2010 |
| ES | 2356829 | T3 | 4/2011 |
| ES | 2358039 | T3 | 5/2011 |
| ES | 2377592 | T3 | 3/2012 |
| GB | 2454898 | A | 5/2009 |
| JP | 2007526795 | A | 9/2007 |
| JP | 2010507735 | A | 3/2010 |
| JP | 4553903 | B2 | 9/2010 |
| JP | 5473057 | B2 | 4/2014 |
| KR | 20060097740 | A | 9/2006 |
| KR | 100904041 | B1 | 6/2009 |
| MA | 28229 | A1 | 10/2006 |
| MX | JL06000026 | A | 7/2006 |
| NO | 327461 | B1 | 7/2009 |
| NZ | 548068 | A | 6/2009 |
| NZ | 577131 | A | 4/2011 |
| NZ | 592116 | A | 6/2011 |
| PT | 1696842 | E | 6/2010 |
| SI | 1696842 | T1 | 7/2010 |
| WO | WO-2005051251 | A2 | 6/2005 |
| WO | WO-2006054273 | A1 | 5/2006 |
| WO | WO-2006054274 | A1 | 5/2006 |
| WO | WO-2006072179 | A1 | 7/2006 |
| WO | WO-2008050307 | A1 | 5/2008 |
| WO | WO-2009010936 | A2 | 1/2009 |
| WO | WO-2012056486 | A2 | 5/2012 |
| WO | WO-2012068686 | A1 | 5/2012 |
| WO | WO-2015061663 | A1 | 4/2015 |
| WO | WO-2016130973 | A1 | 8/2016 |

(56) References Cited

FOREIGN PATENT DOCUMENTS

| | | | |
|---|---|---|---|
| WO | WO-2017079827 | A1 | 5/2017 |
| WO | WO-2017144940 | A1 | 8/2017 |

OTHER PUBLICATIONS

GEAR4—The UK's #1 Protective Phone Cases featuring D3O® Technology. Available at https://www.gear4.com/us/d3o-technology/ (4 pgs) (2017).
Haris et al. An experimental study on shock wave mitigation capability of polyurea and shear thickening fluid based suspension pads. Defence Technology 14:12-18 (2018).
PCT/CA2016/051296 International Search Report and Written Opinion dated Jan. 20, 2017.
Rohrig. No-Hit Wonder! D30®. Available athttps://www.acs.org/content/acs/en/education/resources/highschool/chemmatters/past-issues/2016-2017/february-2017/no-hit-wonder-d3o.html (3 pgs.) (2017).
U.S. Appl. No. 15/683,617 Office Action dated Mar. 2, 2018.
PCT/CA2016/051296 International Preliminary Report on Patentability dated May 24, 2018.
PCT/CA2018/000088 International Search Report and Written Opinion dated Jul. 24, 2018.
U.S. Appl. No. 15/683,617 Office Action dated Sep. 26, 2018.
U.S. Appl. No. 15/683,617 Office Action dated May 29, 2019.

* cited by examiner

PROTECTIVE ARTICLES AND METHODS THEREOF

CROSS-REFERENCE

This application is a continuation of International Application No. PCT/CA2018/000088, filed May 4, 2018, which claims the benefit of U.S. Provisional Patent Application No. 62/502,254, filed May 5, 2017, and U.S. Provisional Patent Application No. 62/543,854, filed Aug. 10, 2017, which are entirely incorporated herein by reference.

BACKGROUND

In sports, military operations, and other vigorous physical activities, the human body may be subjected to significant stresses. For example, impacts to the head and/or body can cause angular/rotational acceleration (whiplash) of the head and neck, and angular/rotational acceleration and whiplash are associated with concussions. The neck/spine or other parts of the body such as the elbow(s), wrist(s), hip(s), knee(s), and/or ankle(s) may also be subjected to musculoskeletal stress, strain, or fatigue.

SUMMARY OF THE INVENTION

In some aspects, disclosed herein are articles configured to provide support and/or protection when worn by a subject. Also disclosed herein are methods of manufacturing and methods of using said articles. The articles may utilize a suitable material for absorbing, resisting, reducing, or counteracting a force. The material can be a non-Newtonian material that has force-reactive or rate-sensitive properties. In some embodiments, an article comprises one or more deformable regions adapted to function as "crumple zones" to absorb some of the forces (internal, external or both) that would otherwise be applied to the body region to which the article is secured. In some embodiments, an article comprises one or more elements that prevent injury by increasing resistance in response to increasing force (e.g. high acceleration impact), in contrast to conventional materials such as, for example, a soft foam padding.

Another aspect provided herein is an article wearable by a subject, comprising: a base layer having an interior surface and an exterior surface, wherein the interior surface has a first coefficient of friction ($\mu 1$) relative to a body surface of the subject, and wherein the base layer has a first modulus of elasticity (E1); at least one gripping element coupled to the interior surface of the base layer, wherein the at least one gripping element is configured to contact a body of the subject, and wherein the at least one gripping element has a second coefficient of friction ($\mu 2$) relative to the body surface, wherein $\mu 2$ is greater than $\mu 1$; at least one compression element coupled to the base layer, wherein the at least one compression element has a second modulus of elasticity (E2) that is greater than E1; and at least one support element comprising a non-Newtonian material coupled to the base layer.

In some embodiments, the at least one gripping element is a plurality of gripping elements positioned on the interior surface of the base layer in a manner that restricts or reduces a sliding movement across the body surface. In some embodiments, the article is mountable on an upper arm, forearm or lower arm, shoulder, chest, back, torso, buttocks, thigh or upper leg, or lower leg or calf of the subject, and wherein the plurality of gripping elements restricts or reduces the sliding movement across the upper arm, forearm or lower arm, shoulder, chest, back, torso, buttocks, thigh or upper leg, or lower leg or calf of the subject. In some embodiments, the at least one gripping element comprises 2, 3, 4, 5, 6, 7, 8, 9, or 10 or more gripping elements. In some embodiments, the at least one compression element comprises at least one of: a chest compression element; a shoulder compression element; an elbow compression element; a thigh compression element; a knee compression element; a shin compression element; an ankle compression element; and a waist compression element. In some embodiments, the at least one compression element comprises 2, 3, 4, 5, 6, 7, 8, 9, or 10 or more compression elements. In some embodiments, the at least one support element comprises at least one of: a neck support element; a thigh support element; a shin support element; and a spine support element. In some embodiments, the at least one support element comprises 2, 3, 4, 5, 6, 7, 8, 9, or 10 or more support elements. In some embodiments, at least one of the support element, the compression element, and the gripping element is irremovably attached to the base layer. In some embodiments, at least one of the support element, the compression element, and the gripping element is irremovably attached to the interior surface of the base layer. In some embodiments, at least one of the support element and the compression element is irremovably attached to the exterior surface of the base layer. In some embodiments, at least one of the support element, the compression element, and the gripping element is laminated or printed adjacent to the base layer. In some embodiments, at least one of the support element, the compression element, and the gripping element is removably attached to the base layer. In some embodiments, at least one of the support element, the compression element, and the gripping element is removably attached to the interior surface of the base layer. In some embodiments, at least one of the support element and the compression element is attached to the exterior surface of the base layer. In some embodiments, at least one of the support element, the compression element, and the gripping element is removably attached to the base layer by a fastener, optionally wherein the fastener comprises a strap a buckle, a hook and loop fastener, a zipper, a button, a hook, an eye, a lace, a magnet, a clasp, a clip, a screw, a bolt, a nut, a tie, or any combination thereof.

In some embodiments, the first coefficient of friction is about 0.1 to about 1. In some embodiments, the first coefficient of friction is at least about 0.1. In some embodiments, the first coefficient of friction is at most about 1. In some embodiments, the first coefficient of friction is about 0.1 to about 0.2, about 0.1 to about 0.3, about 0.1 to about 0.4, about 0.1 to about 0.5, about 0.1 to about 0.6, about 0.1 to about 0.7, about 0.1 to about 0.8, about 0.1 to about 0.9, about 0.1 to about 1, about 0.2 to about 0.3, about 0.2 to about 0.4, about 0.2 to about 0.5, about 0.2 to about 0.6, about 0.2 to about 0.7, about 0.2 to about 0.8, about 0.2 to about 0.9, about 0.2 to about 1, about 0.3 to about 0.4, about 0.3 to about 0.5, about 0.3 to about 0.6, about 0.3 to about 0.7, about 0.3 to about 0.8, about 0.3 to about 0.9, about 0.3 to about 1, about 0.4 to about 0.5, about 0.4 to about 0.6, about 0.4 to about 0.7, about 0.4 to about 0.8, about 0.4 to about 0.9, about 0.4 to about 1, about 0.5 to about 0.6, about 0.5 to about 0.7, about 0.5 to about 0.8, about 0.5 to about 0.9, about 0.5 to about 1, about 0.6 to about 0.7, about 0.6 to about 0.8, about 0.6 to about 0.9, about 0.6 to about 1, about 0.7 to about 0.8, about 0.7 to about 0.9, about 0.7 to about 1, about 0.8 to about 0.9, about 0.8 to about 1, or about 0.9 to about 1. In some embodiments, the first coefficient of friction is about 0.1, about 0.2, about 0.3, about 0.4, about 0.5, about 0.6, about 0.7, about 0.8, about 0.9, or about 1. In some embodiments, the first coefficient of friction is at least about 0.1, about 0.2, about 0.3, about 0.4, about 0.5, about 0.6, about 0.7, about 0.8, about 0.9, or about 1. In some embodiments, the first coefficient of friction is at most about 0.1, about 0.2, about 0.3, about 0.4, about 0.5, about 0.6, about 0.7, about 0.8, about 0.9, or about 1.

In some embodiments, the second coefficient of friction is about 0.1 to about 2. In some embodiments, the second coefficient of friction is at least about 0.1. In some embodiments, the second coefficient of friction is at most about 2. In some embodiments, the second coefficient of friction is about 0.1 to about 0.2, about 0.1 to about 0.3, about 0.1 to about 0.4, about 0.1 to about 0.5, about 0.1 to about 0.6, about 0.1 to about 0.7, about 0.1 to about 0.8, about 0.1 to about 0.9, about 0.1 to about 1, about 0.1 to about 1.1, about 0.1 to about 1.2, about 0.1 to about 1.3, about 0.1 to about 1.4, about 0.1 to about 1.5, about 0.1 to about 1.6, about 0.1 to about 1.7, about 0.1 to about 1.8, about 0.1 to about 1.9, about 0.1 to about 2.0, about 0.2 to about 0.3, about 0.2 to about 0.4, about 0.2 to about 0.5, about 0.2 to about 0.6, about 0.2 to about 0.7, about 0.2 to about 0.8, about 0.2 to about 0.9, about 0.2 to about 1.0, about 0.2 to about 1.1, about 0.2 to about 1.2, about 0.2 to about 1.3, about 0.2 to about 1.4, about 0.2 to about 1.5, about 0.2 to about 1.6, about 0.2 to about 1.7, about 0.2 to about 1.8, about 0.2 to about 1.9, about 0.2 to about 2.0, about 0.3 to about 0.4, about 0.3 to about 0.5, about 0.3 to about 0.6, about 0.3 to about 0.7, about 0.3 to about 0.8, about 0.3 to about 0.9, about 0.3 to about 1.0, about 0.3 to about 1.1, about 0.3 to about 1.2, about 0.3 to about 1.3, about 0.3 to about 1.4, about 0.3 to about 1.5, about 0.3 to about 1.6, about 0.3 to about 1.7, about 0.3 to about 1.8, about 0.3 to about 1.9, about 0.3 to about 2.0, about 0.4 to about 0.5, about 0.4 to about 0.6, about 0.4 to about 0.7, about 0.4 to about 0.8, about 0.4 to about 0.9, about 0.4 to about 1.0, about 0.4 to about 1.1, about 0.4 to about 1.2, about 0.4 to about 1.3, about 0.4 to about 1.4, about 0.4 to about 1.5, about 0.4 to about 1.6, about 0.4 to about 1.7, about 0.4 to about 1.8, about 0.4 to about 1.9, about 0.4 to about 2.0, about 0.5 to about 0.6, about 0.5 to about 0.7, about 0.5 to about 0.8, about 0.5 to about 0.9, about 0.5 to about 1, about 0.6 to about 0.7, about 0.6 to about 0.8, about 0.6 to about 0.9, about 0.6 to about 1.0, about 0.6 to about 1.1, about 0.6 to about 1.2, about 0.6 to about 1.3, about 0.6 to about 1.4, about 0.6 to about 1.5, about 0.6 to about 1.6, about 0.6 to about 1.7, about 0.6 to about 1.8, about 0.6 to about 1.9, about 0.6 to about 2.0, about 0.7 to about 0.8, about 0.7 to about 0.9, about 0.7 to about 1, about 0.8 to about 0.9, about 0.8 to about 1, about 0.9 to about 1.0, about 0.9 to about 1.1, about 0.9 to about 1.2, about 0.9 to about 1.3, about 0.9 to about 1.4, about 0.9 to about 1.5, about 0.9 to about 1.6, about 0.9 to about 1.7, about 0.9 to about 1.8, about 0.9 to about 1.9, about 0.9 to about 2.0, about 1.0 to about 1.0, about 1.0 to about 1.1, about 1.0 to about 1.2, about 1.0 to about 1.3, about 1.0 to about 1.4, about 1.0 to about 1.5, about 1.0 to about 1.6, about 1.0 to about 1.7, about 1.0 to about 1.8, about 1.0, to about 1.9, or about 1.0 to about 2.0. In some embodiments, the second coefficient of friction is about 0.1, about 0.2, about 0.3, about 0.4, about 0.5, about 0.6, about 0.7, about 0.8, about 0.9, about 1.0, about 1.1, about 1.2, about 1.3, about 1.4, about 1.5, about 1.6, about 1.7, about 1.8, about 1.9, or about 2.0. In some embodiments, the second coefficient of friction is at least about 0.1, about 0.2, about 0.3, about 0.4, about 0.5, about 0.6, about 0.7, about 0.8, about 0.9, about 1.0, about 1.1, about 1.2, about 1.3, about 1.4, about 1.5, about 1.6, about 1.7, about 1.8, about 1.9, or about 2.0. In some embodiments, the second coefficient of friction is at most about 0.1, about 0.2, about 0.3, about 0.4, about 0.5, about 0.6, about 0.7, about 0.8, about 0.9, about 1.0, about 1.1, about 1.2, about 1.3, about 1.4, about 1.5, about 1.6, about 1.7, about 1.8, about 1.9, or about 2.0.

In some embodiments, at least one of the support element, the compression element, the gripping element, and the base layer has a modulus of elasticity of about 0.01 GPa to about 15 GPa. In some embodiments, at least one of the support element, the compression element, the gripping element, and the base layer has a modulus of elasticity of at least about 0.01 GPa. In some embodiments, at least one of the support element, the compression element, the gripping element, and the base layer has a modulus of elasticity of at most about 15 GPa. In some embodiments, at least one of the support element, the compression element, the gripping element, and the base layer has a modulus of elasticity of about 0.01 GPa to about 0.02 GPa, about 0.01 GPa to about 0.05 GPa, about 0.01 GPa to about 0.1 GPa, about 0.01 GPa to about 0.5 GPa, about 0.01 GPa to about 1 GPa, about 0.01 GPa to about 2 GPa, about 0.01 GPa to about 5 GPa, about 0.01 GPa to about 10 GPa, about 0.01 GPa to about 15 GPa, about 0.02 GPa to about 0.05 GPa, about 0.02 GPa to about 0.1 GPa, about 0.02 GPa to about 0.5 GPa, about 0.02 GPa to about 1 GPa, about 0.02 GPa to about 2 GPa, about 0.02 GPa to about 5 GPa, about 0.02 GPa to about 10 GPa, about 0.02 GPa to about 15 GPa, about 0.05 GPa to about 0.1 GPa, about 0.05 GPa to about 0.5 GPa, about 0.05 GPa to about 1 GPa, about 0.05 GPa to about 2 GPa, about 0.05 GPa to about 5 GPa, about 0.05 GPa to about 10 GPa, about 0.05 GPa to about 15 GPa, about 0.1 GPa to about 0.5 GPa, about 0.1 GPa to about 1 GPa, about 0.1 GPa to about 2 GPa, about 0.1 GPa to about 5 GPa, about 0.1 GPa to about 10 GPa, about 0.1 GPa to about 15 GPa, about 0.5 GPa to about 1 GPa, about 0.5 GPa to about 2 GPa, about 0.5 GPa to about 5 GPa, about 0.5 GPa to about 10 GPa, about 0.5 GPa to about 15 GPa, about1 GPa to about 2 GPa, about 1 GPa to about 5 GPa, about 1 GPa to about 10 GPa, about 1 GPa to about 15 GPa, about 2 GPa to about 5 GPa, about 2 GPa to about 10 GPa, about 2 GPa to about 15 GPa, about 5 GPa to about 10 GPa, about 5 GPa to about 15 GPa, or about 10 GPa to about 15 GPa. In some embodiments, at least one of the support element, the compression element, the gripping element, and the base layer has a modulus of elasticity of about 0.01 GPa, about 0.02 GPa, about 0.05 GPa, about 0.1 GPa, about 0.5 GPa, about 1 GPa, about 2 GPa, about 3 GPa, about 4 GPa, about 5 GPa, about 6 GPa, about 7 GPa, about 8 GPa, about 9 GPa, about 10 GPa, about 11 GPa, about 12 GPa, about 13 GPa, about 14 GPa, or about 15 GPa. In some embodiments, at least one of the support element, the compression element, the gripping element, and the base layer has a modulus of elasticity of at least about 0.01 GPa, about 0.02 GPa, about 0.05 GPa, about 0.1 GPa, about 0.5 GPa, about 1 GPa, about 2 GPa, about 3 GPa, about 4 GPa, about 5 GPa, about 6 GPa, about 7 GPa, about 8 GPa, about 9 GPa, about 10 GPa, about 11 GPa, about 12 GPa, about 13 GPa, about 14 GPa, or about 15 GPa. In some embodiments, at least one of the support element, the compression element, the gripping element, and the base layer has a modulus of elasticity of at most about 0.01 GPa, about 0.02 GPa, about 0.05 GPa, about 0.1 GPa, about 0.5 GPa, about 1 GPa, about 2 GPa, about 3 GPa, about 4 GPa, about 5 GPa, about 6 GPa, about 7 GPa, about 8 GPa, about 9 GPa, about 10 GPa, about 11 GPa, about 12 GPa, about 13 GPa, about 14 GPa, or about 15 GPa.

In some embodiments, at least one of the support element, the compression element, the gripping element, and the base layer comprises two or more layers. In some embodiments, at least one of the support element, the compression element, the gripping element, and the base layer is durable, waterproof, stain-proof, hypoallergenic, antibacterial, self-healing, heat resistant, friction resistant, or any combination thereof. In some embodiments, the at least one gripping element or the base layer is formed of a polymeric material or composite material. In some embodiments, the at least one support element comprises a cervical support device. In some embodiments, the cervical support device comprises the non-Newtonian material integrated into the base layer by at least one laminated layer. In some embodiments, the cervical support device comprises an inner mesh liner positioned within an interior of the base layer in contact with a wearer's neck. In some embodiments, at least one of the compression elements comprises a polymeric material or composite material. In some embodiments, at least one of the compression elements comprise silicone, nylon, lycra, rubber, neoprene, vinyl, polyurethane, or any combination thereof. In some embodiments, the at least one support element comprises an elastomeric polymer. In some embodiments, the at least one support element comprises a gel, a foam, a non-Newtonian fluid, or any combination thereof. In some embodiments, the foam comprises a non-Newtonian fluid. In some embodiments, the foam comprises a shear thickening non-Newtonian fluid. In some embodiments, the non-Newtonian foam is encapsulated within a pouch. In some embodiments, the non-Newtonian fluid is encapsulated in a pouch. In some embodiments, the non-Newtonian fluid comprises a shear thickening non-Newtonian fluid. In some embodiments, the at least one support element comprises a non-Newtonian foam and a non-Newtonian fluid. In some embodiments, the at least one support element comprises a Newtonian foam material positioned between the body surface of the subject and the non-Newtonian material.

In some embodiments, the non-Newtonian material has a power rule number of about 0.01 to about 0.99. In some embodiments, the non-Newtonian material has a power rule number of at least about 0.01. In some embodiments, the non-Newtonian material has a power rule number of at most about 0.99. In some embodiments, the non-Newtonian material has a power rule number of about 0.01 to about 0.02, about 0.01 to about 0.05, about 0.01 to about 0.1, about 0.01 to about 0.2, about 0.01 to about 0.3, about 0.01 to about 0.4, about 0.01 to about 0.5, about 0.01 to about 0.6, about 0.01 to about 0.7, about 0.01 to about 0.8, about 0.01 to about 0.99, about 0.02 to about 0.05, about 0.02 to about 0.1, about 0.02 to about 0.2, about 0.02 to about 0.3, about 0.02 to about 0.4, about 0.02 to about 0.5, about 0.02 to about 0.6, about 0.02 to about 0.7, about 0.02 to about 0.8, about 0.02 to about 0.99, about 0.05 to about 0.1, about 0.05 to about 0.2, about 0.05 to about 0.3, about 0.05 to about 0.4, about 0.05 to about 0.5, about 0.05 to about 0.6, about 0.05 to about 0.7, about 0.05 to about 0.8, about 0.05 to about 0.99, about 0.1to about 0.2, about 0.1 to about 0.3, about 0.1 to about 0.4, about 0.1 to about 0.5, about 0.1 to about 0.6, about 0.1 to about 0.7, about 0.1 to about 0.8, about 0.1 to about 0.99, about 0.2 to about 0.3, about 0.2 to about 0.4, about 0.2 to about 0.5, about 0.2 to about 0.6, about 0.2 to about 0.7, about 0.2 to about 0.8, about 0.2 to about 0.99, about 0.3 to about 0.4, about 0.3 to about 0.5, about 0.3 to about 0.6, about 0.3 to about 0.7, about 0.3 to about 0.8, about 0.3 to about 0.99, about 0.4 to about 0.5, about 0.4 to about 0.6, about 0.4 to about 0.7, about 0.4 to about 0.8, about 0.4 to about 0.99, about 0.5 to about 0.6, about 0.5 to about 0.7, about 0.5 to about 0.8, about 0.5 to about 0.99, about 0.6 to about 0.7, about 0.6 to about 0.8, about 0.6 to about 0.99, about 0.7to about 0.8, about 0.7 to about 0.99, or about 0.8 to about 0.99. In some embodiments, the non-Newtonian material has a power rule number of about 0.01, about 0.02, about 0.05, about 0.1, about 0.2, about 0.3, about 0.4, about 0.5, about 0.6, about 0.7, about 0.8, or about 0.99. In some embodiments, the non-Newtonian material has a power rule number of at least about 0.01, about 0.02, about 0.05, about 0.1, about 0.2, about 0.3, about 0.4, about 0.5, about 0.6, about 0.7, about 0.8, or about 0.99. In some embodiments, the non-Newtonian material has a power rule number of at most about 0.01, about 0.02, about 0.05, about 0.1, about 0.2, about 0.3, about 0.4, about 0.5, about 0.6, about 0.7, about 0.8, or about 0.99.

In some embodiments, the at least one gripping element is configured to exert at least one of a normal and a tangential force upon the body surface of the wearer. In some embodiments, the at least one gripping element is configured to exert at least one of a normal and a tangential force upon the body surface of the wearer to prevent substantial shifting of the article across the skin of the wearer. In some embodiments, the at least one gripping element comprises a surface texture configured to exert a tangential force upon the body surface of the wearer. In some embodiments, the at least one support element is configured to provide stress relief, load transfer, fatigue relief, or any combination thereof to the wearer. In some embodiments, the at least one support element is configured to provide resistance to movement of at least one of a muscle, a joint, or a bone of a wearer, wherein the resistance increases with increasing force of the movement. In some embodiments, the at least one support element is configured to exert the force on at least one of the muscle, the joint, or the bone of a wearer throughout the wearer's full or partial range of motion in one or more degrees of freedom. In some embodiments, the force comprises a continuous force, a proportional force, a derivative force, or any combination thereof. In some embodiments, at least one of the proportional force and the derivative force is based on a linear position, an angular position, a velocity, or an acceleration of the bone, the muscle, or the joint of the wearer. In some embodiments, the muscle comprises a bicep, a triceps, a deltoid, a forearm, a thigh, a calf, a trapezius, a glute, a neck, a chest, an oblique, an upper back, a lower back, or an abdominal muscle. In some embodiments, the joint comprises an ankle, a knee, a hip, a spine, a wrist, an elbow, or a shoulder joint. In some embodiments, the bone comprises an ankle, a knee, a hip, a spine, a wrist, an elbow, a shoulder, a tibia, a fibula, an arm, a neck, or a rib bone. In some embodiments, the neck support comprises a penannular collar member that is anatomically complementary with a neck of the wearer. In some embodiments, the neck support comprises an elastomeric material or a force-reactive polymer positioned around a rear and lateral sides of a neck of the wearer. In some embodiments, at least one of the neck support, the spine support, the thigh support, and the shin support comprises a furrow. In some embodiments, at least one of the neck support, the spine support, the thigh support, and the shin support comprises a plurality of furrows comprising 2, 3, 4, 5, 6, 7, 8, 9, or 10 or more furrows. In some embodiments, two or more of the plurality of furrows have equivalent sizes or shapes. In some embodiments, two or more of the plurality of furrows have non-equivalent sizes or shapes. In some embodiments, the furrow is configured to flex or fold along a set line, arch, or plane. In some embodiments, the furrow is configured to prevent or inhibit motion of the wearer in one or more degrees of freedom. In some embodiments, the at least one compression element is configured to provide stress support, load transfer, fatigue relief, or any combination thereof to the wearer. In some embodiments, the at least one compression element is configured to exert a force on a muscle a bone, or a joint of a wearer. In some embodiments, the at least one compression element is configured to exert a force on muscle, bone, or joint of a wearer throughout a full or partial range of motion of the muscle, bone, or joint. In some embodiments, the force comprises a continuous force, a proportional force, a derivative force, or any combination thereof. In some embodiments, at least one of the proportional force and the derivative force are based on a linear position, an angular position, a velocity, or an acceleration of the bone, the muscle, or the joint of the wearer. In some embodiments, the muscle comprises a bicep, a triceps, a deltoid, a forearm, a thigh, a calf, a trapezius, a glute, a neck, a chest, or abdominal muscle. In some embodiments, the joint comprises an ankle, a knee, a hip, a spine, a wrist, an elbow, or a shoulder joint. In some embodiments, the bone comprises an ankle, a knee, a hip, a spine, a wrist, an elbow, a shoulder, a tibia, a fibula, an arm, a neck, or a rib bone. In some embodiments, the article further comprises a harness secured to at least one support element. In some embodiments, the harness is integrated into the base layer. In some embodiments, the harness is laminated or printed adjacent to the base layer. In some embodiments, the article further comprises at least one adjustable tension element. In some embodiments, the at least one adjustable tension element comprises at least one of a chest tension element, an abdominal tension element, a waist tension element, a thigh tension element, or a shin tension element. In some embodiments, the at least one adjustable tension element comprises a strap, a fastener, a buckle, a hook and loop fastener, a zipper, a button, a hook, an eye, a lace, a magnet, a clasp, a clip, a screw, a bolt, a nut, a tie, or any combination thereof. In some embodiments, the article is a shirt, a pair of pants, or a full body suit. In some embodiments, the base layer has bilateral symmetry.

Another aspect provided herein is a method for forming an article wearable by a subject, comprising: providing a base layer having an interior surface and an exterior surface, wherein the interior surface has a first coefficient of friction (1) relative to a body surface of the subject, and wherein the base layer has a first modulus of elasticity (E1); coupling at least one gripping element to the interior surface of the base layer, wherein the at least one gripping element is configured to contact a body of the subject, and wherein the at least one gripping element has a second coefficient of friction ($\mu 2$) relative to the body surface, wherein $\mu 2$ is greater than $\mu 1$; coupling at least one compression element to the base layer, wherein the at least one compression element has a second modulus of elasticity (E2) that is greater than E1; and coupling at least one support element comprising a non-Newtonian material to the base layer.

In some embodiments, the method further comprises laminating or printing the compression element or gripping element adjacent to the base layer. In some embodiments, the printing is three-dimensional printing. In some embodiments, at least one of the support element, the compression element, and the gripping element is irremovably attached to the base layer. In some embodiments, at least one of the support element, the compression element, and the gripping element is removably attached to the base layer. In some embodiments, the at least one support element comprises a neck support. In some embodiments, the neck support comprises a penannular collar member that is anatomically complementary with a neck of the wearer. In some embodiments, the neck support comprises an elastomeric material or a force-reactive polymer positioned around a rear and lateral sides of a neck of the wearer. In some embodiments, the at least one support element comprises a spine support comprising at least one furrow configured to flex or fold along a set line, arch, or plane.

Another aspect provided herein is a method for mounting an article on a body of a subject, comprising: providing the article comprising a base layer having an interior surface and an exterior surface, wherein the interior surface has a first coefficient of friction ($\mu 1$) relative to a body surface of the subject, and wherein the base layer has a first modulus of elasticity (E1); at least one gripping element coupled to the interior surface of the base layer, wherein the at least one gripping element is configured to contact a body of the subject, and wherein the at least one gripping element has a second coefficient of friction ($\mu 2$) relative to the body surface, wherein $\mu 2$ is greater than $\mu 1$; at least one compression element coupled to the base layer, wherein the at least one compression element has a second modulus of elasticity (E2) that is greater than E1; and at least one support element comprising a non-Newtonian material coupled to the base layer; and mounting the article on a body of the subject, wherein when mounted on the body of the subject, the interior surface and the at least one gripping element contact the body surface of the subject at $\mu 2$ greater than $\mu 1$.

In some embodiments, when mounted on the body of the subject, the at least one gripping element contacts the body surface of the subject such that the article slides by at most 5 centimeters, 4 centimeters, 3 centimeters, 2 centimeters, or 1 centimeter. In some embodiments, when mounted on the body of the subject, the at least one gripping element contacts the body surface of the subject such that the article slides by at most 20°, 15°, 10°, 5°, or 1° about a point on the body of the subject. In some embodiments, when mounted on the body of the subject, the at least one gripping element contacts the body surface of the subject such that the article slides in a first direction by at most about 25%, 20%, 15%, 10%, 5%, or 1% of the length of the gripping element in the first direction. In some embodiments, when mounted on the body of the subject, the at least one support element provide stress relief, load transfer, fatigue relief, or any combination thereof to the subject. In some embodiments, when mounted on the body of the subject, the non-Newtonian material of the at least one support element comprises: a first viscosity (v1) allowing unrestricted motion by the subject when the motion exerts a first force (F1) upon the at least one support element; and a second viscosity (v2) restricting motion by the subject when the motion exerts a second force (F2) upon the at least one support element, wherein F2 is greater than F1 and v2 is greater than v1. In some embodiments, when mounted on the body of the subject, the at least one support element provides resistance to movement of at least one of a muscle, a joint, or a bone of the subject, wherein the resistance increases with increasing force of the movement. In some embodiments, when mounted on the body of the subject, the at least one support element exerts a force on at least one of a muscle, a joint, or a bone of the subject throughout a full or partial range of motion in one or more degrees of freedom. In some embodiments, when mounted on the body of the subject, the at least one compression element provides stress support, load transfer, fatigue relief, or any combination thereof to the subject. In some embodiments, when mounted on the body of the subject, the at least one compression element is configured to exert a force on a muscle, bone, or joint of a wearer throughout a full or partial range of motion of the muscle, bone, or joint.

Another aspect provided herein is a wearable article comprising a force-directing frame comprising a plurality of frame elements and a quantity of rate-sensitive materials. In some embodiments, the force-directing frame is shaped and dimensioned to be anatomically complementary to a body region of a subject. In some embodiments, at least one fastener is adapted to secure the wearable article on the subject in registration with the body region in close topographical engagement therewith. In some embodiments, the frame elements form at least one deformable region within the frame, and the rate-sensitive material is disposed within the deformable region(s). In some embodiments, the frame elements are configured to, when the wearable article is secured on the body region, divert at least a portion of internal contortion forces within the body region through the frame elements to the deformable region(s) whereby the rate-sensitive material dampens the diverted internal contortion forces by deformation of the rate-sensitive material within the deformable region(s).

Another aspect provided herein is a method for limiting injurious motion comprising diverting, through a wearable article secured on a body region of a subject, at least a portion of internal contortion forces within the body region to rate-sensitive material disposed within at least one deformable region within a frame of the wearable article, and damping the diverted internal contortion forces by deformation of the rate-sensitive material within the deformable region(s). In some preferred embodiments, the wearable article is secured on the subject externally and non-invasively.

Another aspect provided herein is an article comprising an anatomical support and at least one fastener. In some embodiments, the anatomical support comprises at least one force-directing frame and at least one damper engaged with the force-directing frame(s) to absorb forces from the force-directing frame(s), with the force-directing frame(s) being relatively more rigid than the damper(s). In some embodiments, the force-directing frame(s) and the damper(s) are shaped and positioned relative to one another to be anatomically complementary to an anatomical structure of a subject, whereby the anatomical support has an engagement surface that conforms to external surface contours of the anatomical structure. In some embodiments, the fastener(s) secure the anatomical support on the subject in registration with the anatomical structure and with the engagement surface in close topographical engagement with the surface contours of the anatomical structure so that forces are transferred from hard tissue in the anatomical structure to the force-directing frame(s). In some embodiments, when the anatomical support is secured, at least a portion of the forces applied to the hard tissue are diverted away from soft tissue in the anatomical structure to the damper(s) by transfer of the forces from the hard tissue through the force-directing frame(s) to the damper(s) whereby the damper(s) absorb the transferred portion of the forces and thereby limit internal forces applied to the soft tissue by the hard tissue. In some embodiments, a force-directing frame comprises a plurality of discrete force-directing elements spaced from one another by the damper(s) extending between adjacent ones of the discrete force-directing elements.

Another aspect provided herein is a method for inhibiting injury of an anatomical structure of a subject when the anatomical structure is subjected to forces comprises securing an anatomical support to the subject, where the anatomical support comprises at least one force-directing frame and at least one damper engaged with the force-directing frame(s) to absorb forces from the force-directing frame(s), with the force-directing frame(s) being relatively more rigid than the damper(s). In some embodiments, the method further comprises diverting, by the force-directing frame(s), at least a portion of forces applied to hard tissue in the anatomical structure away from soft tissue in the anatomical structure by transfer of the forces from the hard tissue through the force-directing frame(s) to the damper(s) whereby the damper(s) absorb the transferred portion of the forces and thereby limit internal forces applied to the soft tissue by the hard tissue. In some embodiments, the anatomical support is secured to the subject externally and non-invasively.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

A better understanding of the features and advantages of the present invention will be obtained by reference to the following detailed description that sets forth illustrative embodiments and the accompanying drawings of which.

DETAILED DESCRIPTION OF THE INVENTION

Figure 1:
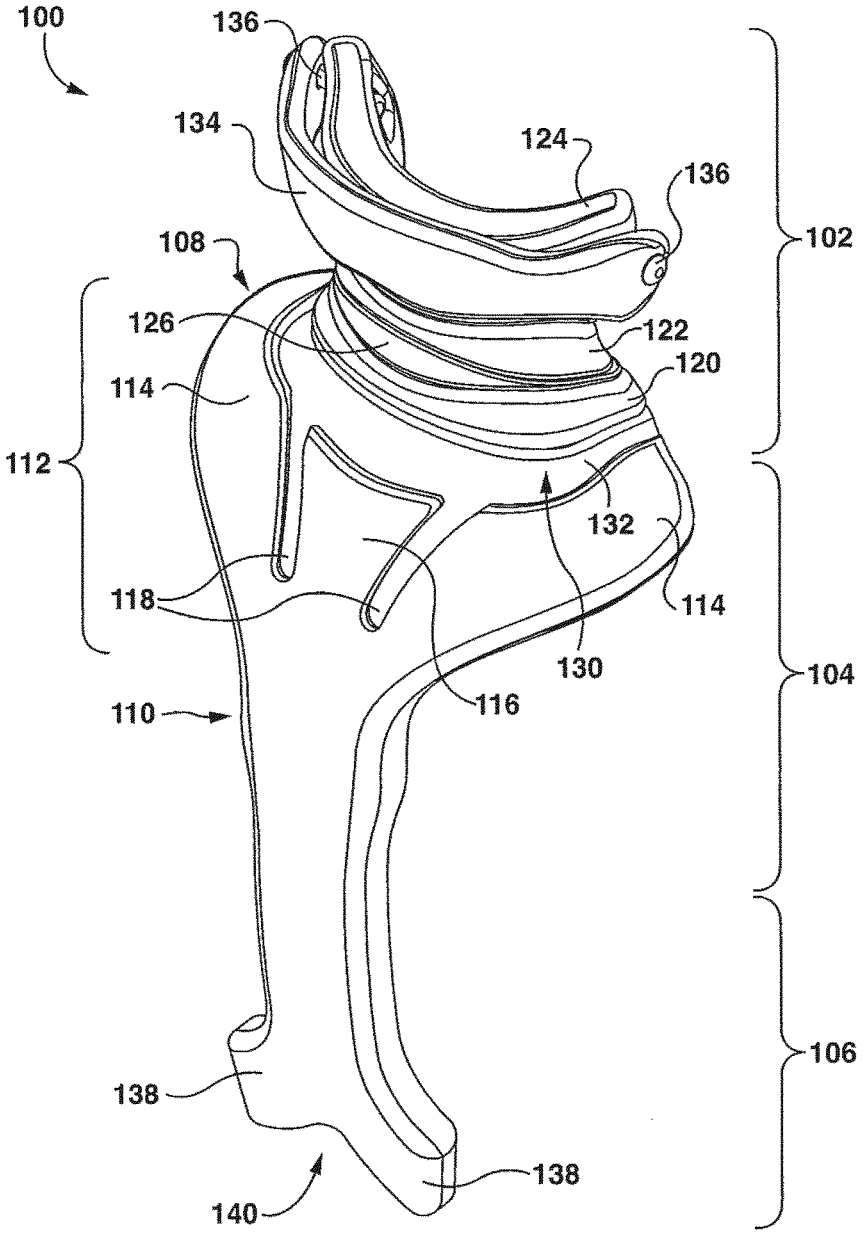
FIG. 1 is a superior dorsal isometric view of a first exemplary spinal support device, in accordance with some embodiments.
Figure 2:
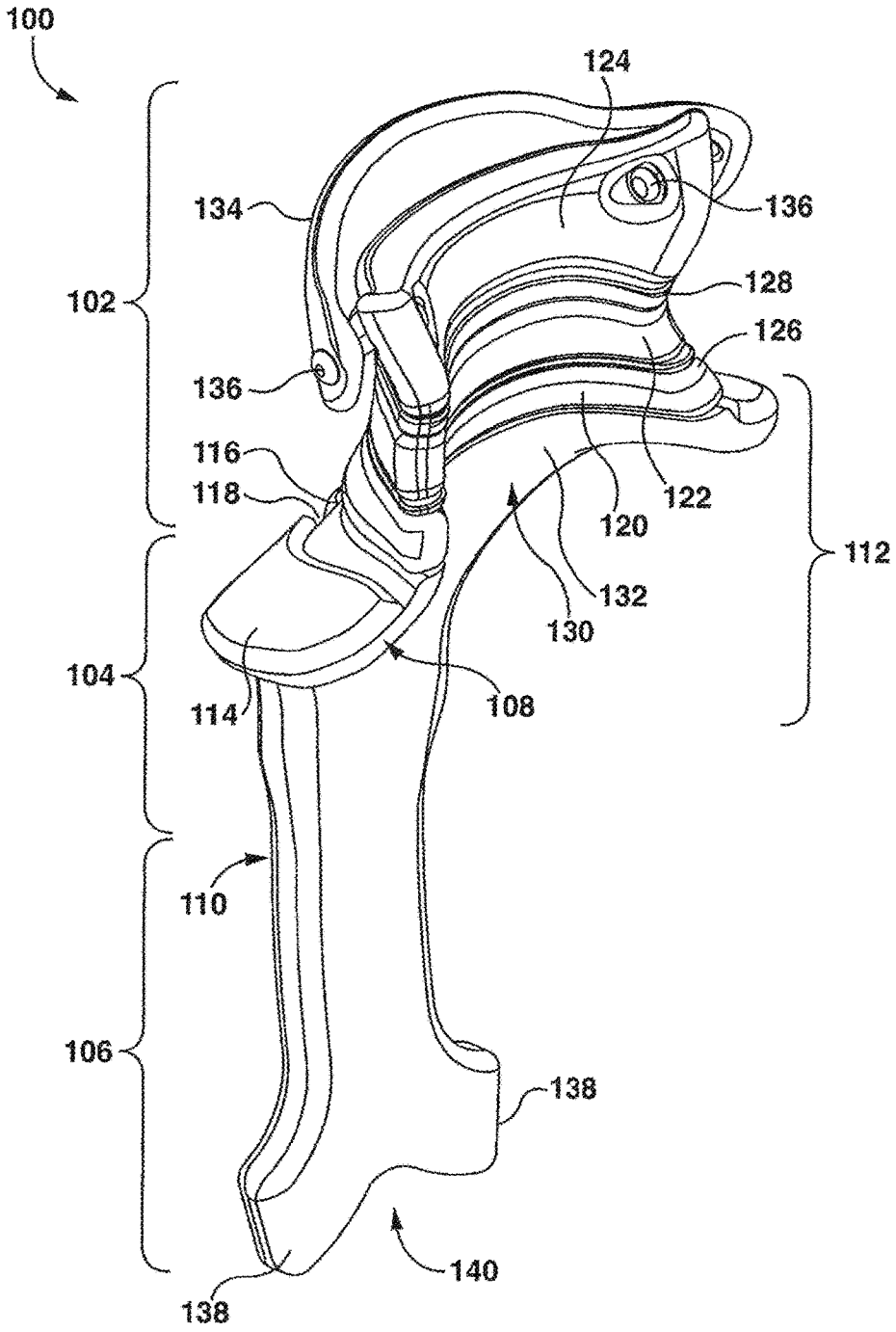
FIG. 2 is a superior ventral isometric view of the spinal support device of FIG. 1, in accordance with some embodiments.
Figure 3:
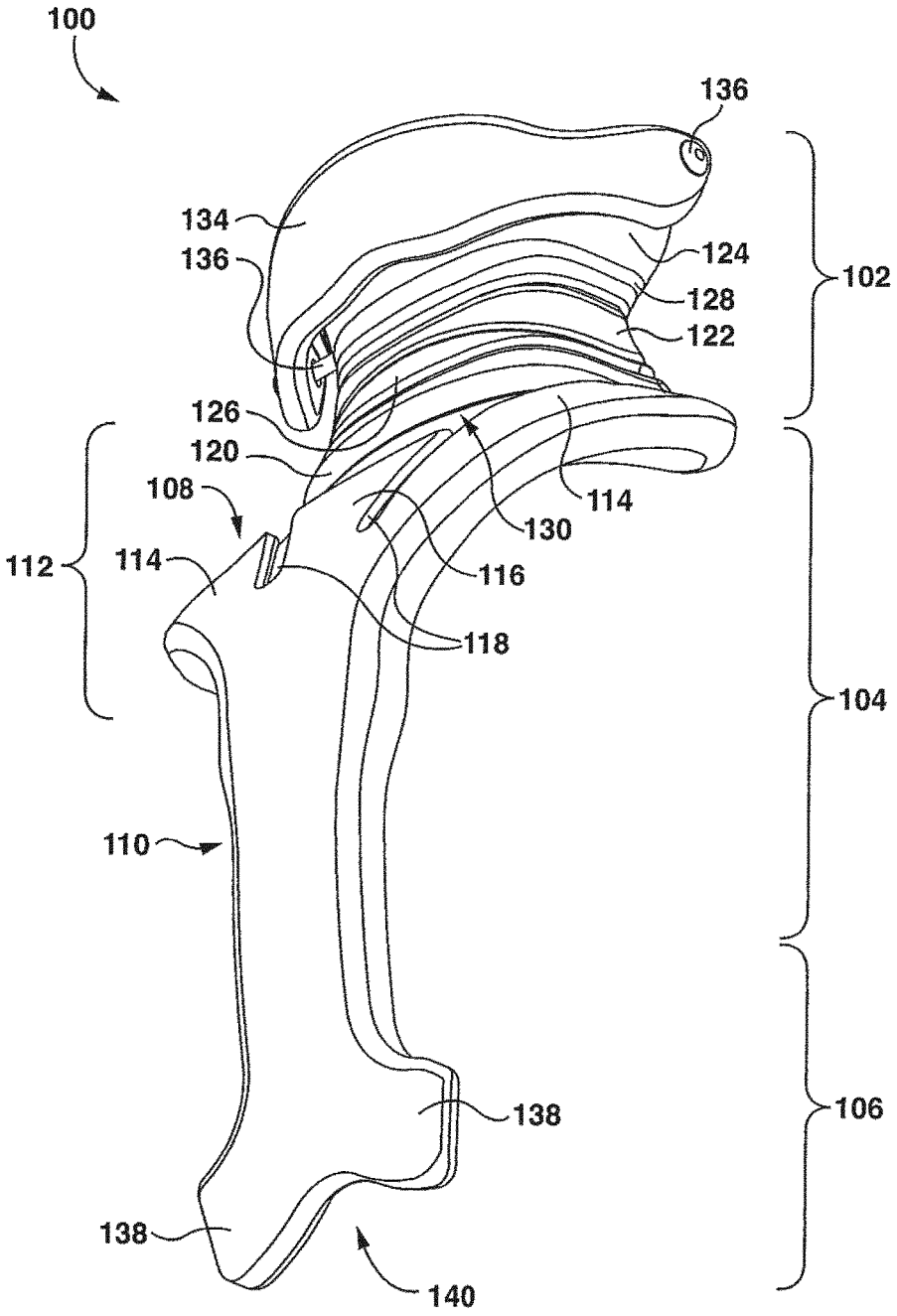
FIG. 3 is an inferior dorsal isometric view of the spinal support device of FIG. 1, in accordance with some embodiments.
Figure 4:
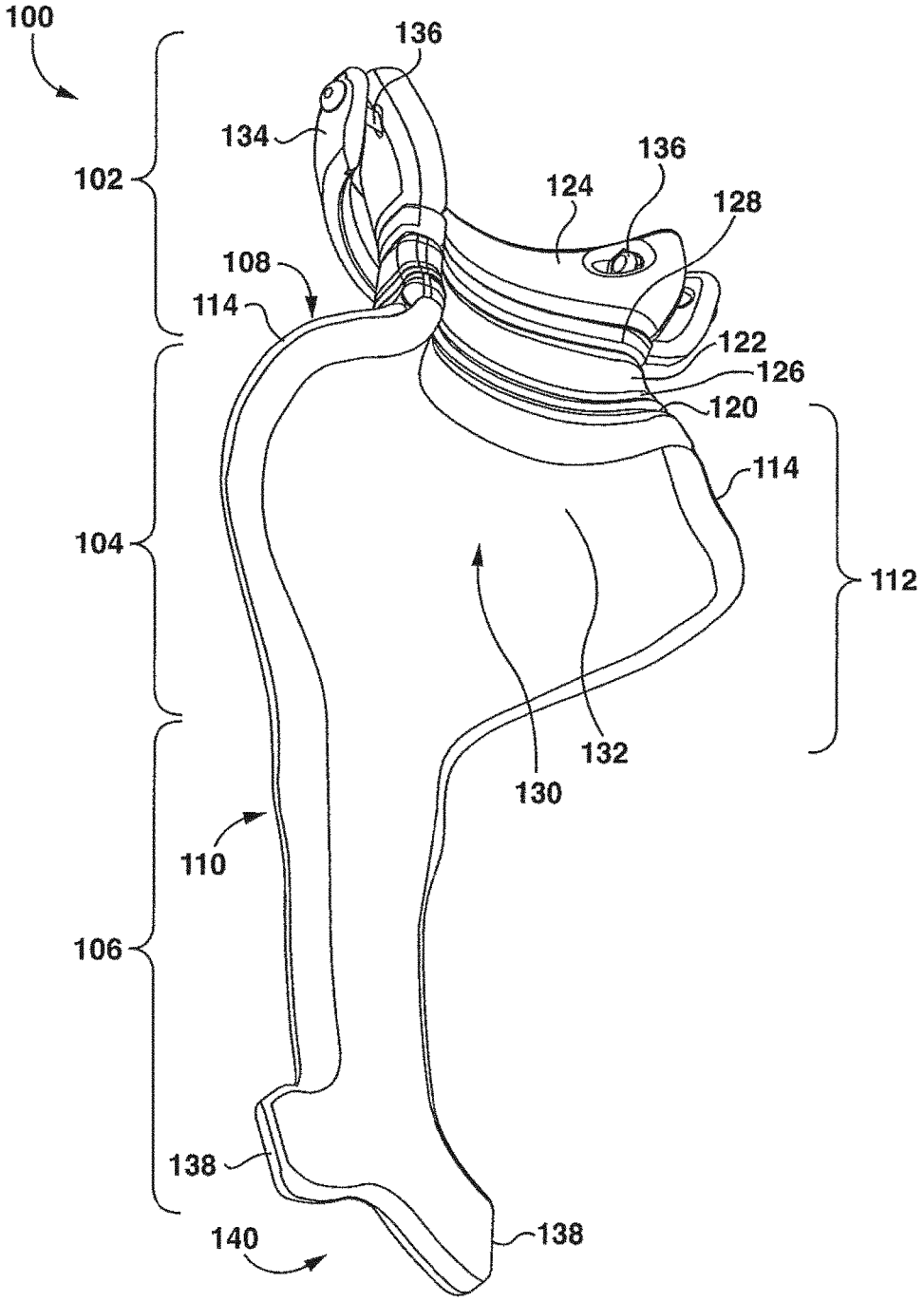
FIG. 4 is an inferior ventral isometric view of the spinal support device of FIG. 1, in accordance with some embodiments.
Figure 5:
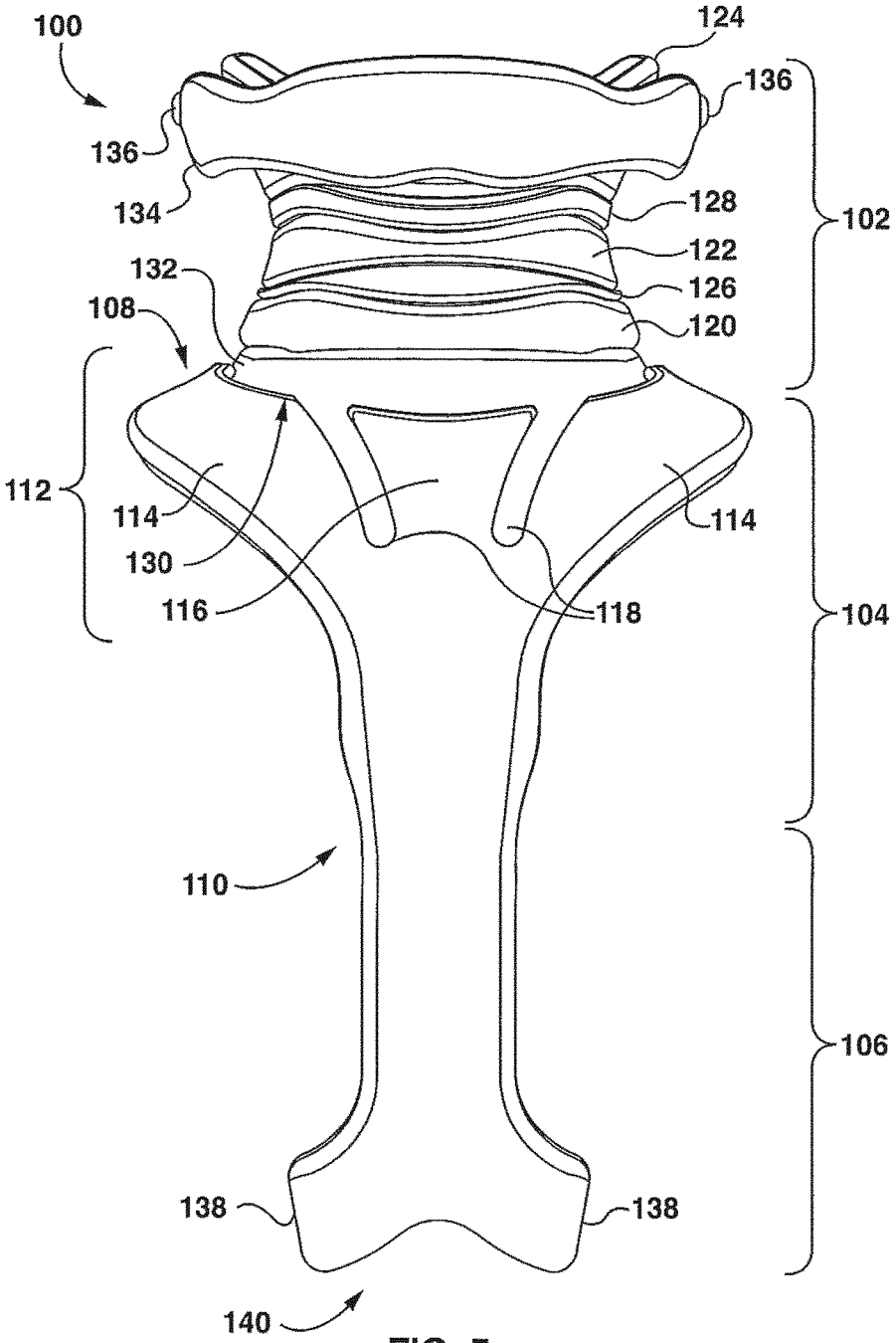
FIG. 5 is a front (dorsal) elevation view of the spinal support device of FIG. 1, in accordance with some embodiments.

Disclosed herein, in certain aspects, are wearable articles that integrate a rate-sensitive material to provide protection without sacrificing freedom of motion. The spinal support devices or support elements constructed according to the present disclosure reduce muscle fatigue by supporting the head and neck in lateral motion and flexion, and by absorbing rotational energy during lateral motion/flexion of the head and neck during an impact, a blow, or any acceleration greater than the one the subject can generate by himself. The support elements are configured to provide increasing resistance and energy absorption in response to the degree of the applied force.

In some embodiments, the wearable article comprises a force-directing frame comprising a plurality of frame elements, and is shaped and dimensioned to be anatomically complementary to a body region of a subject. The subjects with which the wearable articles are used are preferably vertebrates, more preferably mammals and most preferably human. Thus, wearable articles according to the principles elucidated in the present disclosure may include not only humans but, for example and without limitation, ungulates such as sheep, goats, horses, donkeys and mules, reptiles, amphibians, companion animals such as dogs and cats, and other pets such as birds and rodents. Wearable articles according to the present disclosure may be incorporated into protective equipment worn not only by humans but also by military and police animals such as dogs and horses. Wearable articles as disclosed herein may be used in both human and veterinary medical applications, preferably without any surgical implantation.

In some embodiments, the rate-sensitive material is coupled to the frame, and at least one fastener is coupled (directly or indirectly) to the frame and adapted to secure the wearable article on the subject. A wide variety of fasteners can be used, including but not limited to one or more of harnesses, straps, integration into articles, and so on. In the case of harnesses or straps, these may be removable or permanently affixed. Preferably, the wearable article is secured externally, that is, outside of the body of the subject, and non-invasively, that is, without surgery or implantation of any elements into the body of the subject, although embodiments in which all or part of the support is implanted are also contemplated. As noted above, the wearable article can be anatomically complementary to the body region with which it will be used.

In some embodiments, the wearable article will include an engagement surface, which may be a continuous surface or an interrupted surface, for engaging the body region. The engagement surface may include channels and/or protrusions to facilitate airflow. The shape of the engagement surface is complementary to the surface contours of the anatomical structure of the body region to which the wearable article is secured. For example, where the body region is the neck and trapezius muscles, the wearable article may have an elongate channel which receives the neck and then broadens at the base to accommodate the trapezius muscles. Similarly, a wearable article for an elbow joint may be shaped to engage the distal brachium, antecubitis, olecranon and proximal antebrachium, or parts thereof, and include an engagement surface adapted for such purpose. These are merely examples of body regions with which wearable articles described herein may be used, and are not intended to be limiting. For example, and without limitation, wearable articles according to the present disclosure may adapted to provide support to all or part of any of the head and neck in combination, the neck, the torso, the spine, one or both shoulders, one or both elbows, one or both wrists, one or both hands, one or both hips, one or both knees, one or both ankles, and/or one or both feet.

When secured by the fastener(s), in certain embodiments, the wearable article will be in registration with the body region in close topographical engagement therewith. For example, one or more layers of sufficiently thin, close-fitting clothing, including protective clothing, may be interposed between the body region and the wearable article without preventing close topographical engagement between the body region and the wearable article. Moreover, the term "close topographical engagement" encompasses gaps in engagement between the wearable article and the body region (e.g. an interrupted engagement surface), for example for ventilation or for mobility, as long as there is sufficient engagement to permit effective transmission of forces from the body region to the wearable article.

In some embodiments, the frame elements of the force-directing frame form at least one deformable region within the frame; that is, a region of the frame which can undergo deformation in response to forces applied to the frame. This deformation can be achieved, for example and without limitation, by resilience/flexibility of all or part of the relevant frame members, including areas of reduced thickness serving as living hinges, by conventional hinging of one frame element to another, by one frame element being slidably engaged with another frame elements, by combinations of the foregoing, or by other suitable techniques. In some embodiments, the force-directing frame comprises a monolithic unit, or alternatively, a plurality of individual frame elements, which are connected to one another, separate and spaced from one another, or a combination (e.g. some frame elements may be connected to other frame elements and some frame elements may not be connected to other frame elements).

In some embodiments, the frame elements are configured to, when the wearable article is secured on the body region, divert at least a portion of internal contortion forces within the body region through the frame elements to the deformable region(s); the force transfer is achieved by way of the close topographical engagement between the wearable article and the body region. The term "internal contortion forces" refers to the movements of anatomical structures relative to one another during movement of the body, for example the relative movements of bones, cartilage, muscle, and other soft tissue during flexion, extension, or rotation of a joint. The internal contortion forces may be the result of externally applied forces, internal forces generated by the musculature of the body region, or a combination of both internal and external forces. For example, an athlete or soldier may be subjected to external forces by a projectile impact which causes movement of his or her body, or subjected to internal forces when spinning suddenly in response to a noise, or to both internal and external forces when attempting to maintain balance during a contact sport (e.g. American football, rugby or martial arts) or in actual hand-to-hand, hand-to-weapon or weapon-to-weapon combat.

In some embodiments, the rate-sensitive material is disposed at least within the deformable region(s), and the rate-sensitive material damps the diverted internal contortion forces by deformation of the rate-sensitive material within the deformable region(s). In effect, the deformable regions containing the rate-sensitive material function as "crumple zones" which absorb some of the forces (internal, external or both) that would otherwise be applied to the body region. The particular rate-sensitive material used, and its density and thickness, will depend on how the wearable article will be used (e.g. the nature of the activity) and the body region with which the wearable article may be used, and may also depend on the characteristics of the individual subject (e.g. height, weight, strength and other conditioning factors, etc.). Moreover, different types, thicknesses and densities of rate-sensitive materials may be used in different deformable regions or even within a single deformable region (e.g. laminated in layers or arranged in a deformable sequence), and the properties of the rate-sensitive material (s) may be further tuned by applying suitable coatings or laminates to surface(s) of the rate-sensitive materials, for example to modify the surface tension of the rate-sensitive materials. In some embodiments, the wearable article comprises a monolithic quantity of rate-sensitive material, and the frame elements may be overlaid onto or set into the rate-sensitive material to form the force-directing frame and define the deformable regions. In other embodiments, discrete, separate individual portions of rate-sensitive materials may be disposed in the deformable regions.

In some embodiments, the precise shape, location and configuration of the deformable region(s) will depend on the particular application in which the wearable article is to be used and/or the body region to be supported. In one preferred embodiment, the wearable article is anatomically non-restrictive. One preferred approach is to recreate, mimic, emulate or conform to anatomical structural arrays or groupings, such as for example all or part of any of the head and neck in combination, the neck, the torso, the spine, one or both shoulders, one or both elbows, one or both wrists, one or both hands, one or both hips, one or both knees, one or both ankles, and/or one or both feet. By recreating, mimicking, emulating or conforming to anatomical structural arrays the wearable article can, by its close topographical engagement with the body region, divert at least some of the internal contortion forces away from vulnerable soft tissues and strategically direct the diverted forces to the deformable region(s) where those forces can be attenuated, absorbed or damped by the rate-sensitive materials therein. In some such embodiments the frame elements correspond to hard tissue such as bone and/or cartilage and the deformable regions containing rate-sensitive materials may correspond to soft tissue such as muscle and connective tissue. In such embodiments, the frame elements is positioned in registration with hard tissues that would transmit the forces and the deformable regions containing the rate-sensitive materials may be positioned in registration with those soft tissues in the body region that would undergo deformation when subjected to internal contortion forces and be susceptible to injury as a result. In some instances, registration between the frame elements and the hard tissues and/or between the deformable regions and the vulnerable soft tissues is not required so long as the wearable article is configured to divert at least some of the internal contortion forces away from vulnerable soft tissues and strategically direct the diverted forces to the deformable region(s). In either case, the configuration of the wearable article is preferably such that it permits the wearer to move the relevant body region(s) through substantially normal ranges of motion (e.g. flexion, extension, rotation). In some embodiments, the primary protection provided by the wearable article results not from substantial restrictions on range of motion, but from diversion of internal contortion forces to the deformable regions where the properties of the rate-sensitive materials therein can be exploited.

As noted above, a rate-sensitive material can be a material whose resistance to applied force increases with increasing force. In some embodiments, wearable articles according to the present disclosure leverage the compressible/expandable/viscoelastic properties of rate-sensitive materials. By selection of appropriate rate-sensitive materials for the activities with which the wearable article will be used, a wearable article can be constructed in which the rate-sensitive materials will offer very little resistance to the diverted internal contortion forces when those forces are applied at the rates expected for that activity. As such, the wearable article will provide little resistance to the subject's ordinary motion during the activity. At moments of high energy (e.g. sudden hyperextension, acceleration, deceleration such as arising from an impact), the internal contortion forces will be applied at a much higher rate. When a portion of those higher-rate internal contortion forces are diverted to the deformable regions, they will meet much greater resistance from the rate-sensitive material therein. The effect of this greater resistance is a damping or absorption of the diverted internal contortion forces, which may result in the stabilization of movements or articulations known to cause injury. For example, without limitation and without promising any particular utility, it is contemplated that suitably designed wearable articles according to the present disclosure may assist in preventing or reducing whiplash, reducing fatigue, reducing the effect of applied G-forces (e.g. for aircrews), providing passive stabilization, providing load offset, providing lateral resistance, providing anterior and posterior resistance, improving and stabilizing posture, injury stabilization and immobilization, and anti-inversion sprain prevention.

While some preferred embodiments are anatomically non-restrictive, other embodiments may be anatomically restrictive, that is, they may impose substantial restrictions on the wearer's ordinary range of motion for the affected body region. Anatomically restrictive embodiments may be advantageous, for example, in injury stabilization and post-surgical applications, or in preventing neck fatigue (e.g. in pilots).

Notably, performance of the wearable articles disclosed herein is not dependent solely on the properties of the rate-sensitive materials, but on the interaction between the rate-sensitive materials and the materials of the force-directing frame; although, in some cases wearable articles are constructed according to the principles described herein using conventionally resilient materials in place of rate-sensitive materials. Moreover, the force-directing frame may take a wide range of forms so long as it performs the function of directing the energy dissipation by distributing forces to specific areas of the rate-sensitive material (or resilient material). For example, a force-directing frame may comprise or consist of one or more regions of thin film (which may be of monolithic or composite structure) having suitable force-directing properties and that is laminated, adhered, or otherwise secured to the rate-sensitive material (or resilient material). The term "energy-absorbing material" is used herein to encompass both rate-sensitive materials and conventional resilient materials.

As noted above, in certain embodiments, the deformable regions containing the rate-sensitive material function as "crumple zones" which absorb some of the forces (internal, external or both) that would otherwise be applied to the body region. In some embodiments, the frame elements control the surface of the rate-sensitive material to transform what would otherwise be a flexing motion into compression, where the rate-sensitive material is most effective in absorbing/damping force. More particularly, the frame elements may be made from a material that is harder, e.g. more rigid, than the rate-sensitive material, and the surfaces of the frame elements can compress the rate-sensitive material so that the shape and configuration of the frame elements can direct where, and to what degree, the rate-sensitive material absorbs energy. For example, the frame elements may be rigid or semi-rigid, so long as they are sufficiently more rigid than the rate-sensitive material to effectively control the compression of the particular rate-sensitive materials given the forces expected to be applied. The properties (e.g. rigidity) of the frame elements and the properties (e.g. density) of the rate-sensitive material will depend on the activity with which the wearable article will be used. More rigid frame elements and denser rate-sensitive material may be used for high intensity sports/activities (e.g. hockey, football, military, motor sports) and less rigid frame elements and lower density rate-sensitive material may be used for low intensity applications (e.g. injury recovery, proprioception, mitigation of neck/joint fatigue or strain, etc.). In certain applications, the energy-absorbing material in one or more of the deformable regions may function as a symphyseal resistive joint (as described below).

In some embodiments, one or more of the frame elements include a projection, layer, or outer surface which extends over a deformation region to provide additional protection (e.g. impact protection). For example, a rigid foam or rubber material may be provided around the knees, elbows or other joints. Wearable articles as described herein may include or be integrated with one or more additional layers to provide additional functionality For example, additional layers may provide padding for impact protection, cut protection, projection against projectiles (e.g. a layer of para-aramid synthetic fiber such as that marketed under the trademark Kevlar®), insulation, or comfort. Optionally, the additional layers may be interchangeable so that a single core wearable article can be adapted for use in different activities (e.g. a single custom-fitted wearable article for the cervical spine may be removably inter-engageable with both American football padding/armor and ice hockey padding/armor. In some embodiments, additional layers may incorporate gel-filled or fluid-filled chambers to provide impact protection and/or cushioning. An innermost layer may also be provided to improve the close topographical engagement of the wearable article with the body region. An exemplar combination of layers utilized in the wearable article such as within a support element includes an outer layer of a rigid foam, rubber, or plastic material, an internal or middle layer of a rate-sensitive material (e.g. a non-Newtonian material suspended in a foam matrix) whose viscosity increases in response to increasing force, and an inner layer of a soft foam or padding to help cushion the surface of the wearer's anatomy in contact with the support element and/or wearable article.

Optionally, electronic sensors (e.g. optical sensors, force sensors, or others) may be incorporated into wearable articles according to the present disclosure. For example, suitable accelerometers may be used as force sensors. Where electronic sensors are used, these may be coupled (e.g. by wire) to an onboard computer or onboard data storage, or to a transmitter (e.g. a radio, Wi-Fi, or Bluetooth transmitter) which may communicate wirelessly with a computing device (e.g. a smartphone or tablet).

In various aspects, the wearable articles described herein enable a method for limiting injurious motion. This method comprises diverting, through a wearable article secured on a body region of a subject, at least a portion of internal contortion forces within the body region to rate-sensitive material disposed within at least one deformable region within a frame of the wearable article, and damping or absorbing the diverted internal contortion forces by deformation of the rate-sensitive material within the at least one deformable region.

Certain exemplary wearable articles in the form of spinal support devices (which can be integrated into the wearable articles described herein as support elements) will now be described by way of example, it being understood that the teachings of the present disclosure are not limited to spinal support devices, but may be applied to articles for a wide range of anatomical structures.

Reference is now made to FIGS. 1 to 13, which show a first exemplary spinal support device, indicated generally by reference 100. The spinal support device shown in FIGS. 1 to 13 is one exemplary implementation of a wearable article according to the present disclosure, and serves as an article for an anatomical structure, in this case the neck/back/spine.

The spinal support device 100 comprises a cervical spine support portion 102, an upper spinal support portion 104, and a lower spinal support portion 106. The cervical spine support portion 102 is coupled to the superior end 108 of the upper spinal support portion 104 and the lower spinal support portion 106 extends from an inferior end 110 of the upper spinal support portion 104. The upper spinal support portion 104 and the lower spinal support portion 106 may be monolithically formed as a single element, or may be formed as two parts (each of which may consist of sub-parts) joined to one another.

Figure 6:
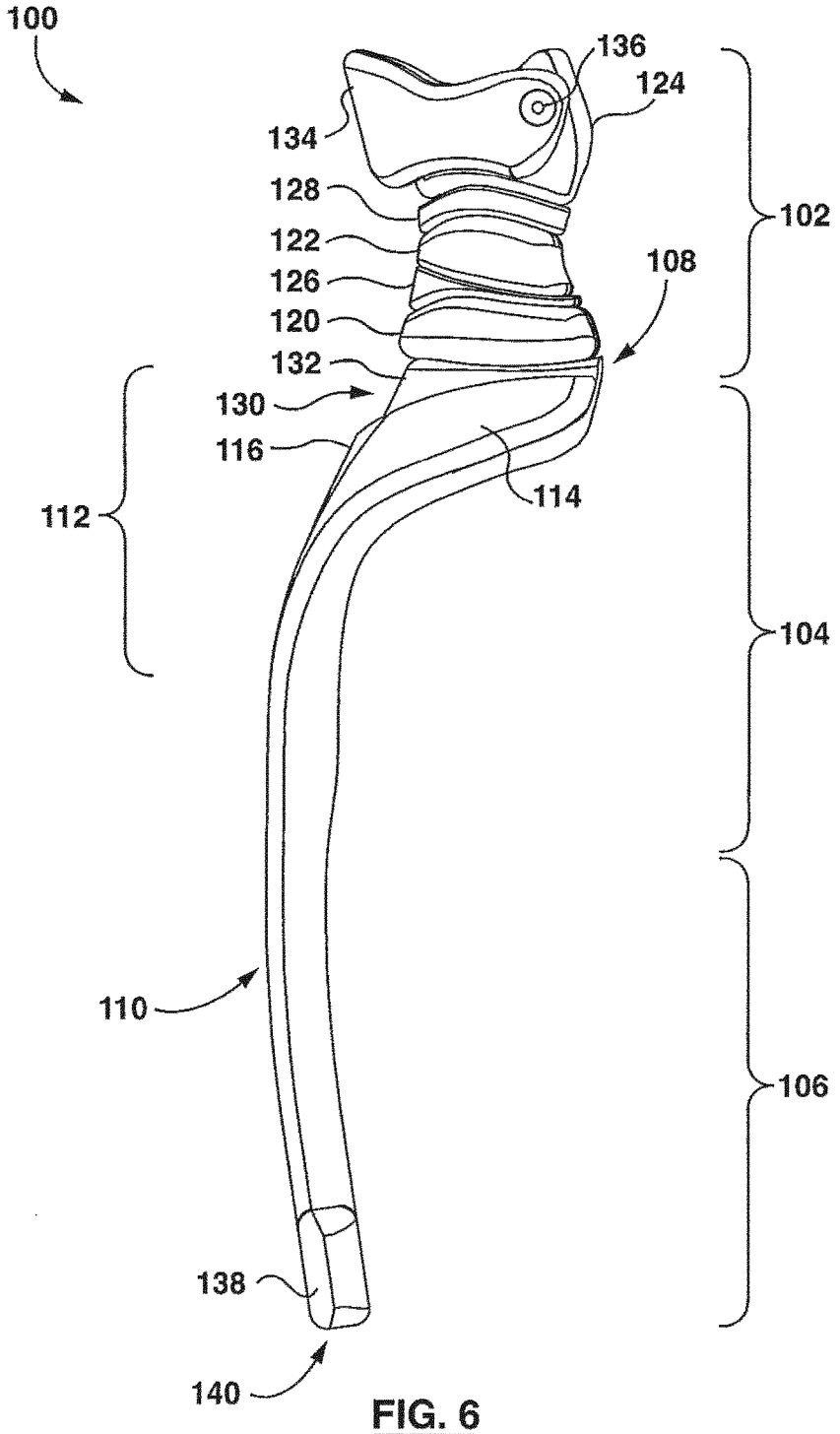
FIG. 6 is a side elevation view of the spinal support device of FIG. 1, in accordance with some embodiments.
Figure 7:
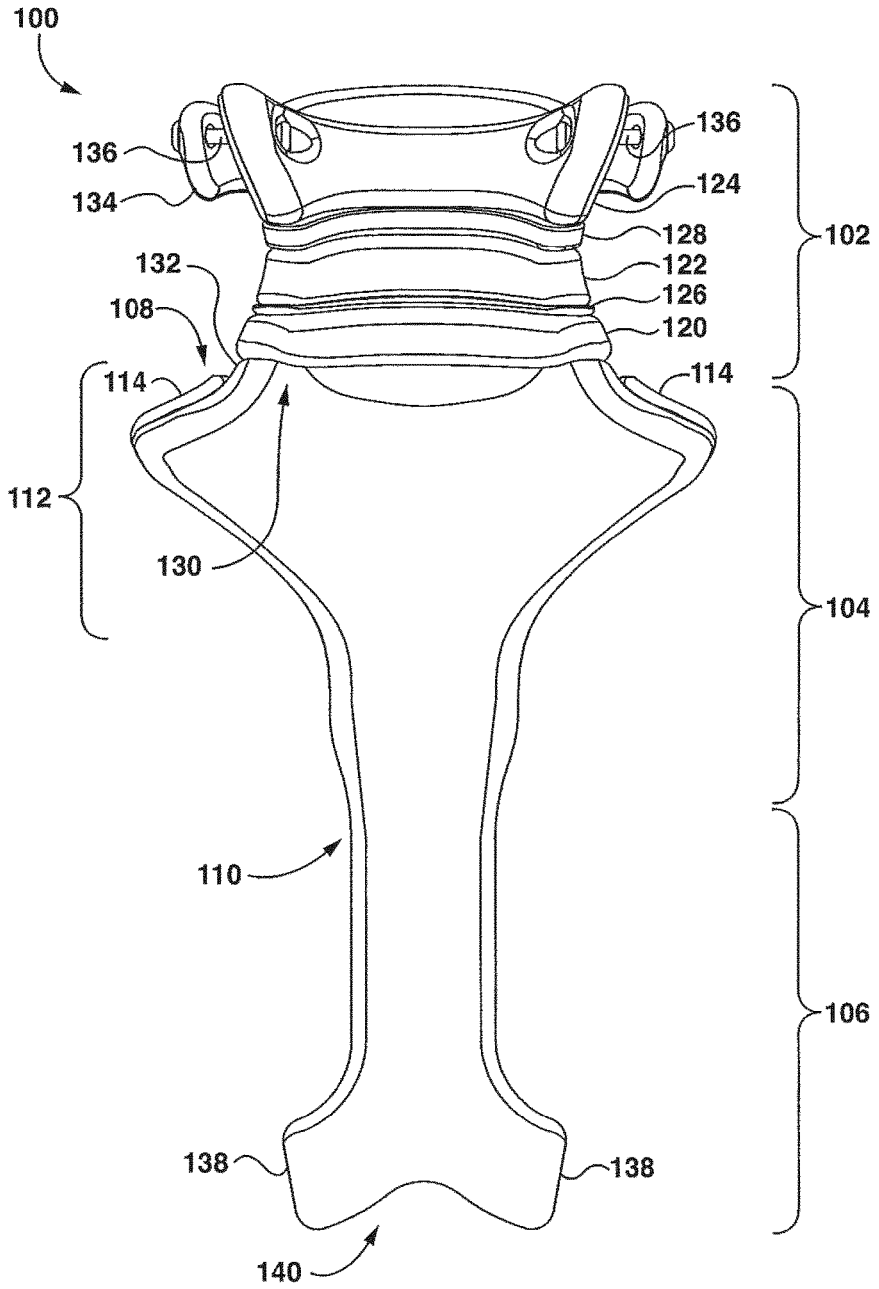
FIG. 7 is a rear (ventral) elevation view of the spinal support device of FIG. 1, in accordance with some embodiments.
Figure 8:
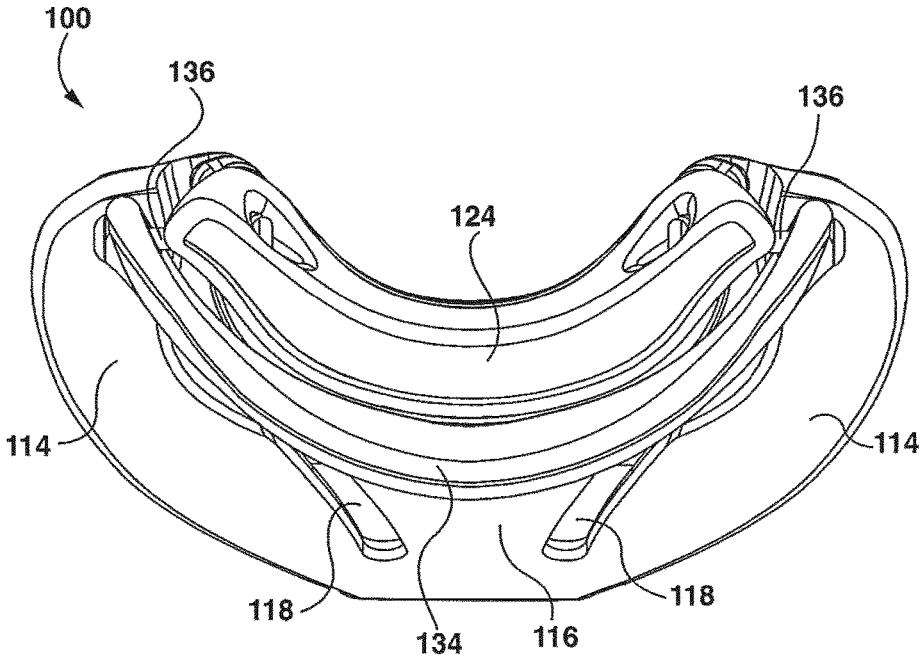
FIG. 8 is a top plan view of the spinal support device of FIG. 1, in accordance with some embodiments.
Figure 9:
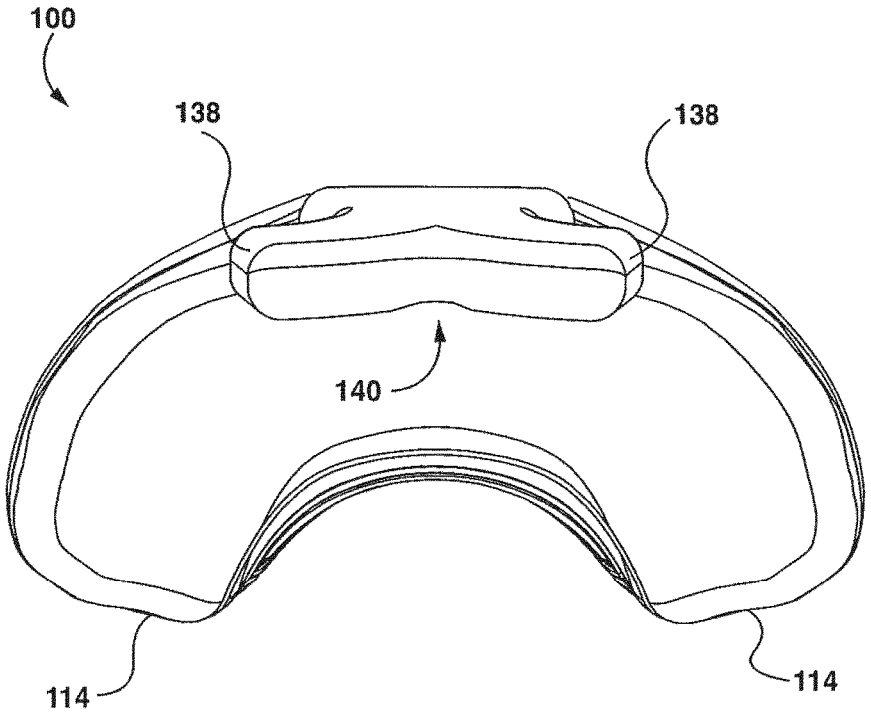
FIG. 9 is a bottom plan view of the spinal support device of FIG. 1, in accordance with some embodiments.
Figure 10:
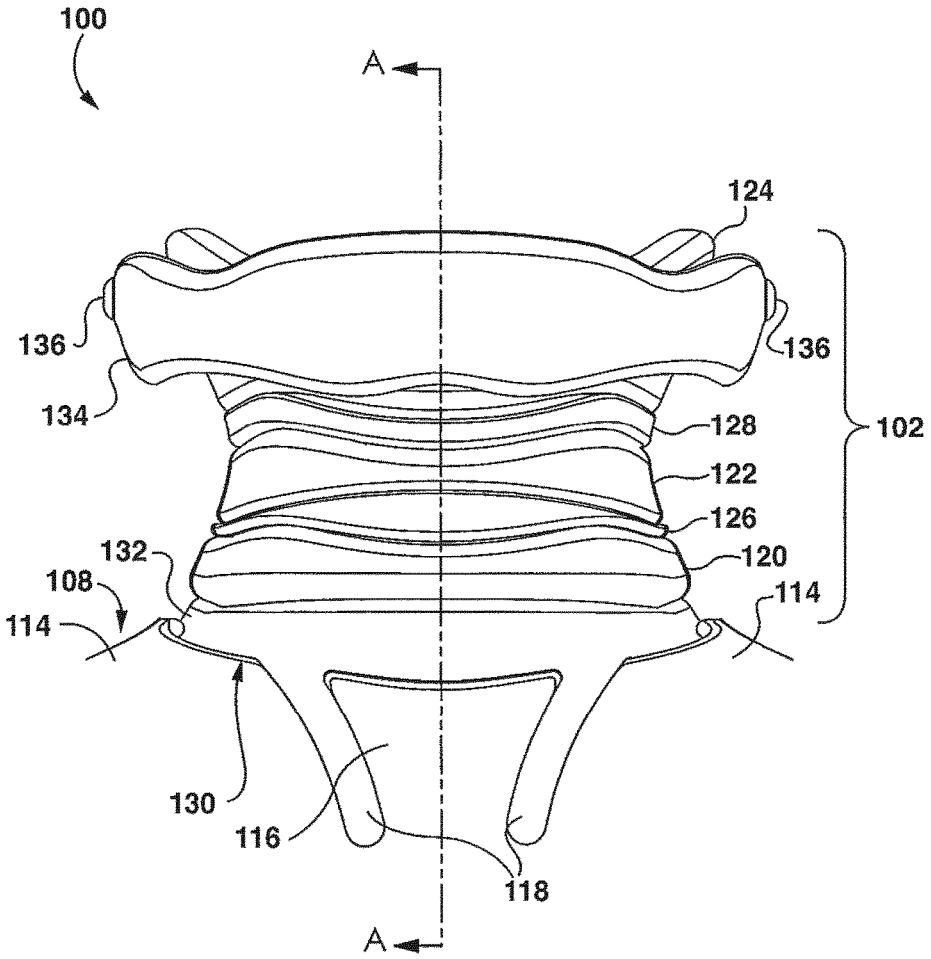
FIG. 10 is a detail front (dorsal) elevation view of a portion of the spinal support device of FIG. 1, in accordance with some embodiments.
Figure 11:
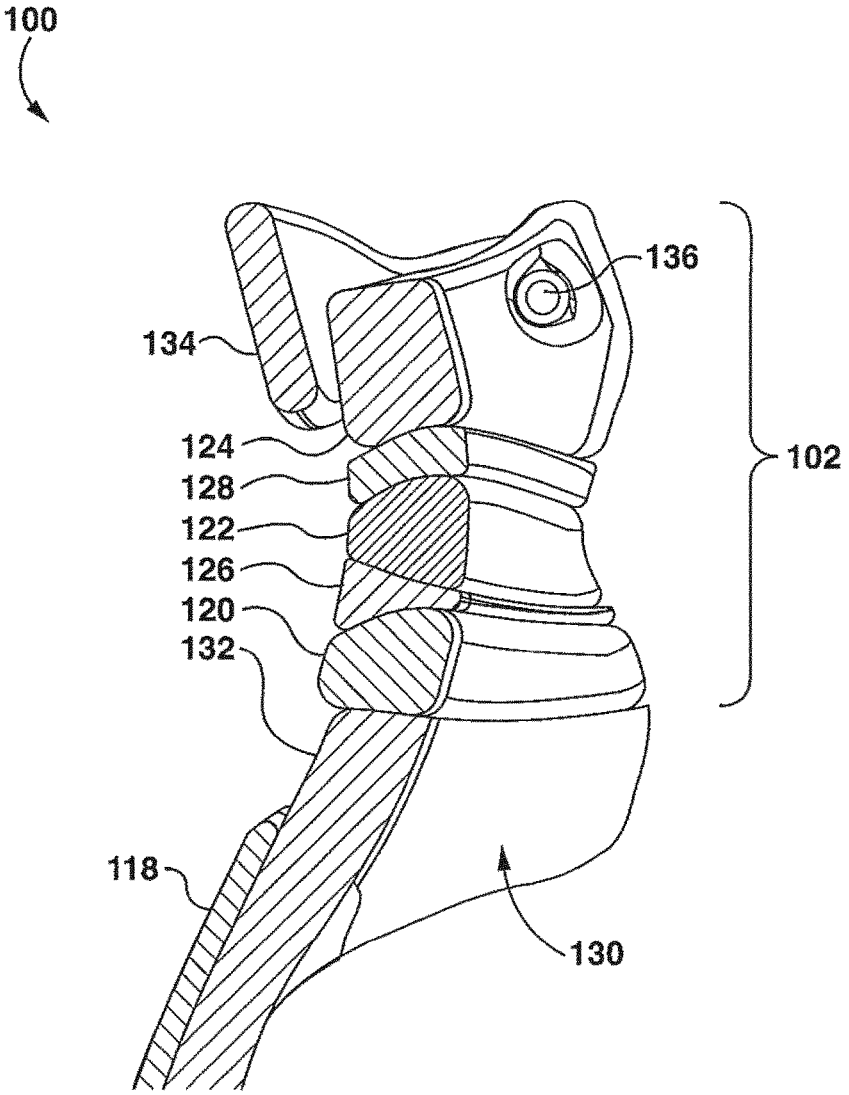
FIG. 11 is a cross-sectional view of a portion of the spinal support device of FIG. 1, taken along the line A-A in FIG. 10, in accordance with some embodiments.
Figure 12:
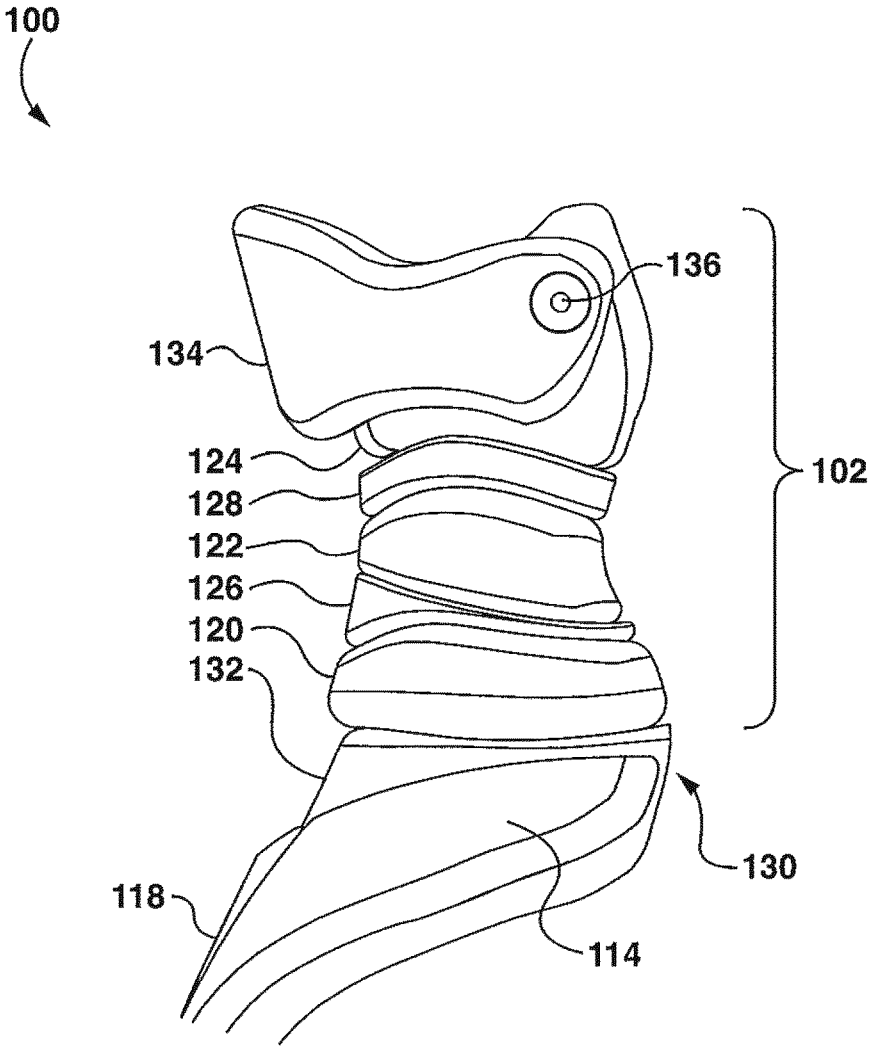
FIG. 12 is a detail side elevation view of a portion of the spinal support device of FIG. 1, in accordance with some embodiments.
Figure 13:
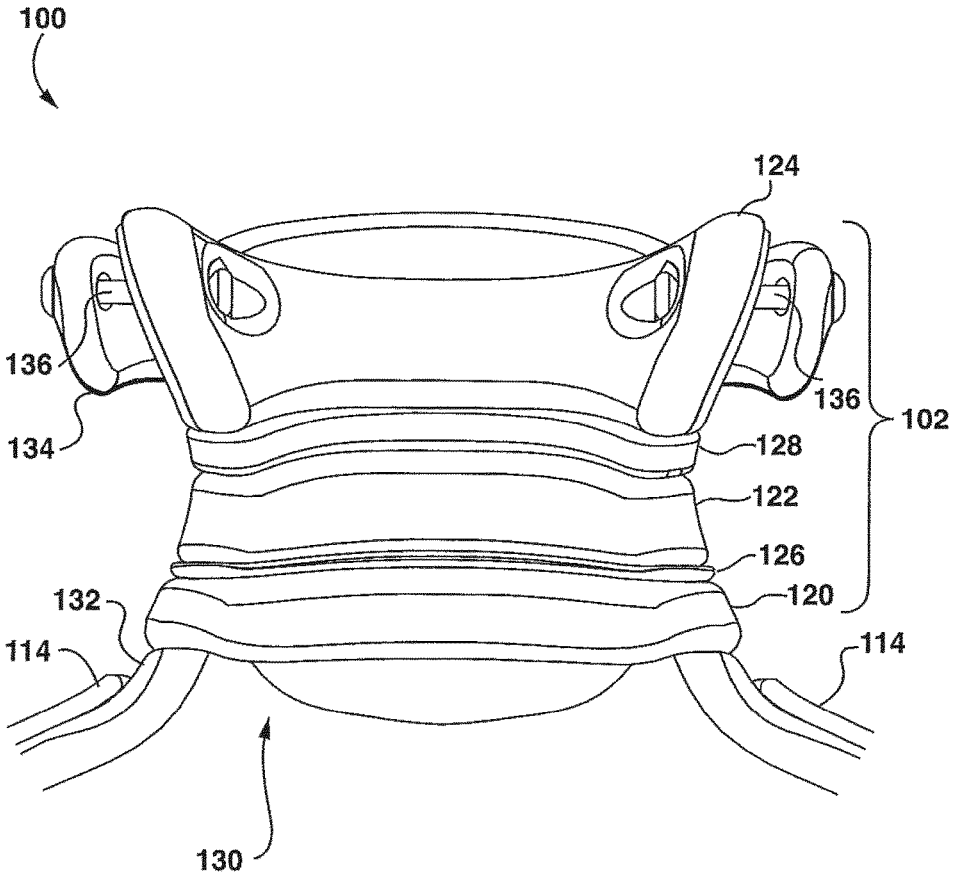
FIG. 13 is a detail rear (ventral) elevation view of a portion of the spinal support device of FIG. 1, in accordance with some embodiments.
Figure 14:
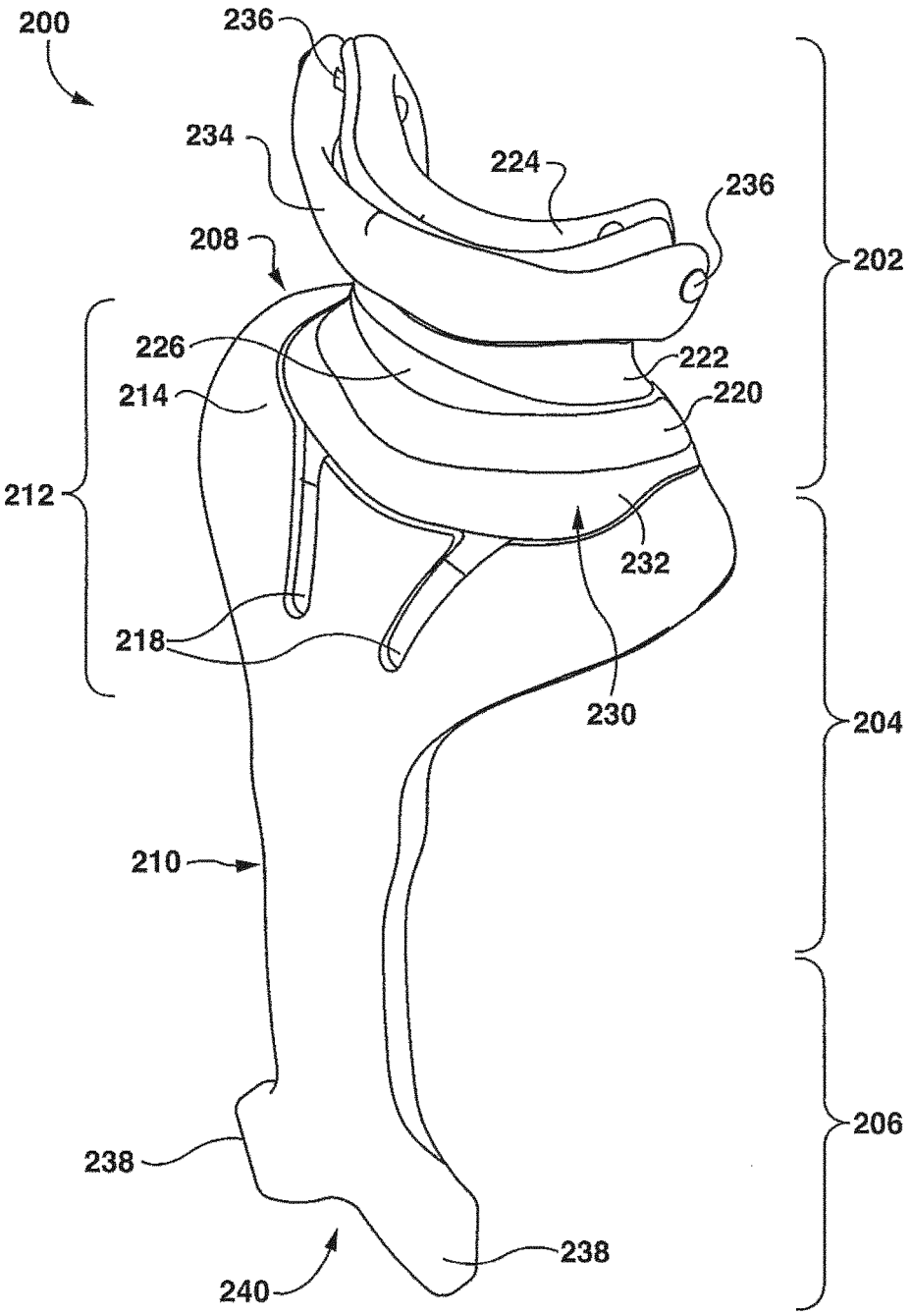
FIG. 14 is a superior dorsal isometric view of a second exemplary spinal support device, in accordance with some embodiments.
Figure 15:
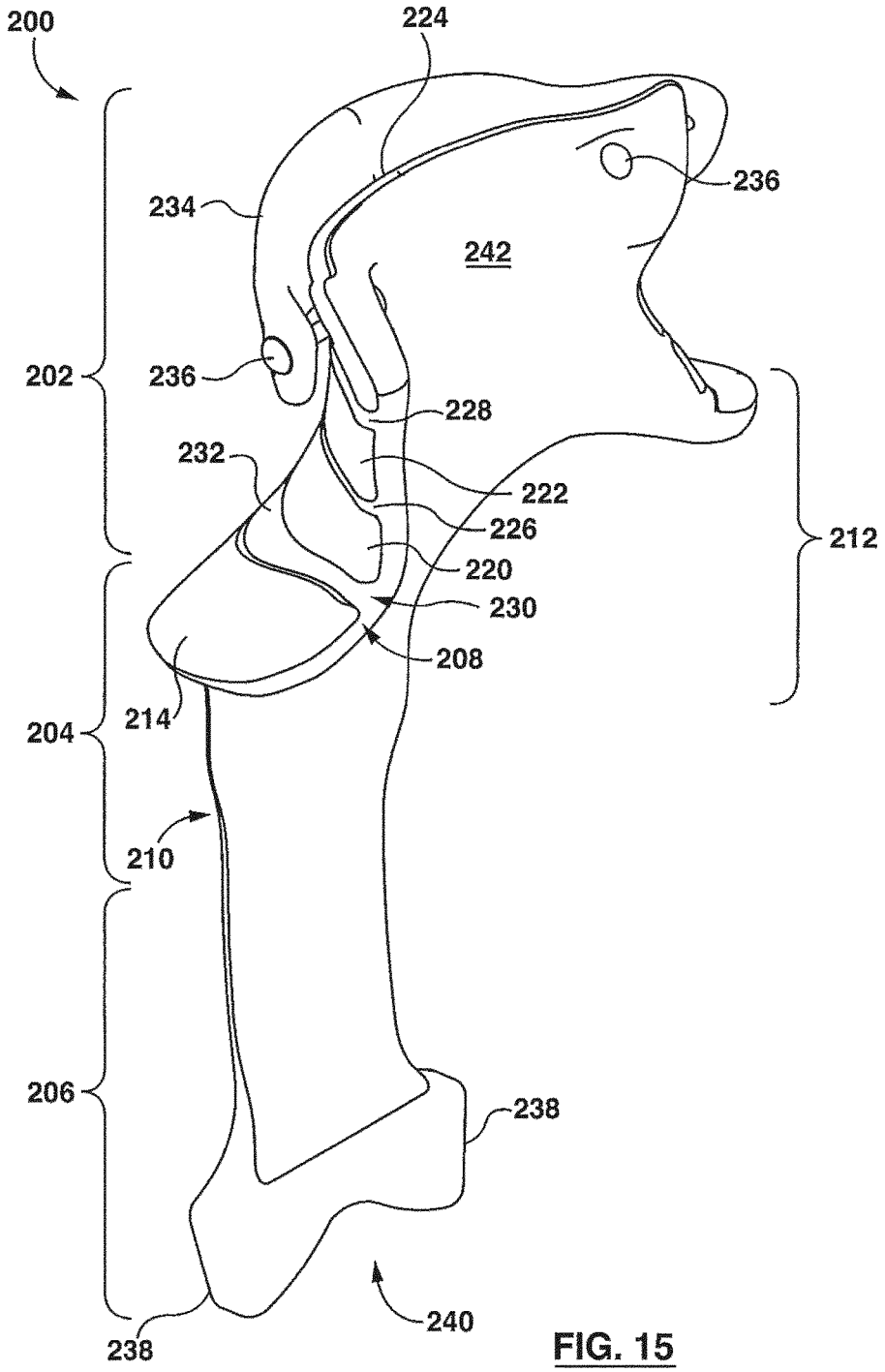
FIG. 15 is a superior ventral isometric view of the spinal support device of FIG. 14, in accordance with some embodiments.
Figure 16:
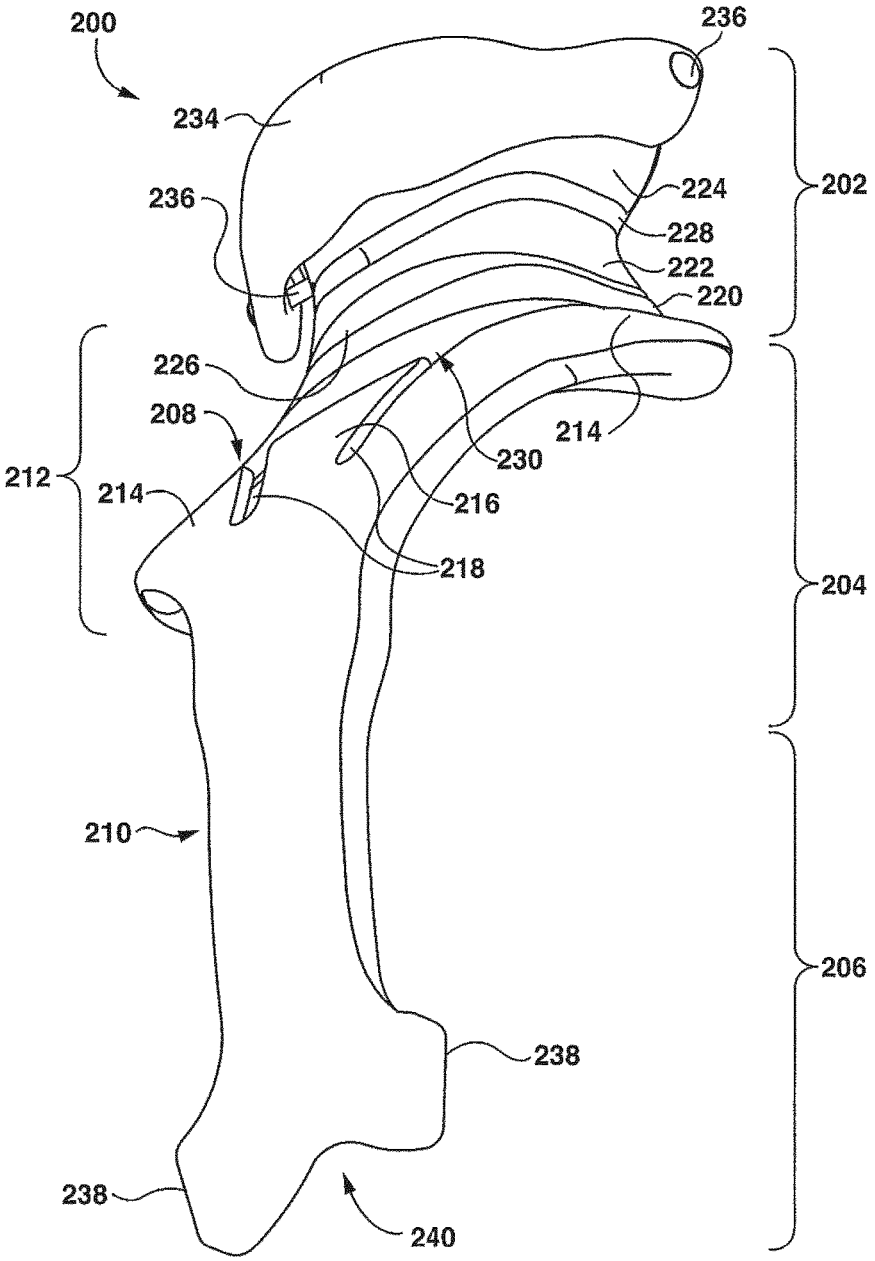
FIG. 16 is an inferior dorsal isometric view of the spinal support device of FIG. 14, in accordance with some embodiments.
Figure 17:
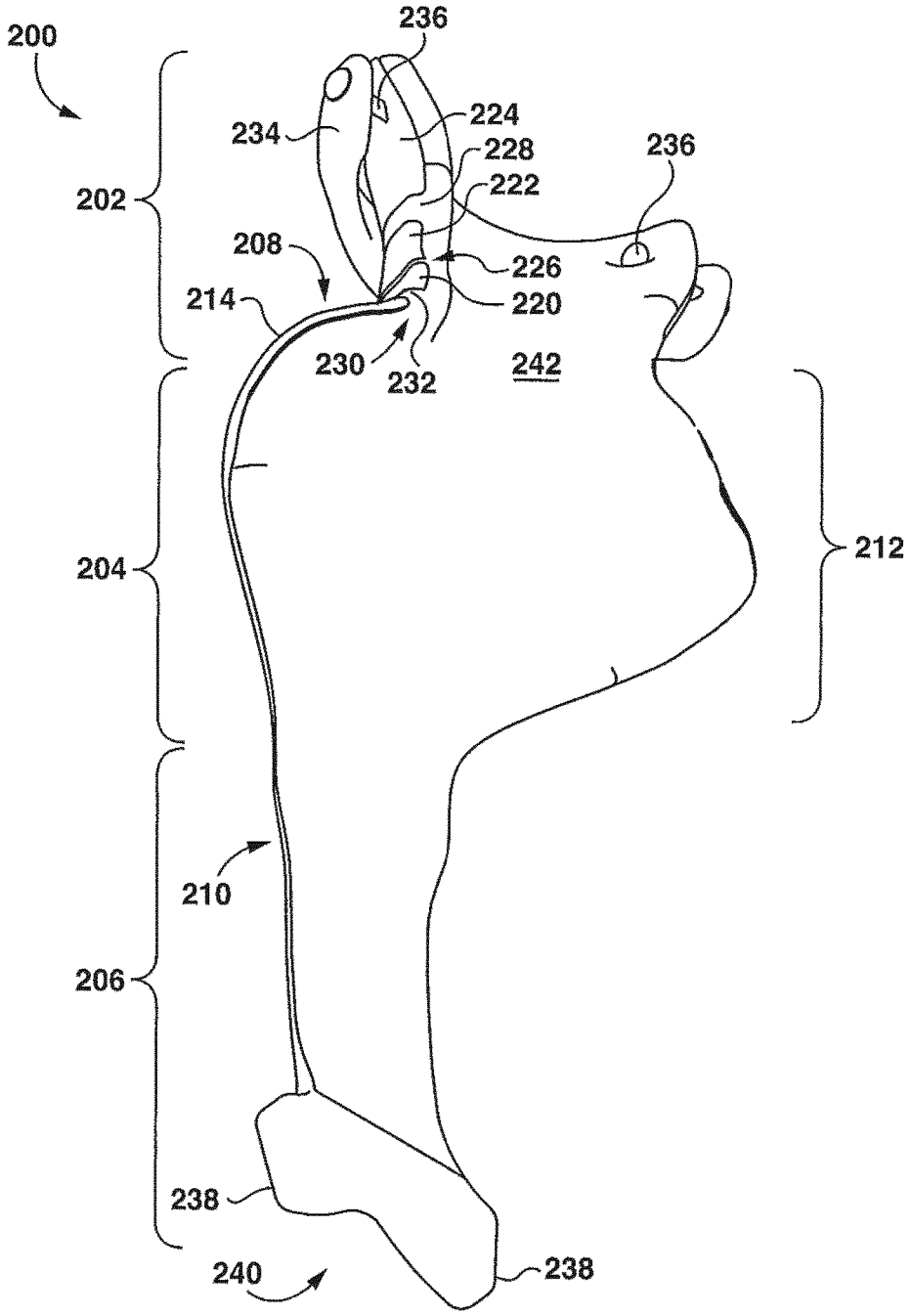
FIG. 17 is an inferior ventral isometric view of the spinal support device of FIG. 14, in accordance with some embodiments.
Figure 18:
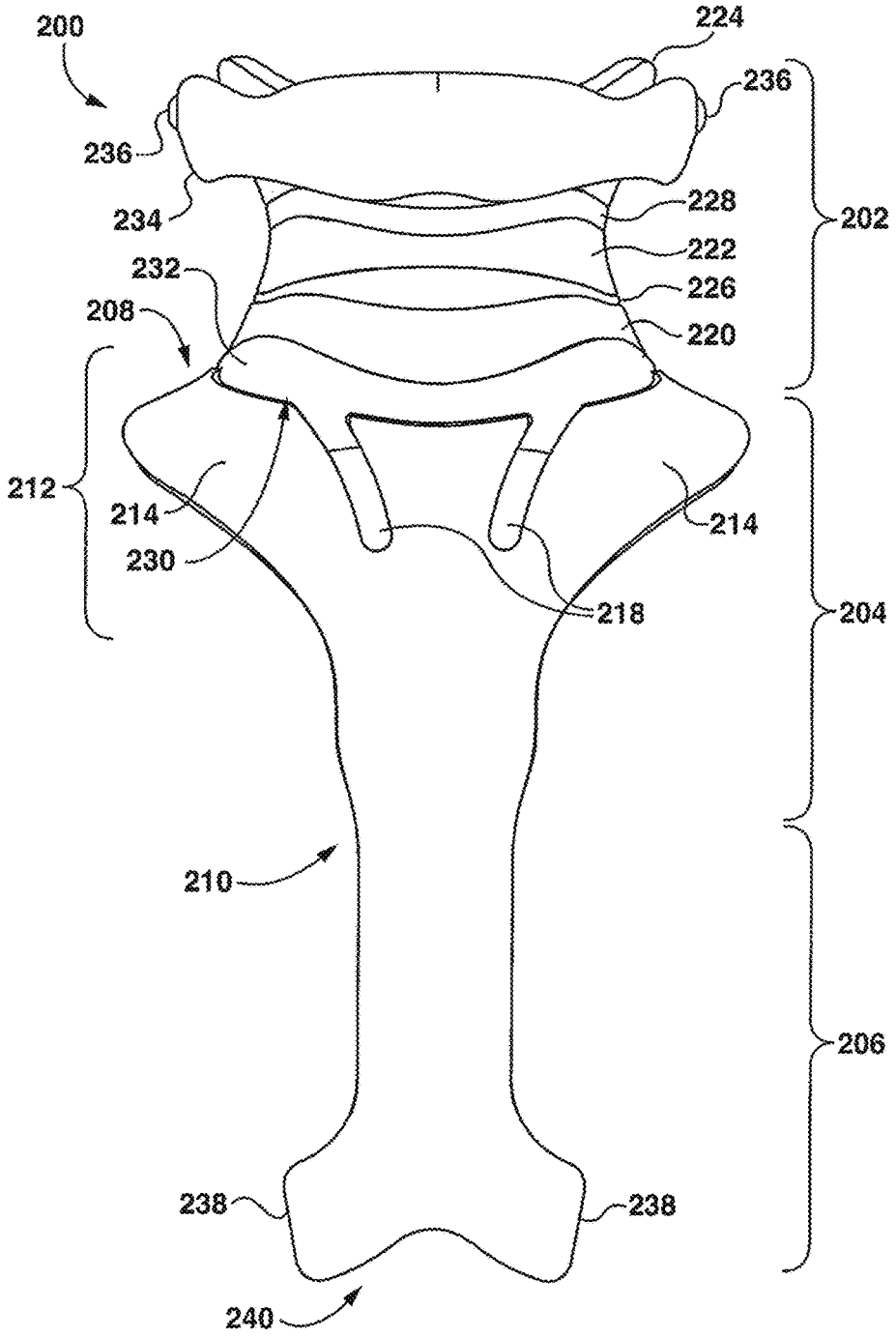
FIG. 18 is a front (dorsal) elevation view of the spinal support device of FIG. 14, in accordance with some embodiments.
Figure 19:
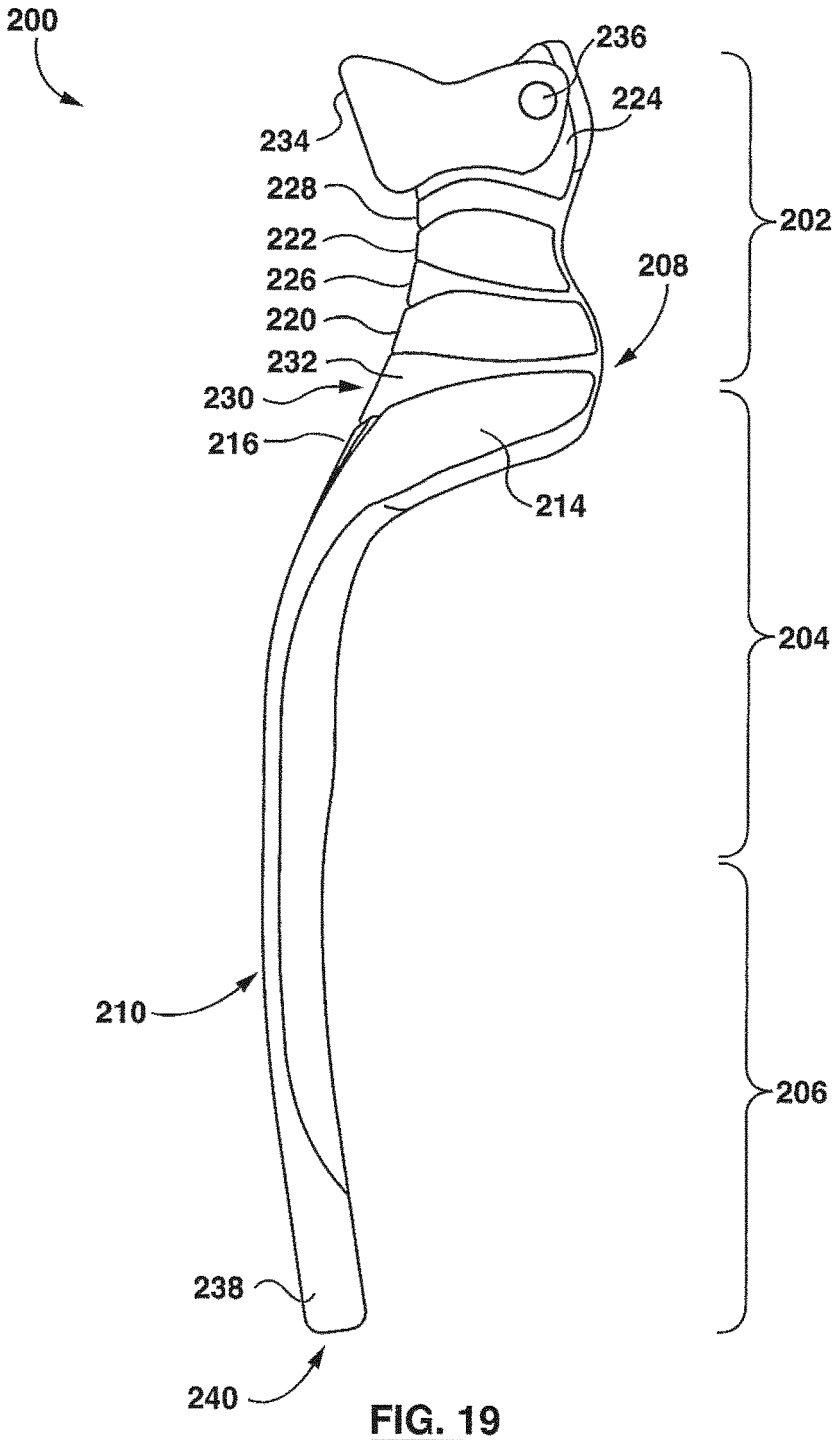
FIG. 19 is a side elevation view of the spinal support device of FIG. 14, in accordance with some embodiments.
Figure 20:
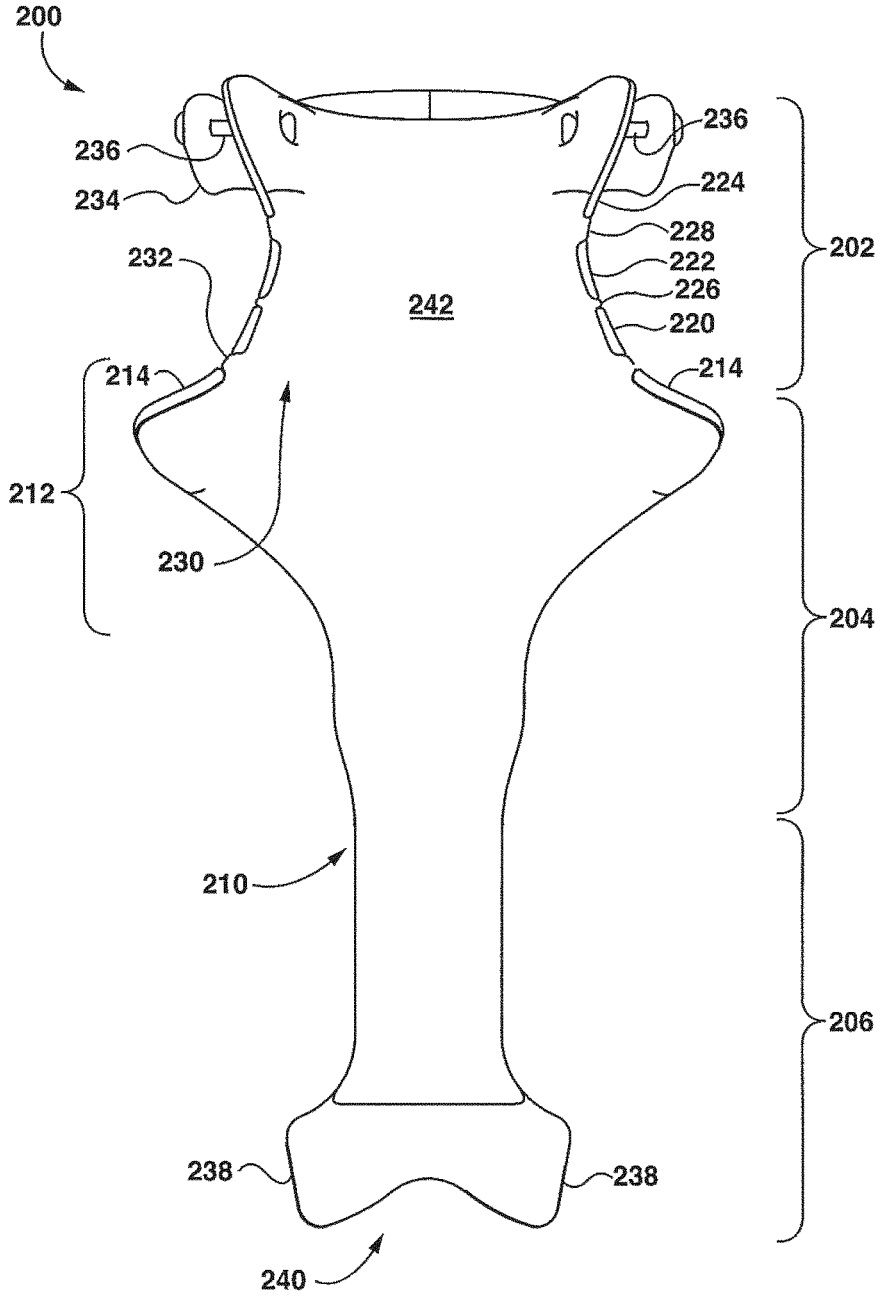
FIG. 20 is a rear (ventral) elevation view of the spinal support device of FIG. 14, in accordance with some embodiments.
Figure 21:
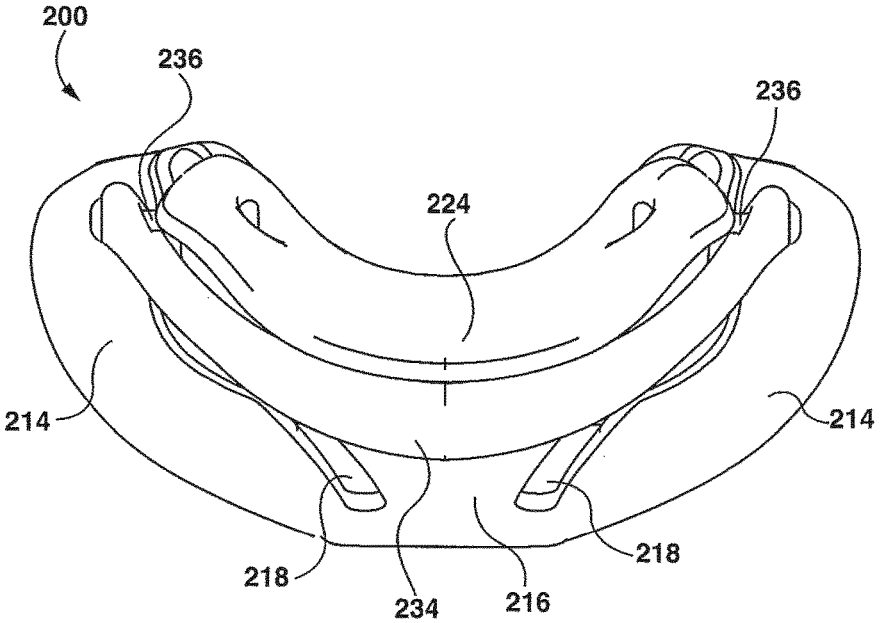
FIG. 21 is a top plan view of the spinal support device of FIG. 14, in accordance with some embodiments.
Figure 22:
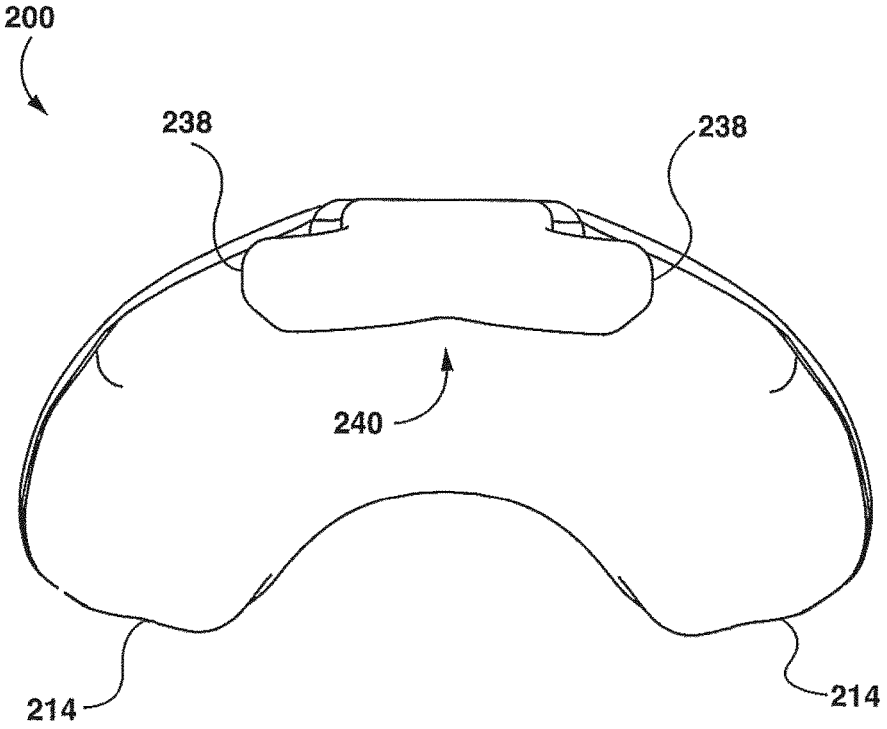
FIG. 22 is a bottom plan view of the spinal support device of FIG. 14, in accordance with some embodiments.
Figure 23:
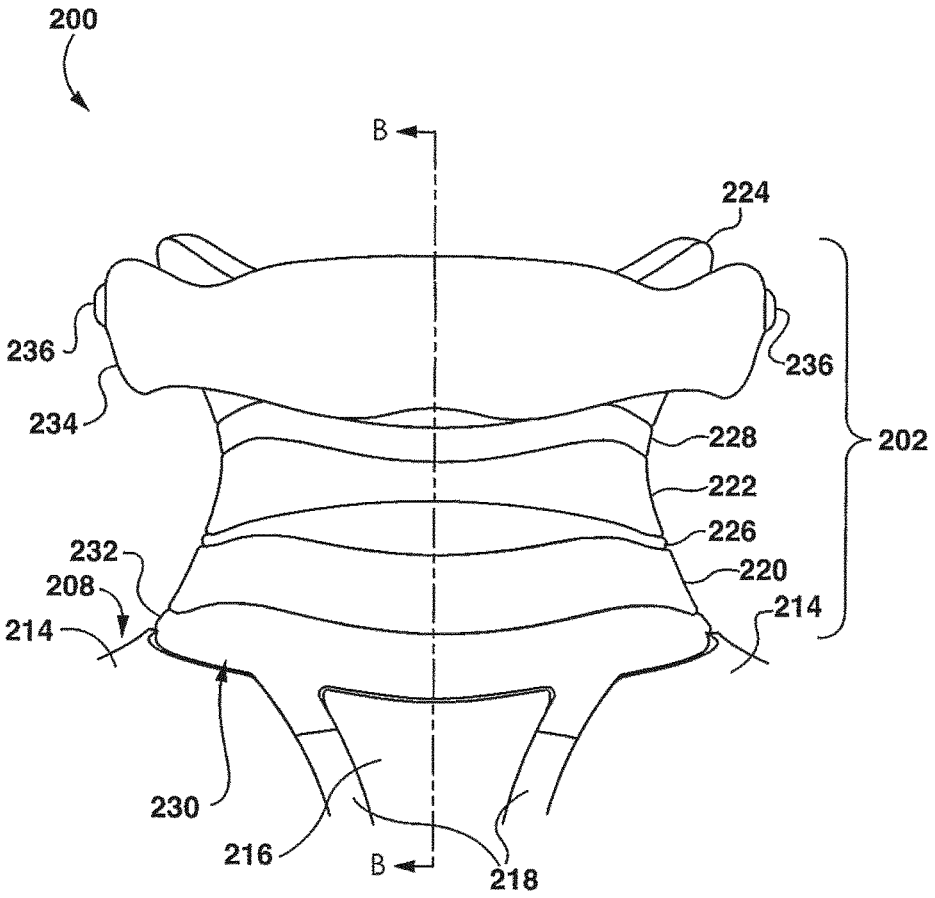
FIG. 23 is a detail front (dorsal) elevation view of a portion of the spinal support device of FIG. 14, in accordance with some embodiments.
Figure 24:
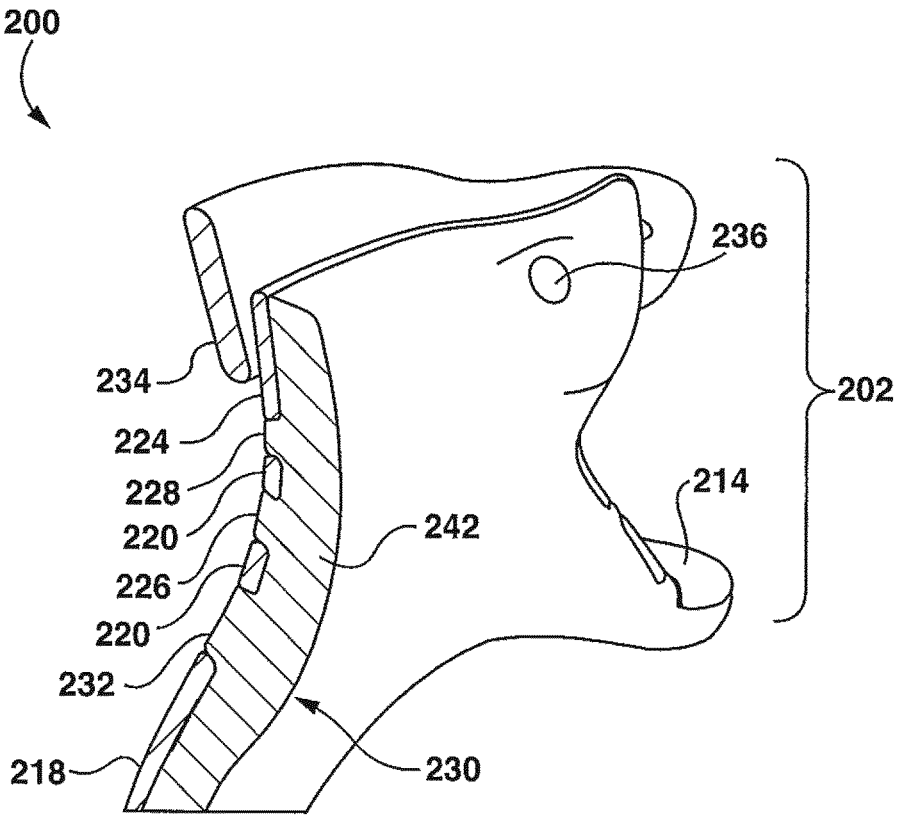
FIG. 24 is a cross-sectional view of a portion of the spinal support device of FIG. 14, taken along the line B-B in FIG. 23, in accordance with some embodiments.
Figure 25:
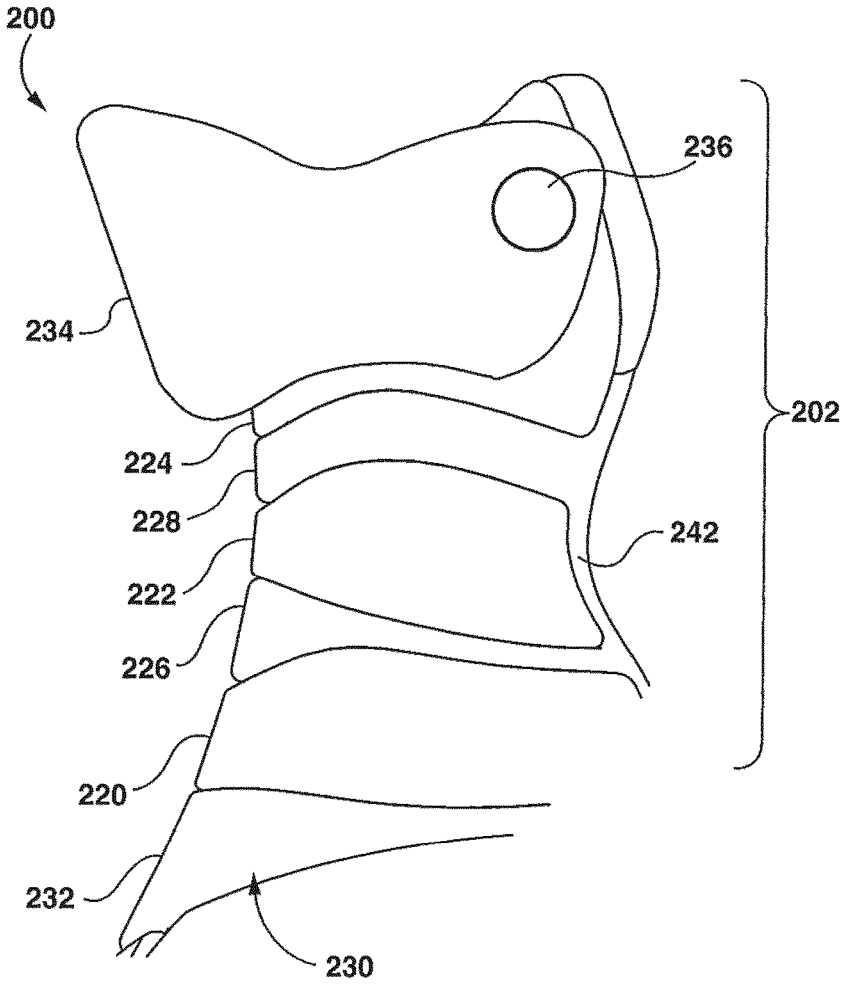
FIG. 25 is a detail side elevation view of a portion of the spinal support device of FIG. 14, in accordance with some embodiments.
Figure 26:
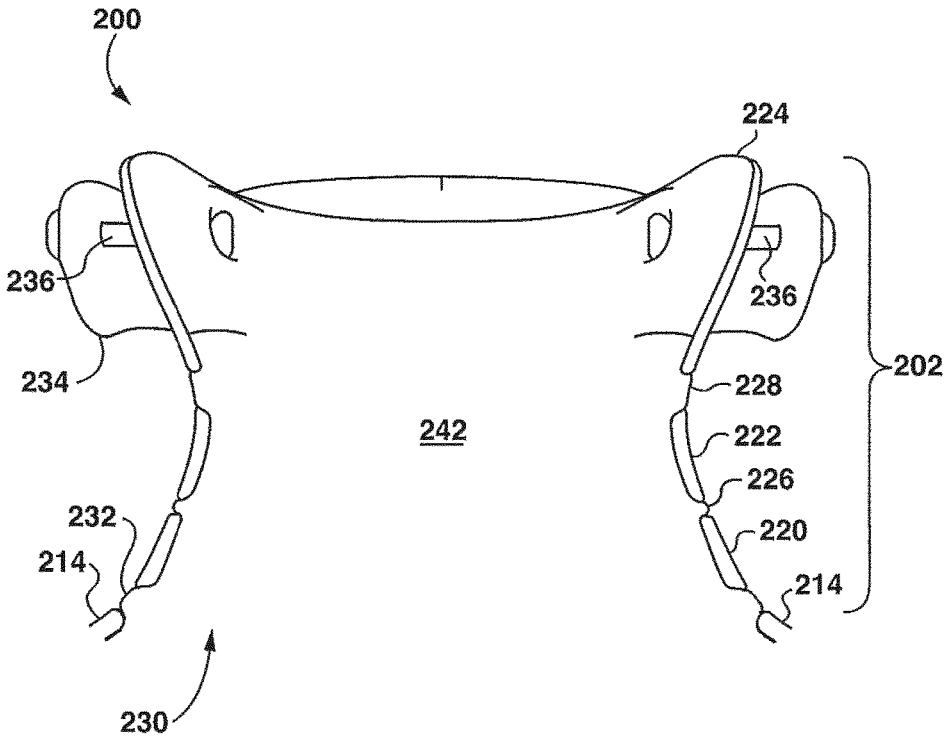
FIG. 26 is a detail rear (ventral) elevation view of a portion of the spinal support device of FIG. 14, in accordance with some embodiments.

When worn by a human subject (not shown in FIGS. 1 to 13), the upper spinal support portion 104 and lower spinal support portion 106 together extend from the C7 vertebra to at least the L1 vertebra on a human spine and, as can be seen, the spinal support device 100 is contoured to fit the curvature of a human back. Thus, as best seen in FIG. 6, the upper spinal support portion 104 and the lower spinal support portion 106 are adapted to conform to human spinal curvature and, in use, would be secured in position over the wearer's spine as described further below. The interior contours of the spinal support device 100 form an engagement surface that conforms to the external surface contours of the back and neck.

The superior end 108 of the upper spinal support portion 104 comprises a biomechanically rigid trapezius grapnel 112 adapted to extend over and engage human trapezius muscles from a dorsal position toward a ventral position on a human subject. The term "biomechanically rigid", as used herein, means sufficiently rigid to transmit substantially all applied force rather than absorbing the force by deformation. In this sense, the term "biomechanically rigid" means rigid in the same sense that the bones of the skeleton are rigid and thus the term "biomechanically rigid" does not preclude some flexibility. The entirety of the upper spinal support portion 104 may be biomechanically rigid, or only the trapezius grapnel 112 may be biomechanically rigid. Optionally, the upper spinal support portion 104 may be constructed so that the trapezius grapnel 112 is biomechanically rigid and the rigidity of the upper spinal support portion 104 decreases (e.g. the flexibility increases) toward the inferior end 110 thereof. In preferred embodiments, the lower spinal support portion 106 is substantially more flexible than the upper spinal support portion 104.

In the illustrated embodiment, the superior end 108 of the upper spinal support portion 104 is generally trident-shaped and the trapezius grapnel 112 comprises outwardly extending opposed trapezius support arms 114 and a spinal support arm 116 disposed between the trapezius support arms 114. Slots 118 are interposed between the spinal support arm 116 and the trapezius support arms 114. The trapezius support arms 114 are adapted to engage human trapezius muscles and thereby stabilize the spinal support device 100 while enabling force to be transferred from the cervical spine support portion 102 to the trapezius muscles or, more broadly, the upper torso. The mechanism used to secure the upper spinal support portion 104 and the lower spinal support portion 106 over the wearer's spine will also maintain the trapezius grapnel 112 in engagement with the wearer's trapezius muscles. The trident shape is merely one exemplary shape for the trapezius grapnel 112 and other suitable shapes may also be used.

As best seen in FIGS. 10 to 13, the cervical spine support portion 102 comprises a generally C-shaped biomechanically rigid C6 vertebra support 120, a generally C-shaped biomechanically rigid C4 vertebra support 122, and a generally C-shaped biomechanically rigid atlas support 124. When the spinal support device 100 is worn by a human subject, the C6 vertebra support is aligned with and positioned to cradle a human C6 vertebra from a dorsal side thereof, the C4 vertebra support is aligned with and positioned to cradle a human C4 vertebra from a dorsal side thereof, and the atlas support 124 is aligned with and positioned to cradle human C1 and C2 vertebrae from a dorsal side thereof.

The upper spinal support portion 104 and lower spinal support portion 106 together form a force-directing frame of a wearable article, and the trapezius support arms 114, spinal support arm 116, C6 vertebra support 120, C4 vertebra support 122, and atlas support 124 are frame elements thereof. As can be seen, the force-directing frame formed by the upper spinal support portion 104 and lower spinal support portion 106 is shaped and dimensioned to be anatomically complementary to a body region, in this case the back and neck, of a subject, in this case a human The C6 vertebra support 120, C4 vertebra support 122, and atlas support 124 are spaced from one another and joined together by respective symphyseal resistive joints formed by symphyseal resistive dampers extending there-between. The term "symphyseal resistive damper" means an element or set of elements which, when interposed between two parts, can function as a symphyseal gliding joint between those two parts and permits limited relative angular (flexion/extension) and rotational movement of one of the parts relative to another while resisting the force of such movement so as to apply a braking/decelerating effect to such movement, and "symphyseal resistive joint" refers to a joint comprising a "symphyseal resistive damper". A C6-C4 symphyseal resistive damper extends between the C6 vertebra support 120 and the C4 vertebra support 122 to form a C6-C4 symphyseal resistive joint 126 there-between, and a C4-atlas symphyseal resistive damper extends between the C4 vertebra support 122 and the atlas support 124 to form a C4-atlas symphyseal resistive joint 128 there-between. The cervical spine portion 102 is joined to the superior end 108 of the upper spinal support portion 104 by an upper spine-cervical spine symphyseal resistive damper extending between the superior end 108 of the upper spinal support portion and the C6 vertebra support 120 which forms an upper spine-cervical spine symphyseal resistive joint 130. Thus, a plurality of dampers is engaged with the force-directing frame formed by the upper spinal support portion 104 and lower spinal support portion 106 to absorb forces therefrom. As can be seen in the FIG., the force-directing frame (upper spinal support portion 104 and lower spinal support portion 106) and the dampers (symphyseal resistive joints 126, 128, 130) are shaped and positioned relative to one another to be anatomically complementary to an anatomical structure of a subject, in this case the back and upper spine of a human being. This anatomical structure comprises hard tissue (vertebrae) and soft tissue (e.g. muscle, intervertebral discs).

In the exemplary embodiment shown in FIGS. 1 to 13, the C6-C4 symphyseal resistive joint 126, the C4-atlas symphyseal resistive joint 128 and the upper spine-cervical spine symphyseal resistive joint 130 are each discrete joints formed from separate pieces of energy-absorbing material. Thus, the force-directing frame comprises a plurality of discrete force-directing elements (trapezius grapnel 112, C6 vertebra support 120, C4 vertebra support 122 and atlas support 124) spaced from one another by the dampers (symphyseal resistive joints 130, 126, 128) extending between adjacent force-directing elements. In the illustrated embodiment, the C6-C4 symphyseal resistive joint 126 is a generally C-shaped element that extends between the superior end of the C6 vertebra support 120 and the inferior end of the C4 vertebra support 122, and the C4-atlas symphyseal resistive joint 128 is a generally C-shaped element that extends between the superior end of the C4 vertebra support 122 and the inferior end of the atlas support 124. The upper spine-cervical spine symphyseal resistive joint 130 conforms to the shape of the trapezius grapnel 112 and extends both inferiorly and superiorly thereof. More particularly, the upper spine-cervical spine symphyseal resistive joint 130 is on the ventral side of the upper spinal support portion 104 and extends inferiorly beyond the slots 118 and superiorly beyond the trapezius support arms 114 and a spinal support arm 116. Beyond the superior end 108 of the upper spinal support portion 104, the upper spine-cervical spine symphyseal resistive joint 130 converges to form a penannular collar 132 extending to the inferior end of the C6 vertebra support 120. In the illustrated embodiment, the material that forms the upper spine-cervical spine symphyseal resistive joint 130 also extends inferiorly along the ventral surface of the spinal support device 100 to the inferior end 140 of the lower spinal support portion 106. In other embodiments the material that forms the upper spine-cervical spine symphyseal resistive joint may not extend as far inferiorly; for example the material may extend only to the inferior end of the upper spinal support portion.

The energy-absorbing material used to form the C6-C4 symphyseal resistive joint 126, the C4-atlas symphyseal resistive joint 128 and the upper spine-cervical spine symphyseal resistive joint 130 may be, for example, an elastomeric material or a suitable force-reactive polymer such as those described herein. Thus, in one embodiment of the exemplary spinal support device 100 shown in FIGS. 1 to 13, a quantity of rate-sensitive material is coupled to the force-directing frame (upper spinal support portion 104 and lower spinal support portion 106) to form the symphyseal resistive joints 126, 128, 130. In this particular embodiment, these symphyseal resistive joints 126, 128, 130 are the deformable regions in which the rate-sensitive material is disposed.

The relative positions of the trapezius grapnel 112, C6 vertebra support 120, C4 vertebra support 122 and atlas support 124 and the symphyseal resistive joints 126, 128, 130 allow the cervical spine support portion 102 and the superior end 108 of the upper spinal support portion 104 to mimic the natural articulation of a human spine. At the same time, the structure provides resistance to applied force causing flexion/extension/rotation of the spine (e.g. from a ball or another player impacting the head and/or body), thereby reducing angular/rotational acceleration (whiplash) of the head and neck from impact to the head or body). Specifically, the energy-absorbing material forming the symphyseal resistive joints 126, 128, 130 provides progressively increasing resistance to deformation. The deformation may be compression, tension, or a combination (depending on the nature of the movement, some parts of a particular symphyseal resistive joint may be in compression while other parts are in tension). Where the symphyseal resistive joints are formed from an elastomeric material, the resistance to deformation will increase as displacement increases, and where the symphyseal resistive joints are formed from a force-reactive polymer, the resistance to deformation will increase as the applied force increases. Since relative movement of the trapezius grapnel 112, C6 vertebra support 120, C4 vertebra support 122 and atlas support 124 results in deformation of the symphyseal resistive joints 126, 128, 130, the symphyseal resistive joints 126, 128, 130 provide a progressively increasing resistance toward the limits of the range of motion, which in turn provides a mechanical resistance to (e.g. braking/deceleration of) of whiplash-related and concussion-related movement. Thus, the frame elements (trapezius support arms 114, spinal support arm 116, C6 vertebra support 120, C4 vertebra support 122 and atlas support 124) are configured to divert at least a portion of internal contortion forces within the spine through the frame elements to the deformable regions (symphyseal resistive joints 126, 128, 130) whereby the energy-absorbing material damps the diverted internal contortion forces by deformation of the energy-absorbing material within the deformable regions.

In order to couple movement of a subject's head to the spinal support device 100, the spinal support device 100 is provided with at least one helmet integration element that is pivotally mounted to the atlas support 124. In the exemplary embodiment shown in FIGS. 1 to 13, the spinal support device 100 is provided with a single generally C-shaped helmet integration element 134. The atlas support 124 is pivotally nested within the helmet integration element 134 so that the helmet integration element 134 can pivot inferiorly and superiorly relative to the atlas support 124 within a limited range of pivotal motion. In the illustrated embodiment, the helmet integration element 134 is coupled to the atlas support 124 by opposed pivot pins 136; suitable bushings and/or bearings (not shown) may be associated with the pivot pins 136.

In use, a helmet (not shown) is coupled to the helmet integration element 134 so that movement of the helmet during flexion and extension of the head will cause a corresponding movement of the helmet integration element 134; preferably, the helmet can be releasably coupled to the helmet integration element 134. For example, one or more tethers (not shown) may extend from the helmet integration element 134 for securing the helmet integration element 134 to a helmet (e.g. via snap fitting or other fastener) and the back of the helmet can be shaped to engage the helmet integration element 134. In such an embodiment, movement of the helmet during flexion of the head will move the helmet integration element 134 via tension applied through the tethers, and movement of the helmet during extension of the head will move the helmet integration element 134 by way of the back of the helmet pushing on the helmet integration element 134. In other embodiments, the helmet integration element 134 may be rigidly coupled to the helmet so that the helmet and the helmet integration element 134 move in unison.

When flexion and extension of the head are within the limited range of pivotal motion of the helmet integration element 134 relative to the atlas support 124, the helmet integration element 134 can pivot freely relative to the atlas support 124. Thus, the limited range of pivotal motion will be selected to correspond to an ordinary or "safe" range of flexion and extension to preserve freedom of movement. When flexion or extension of the head moves beyond the ordinary or "safe" range, the pivotal movement of the helmet integration element 134 relative to the atlas support 124 will exceed the limited range of pivotal motion. This will cause the helmet integration element 134 to engage the atlas support 124 so that further flexion/extension of the head will move the helmet integration element 134 and the atlas support in unison so that further movement will be resisted by C4-atlas symphyseal resistive joint 128 (and possibly the other symphyseal resistive joints 126, 130).

While helmets used in conjunction with the spinal support devices described herein will typically be specially adapted for coupling to the helmet integration element thereof, it is contemplated that different types of helmets may be provided for different activities, with each such helmet being similarly adapted for coupling to a helmet integration element. Thus, there may be different helmets for, for example, football, hockey, skateboarding, alpine sports, or other activities, with each such helmet being adapted for coupling to the same type of helmet integration element. In such an embodiment, a single spinal support device may be used for multiple activities by decoupling one helmet from the helmet integration element and then coupling a different helmet to the helmet integration element.

The spinal support device 100 may be secured on the dorsal side of a subject's torso in a variety of ways. For example, in one embodiment, a harness (not shown in FIGS. 1 to 13) may be used. The harness may comprise opposed fastening straps (not shown in FIGS. 1 to 13) that extend between the superior end 108 of the upper spinal support portion 102 (in particular the spinal support arm 116) and the projections 138 at the Y-shaped inferior end 140 of the lower spinal support portion 106 for strapping the spinal support device 100 onto a subject's back. Thus, the fastening straps are adapted for fastening the upper spinal support portion and the lower spinal support portion onto a human back in registration with a spine thereof. In another embodiment, the upper spinal support portion 104 and the lower spinal support portion 106 may be integrated into the dorsal side of a torso article such as a vest, compression shirt, or the like. Thus, the harness adapted to secure the wearable article (spinal support device 100) externally and non-invasively on a human being in registration with the body region, in this case the back and neck, with the engagement surface in close topographical engagement with the surface contours of the back and neck, so that forces are transferred from the hard tissue (vertebrae) to the force-directing frame (upper spinal support portion 102 and lower spinal support portion 106). With the spinal support device 100 so secured, at least a portion of the forces applied to the hard tissue (vertebrae) are diverted away from the soft tissue (e.g. muscle, intervertebral discs) to the dampers (symphyseal resistive joints 126, 128, 130) by transfer of the forces from the hard tissue through the force-directing frame to the dampers whereby the dampers absorb the transferred portion of the forces and thereby limit internal forces applied to the soft tissue by the hard tissue.

Reference is now made to FIGS. 14 to 26, which show a second exemplary spinal support device, indicated generally by reference 200. The second exemplary spinal support device 200 shown in FIGS. 14 to 26 is similar to the first exemplary spinal support device 100 shown in FIGS. 1 to 13, with like features denoted by like reference numerals, except with the prefix "2" instead of "1". Thus, the cervical spine support portion of the second exemplary spinal support device 200 is denoted by reference 202, the upper spinal support portion of the second exemplary spinal support device 200 is denoted by reference 204, and so on. The second exemplary spinal support device 200 differs from the first exemplary spinal support device 100 primarily in that instead of being discrete joints formed from separate pieces of energy-absorbing material, in the second exemplary spinal support device 200 the symphyseal resistive dampers that form the C6-C4 symphyseal resistive joint 226, the C4-atlas symphyseal resistive joint 228 and the upper spine-cervical symphyseal resistive joint 230 are formed from at least one monolithic layer of energy-absorbing material extending from the trapezius grapnel 212 along the cervical spine support portion 202.

In the illustrated embodiment, one or more layers 242 of energy-absorbing material are disposed on the ventral side of the upper spinal support portion 204, and extend from just above the inferior end 240 of the lower spinal support portion 206 superiorly to the upper spinal support portion 204 and along and past the trapezius grapnel 212 and then along the ventral side of the cervical spine support portion 202 to the atlas support 224. The energy-absorbing material need not extend as far inferiorly as is shown in the illustrated embodiment but merely needs to extend far enough inferiorly to perform the symphyseal resistive joint functions. At the junction between the superior end 208 of the upper spinal support portion 204 and the C6 vertebra support 220, the layer(s) 242 of energy-absorbing material converge to form a penannular collar 232 forming part of the upper spine-cervical spine symphyseal resistive joint 230, and continue along the ventral side of the cervical spine support portion 202. The C6-C4 symphyseal resistive joint 226 is formed by a portion of the layer(s) 242 of energy-absorbing material that projects dorsally between the C6 vertebra support 220 and the C4 vertebra support 222, and the C4-atlas symphyseal resistive joint 228 is formed by a portion of the layer(s) 242 of energy-absorbing material that projects dorsally between the C4 vertebra support 122 and the atlas support 124. The energy-absorbing material may be, for example, an elastomeric material or a force-reactive polymer. Where multiple layers 242 are provided, the layers may be of identical, similar, or dissimilar energy-absorbing materials.

Reference is now made to FIGS. 27 to 37, which show a third exemplary spinal support device, indicated generally by reference 300, according to an aspect of the present disclosure. The third exemplary spinal support device 300 is another exemplary implementation of a wearable article constructed according to the principles disclosed herein.

Figure 27:
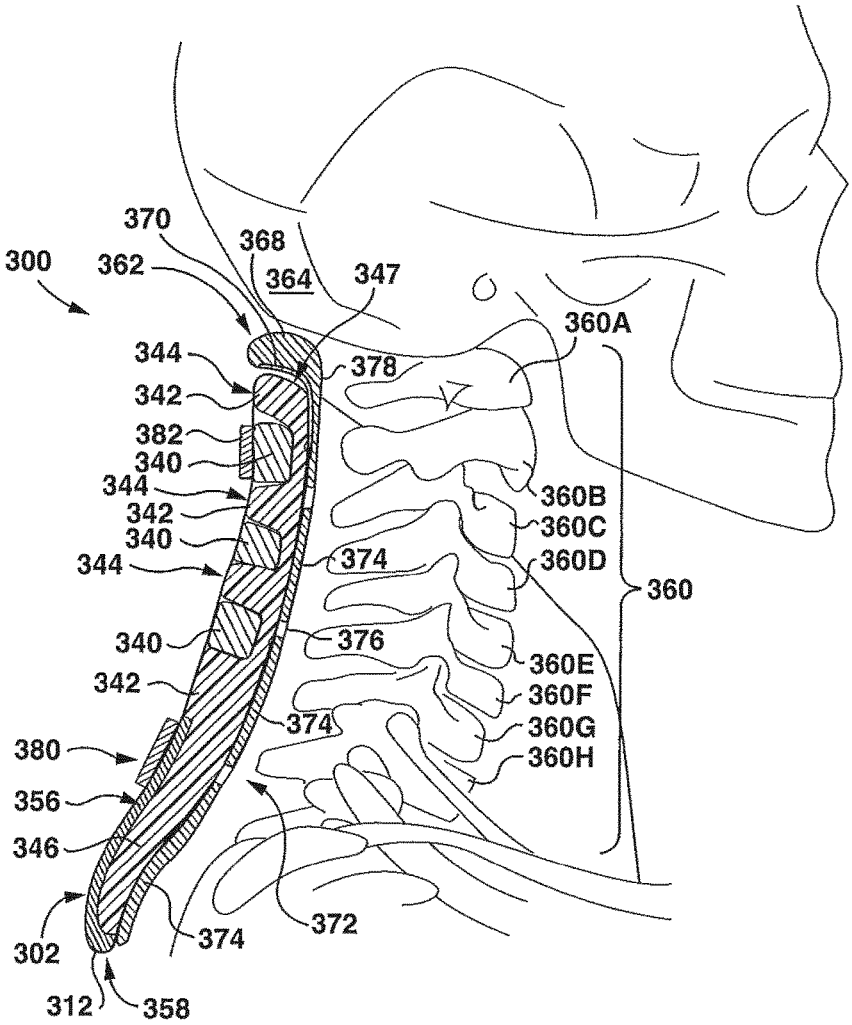
FIG. 27 is a cross-sectional view of part of a third exemplary spinal support device, taken along the line 27-27 in FIG. 34 showing a first alignment with human vertebrae, in accordance with some embodiments.
Figure 28:
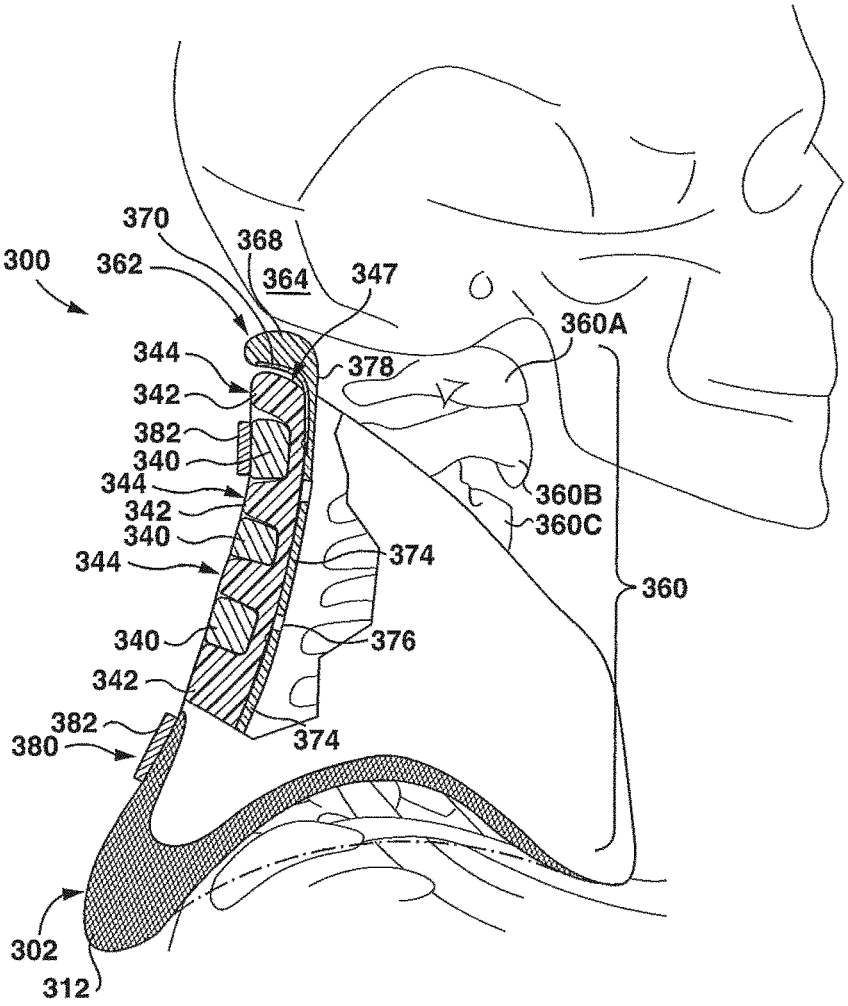
FIG. 28 is a partial cut-away view of the part of the spinal support device shown in FIG. 27, showing the first alignment with human vertebrae, in accordance with some embodiments.
Figure 29:
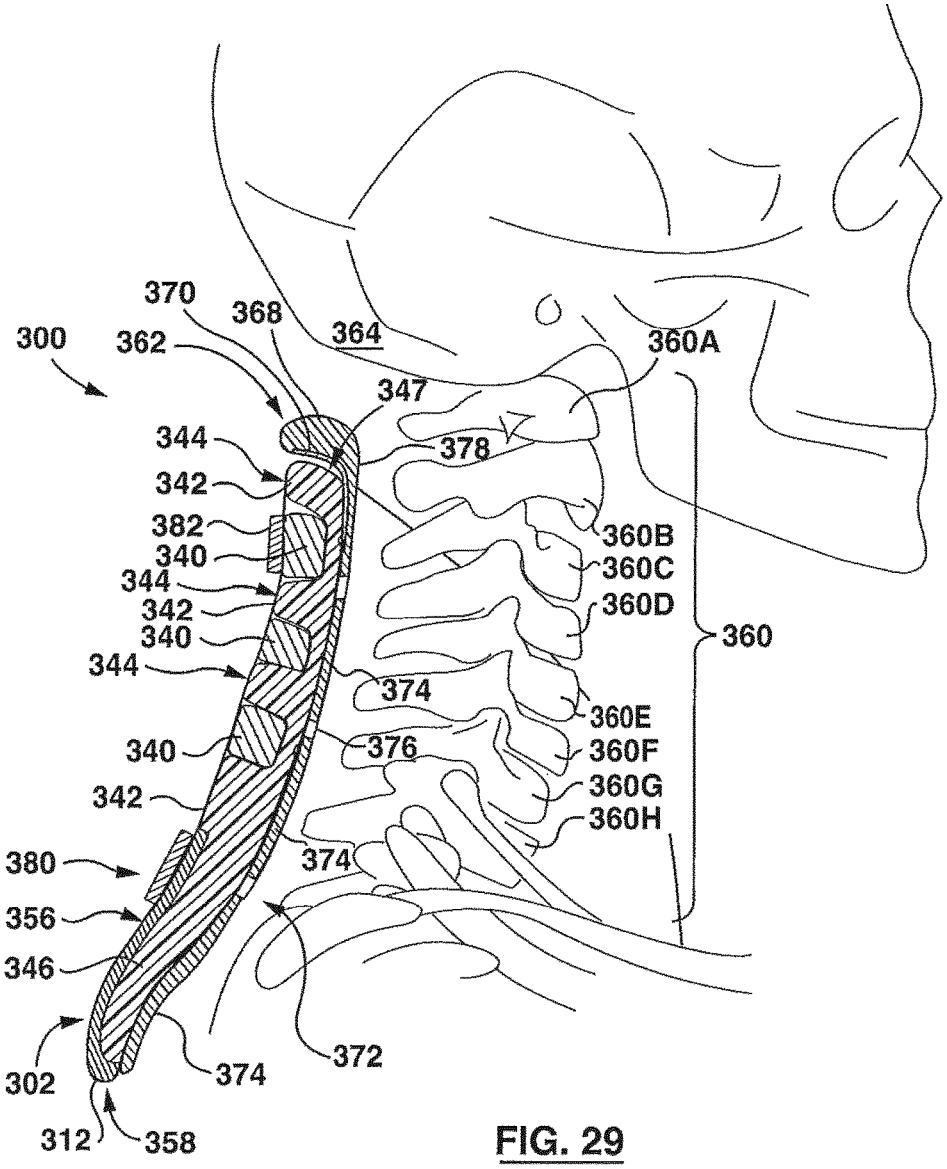
FIG. 29 is the same cross-sectional shown in FIG. 27 but showing a second alignment with human vertebrae, in accordance with some embodiments.
Figure 36:
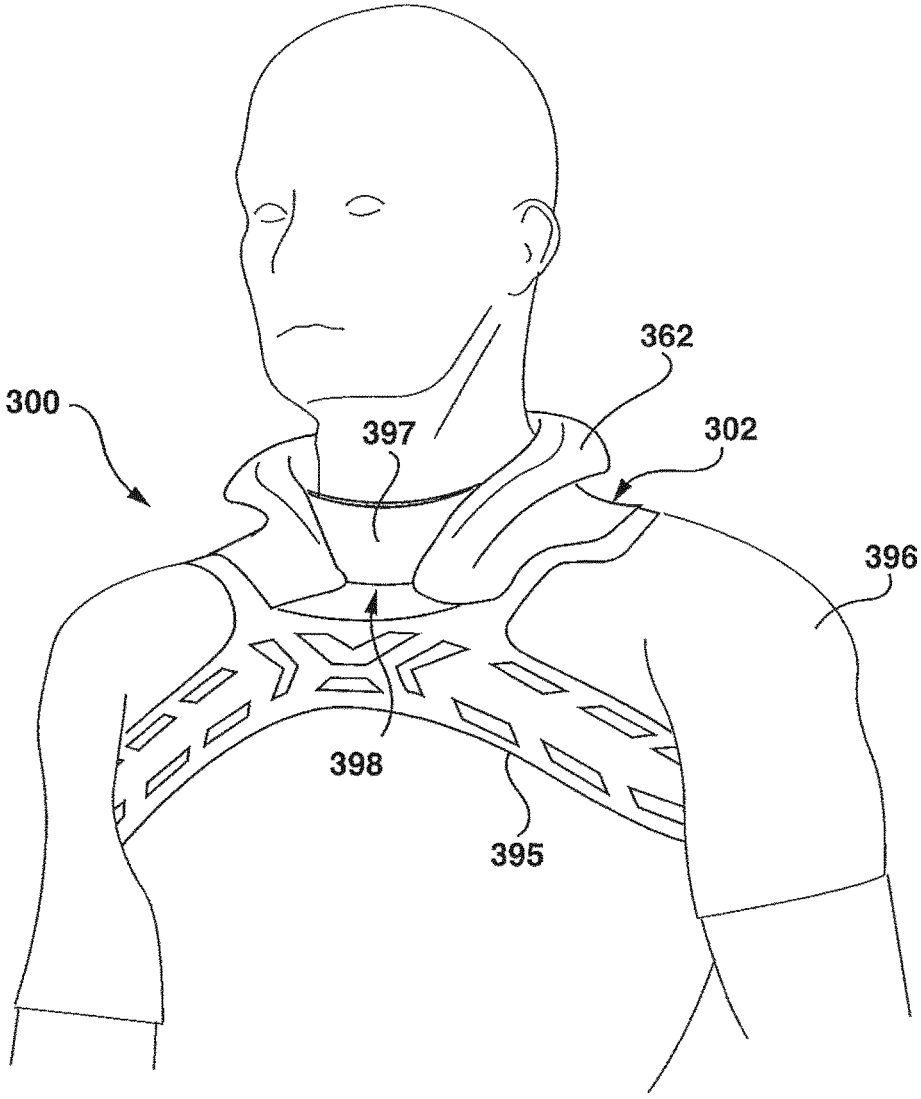
FIG. 36 is a front perspective view of the spinal support device of FIG. 27 harnessed to a human, in accordance with some embodiments.
Figure 37:
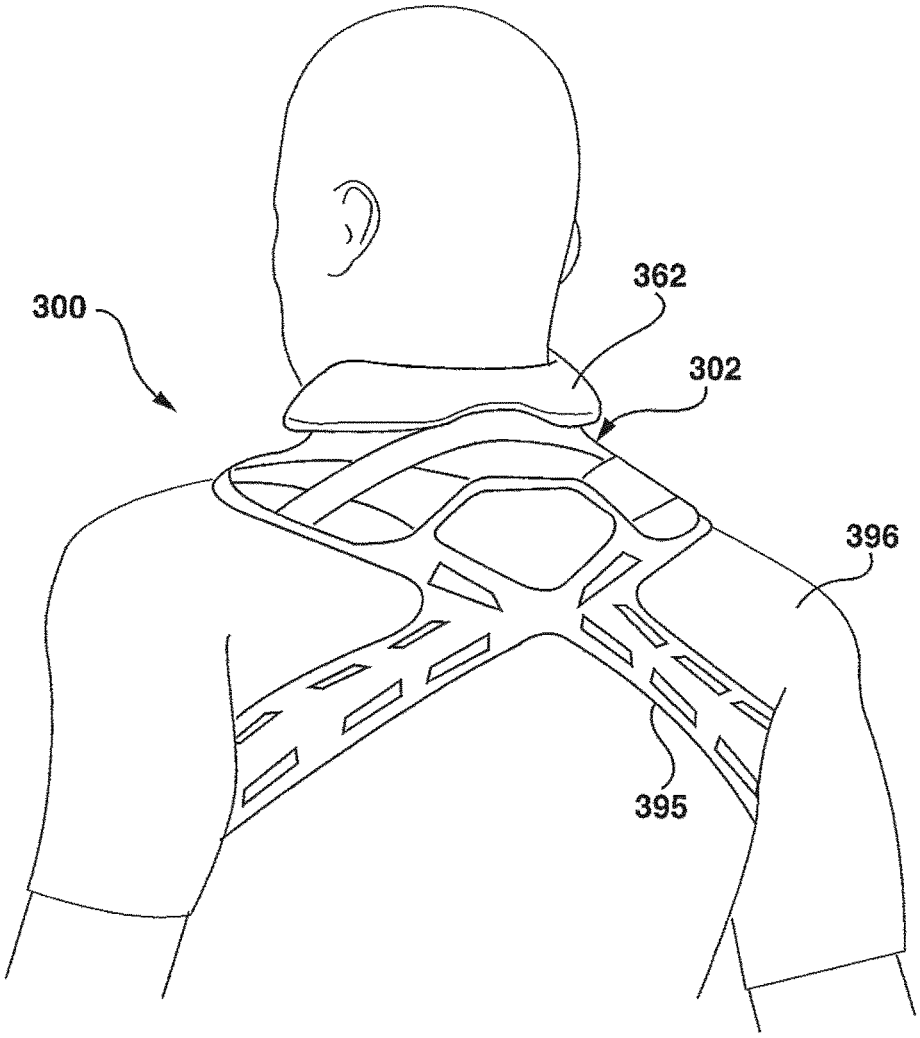
FIG. 37 is a rear perspective view of the spinal support device of FIG. 27 harnessed to a human, in accordance with some embodiments.

As best seen in FIGS. 27 to 29, the third spinal support device 300 comprises a biomechanically stiff trapezius grapnel 312 adapted to extend over and engage human trapezius muscles from a dorsal position toward a ventral position, a penannular cervical spine support portion 302 coupled to and supported by the trapezius grapnel 312, and a harness 395 (see FIGS. 36 and 37). The term "biomechanically stiff", as used herein, means sufficiently rigid to transmit the majority of applied force while absorbing a minor portion of the applied force by deformation. In this sense, the term "biomechanically stiff" means stiff in the same sense that thick fibrocartilage is stiff, and the term "biomechanically stiff" implies less rigidity (more flexibility) than the term "biomechanically rigid". The trapezius grapnel 312 may be made from, for example, silicone, rubber, or suitable polymer materials.

The penannular shape of the cervical spine support portion 302 (best seen in FIG. 31) allows it to cradle the cervical spine portion of a subject's neck, as shown in FIGS. 27 to 29. The cervical spine support portion 302 comprises a series of biomechanically stiff vertebra supports 340 and a series of symphyseal resistive dampers 342. Like the trapezius grapnel 312, the biomechanically stiff vertebra supports 340 may be made from, for example, silicone, rubber, or suitable polymer materials, which may be the same material, used for the trapezius grapnel 312 or a different material. The vertebrae supports 340 are more rigid than the material used for the symphyseal resistive dampers 342. The symphyseal resistive dampers 342 may be formed, for example, from an elastomeric material or a suitable force-reactive polymer. The vertebra supports 340 are spaced from one another by symphyseal resistive joints formed by the symphyseal resistive dampers 342. Each of the vertebra supports 340 is a frame element forming part of a force-directing frame which, as can be seen in the drawings, is anatomically complementary to the human cervical spine, which comprises hard tissue (vertebrae) and soft tissue (e.g. muscle, intervertebral discs). These frame elements (vertebra supports 340) form the deformable regions within the frame, that is, the spaces between the vertebra supports 340, and the energy-absorbing material that makes up the symphyseal resistive dampers 342 is disposed in those deformable regions. More particularly, one of the symphyseal resistive dampers 342 extends between each adjacent pair of vertebra supports 340 so that the vertebra supports 340 alternate with the symphyseal resistive joints formed by the symphyseal resistive dampers 342. Thus, the symphyseal resistive dampers 342 are engaged with the force-directing frame that comprises the vertebra supports 340 to absorb forces therefrom. As can be seen in FIGS. 27 to 29, the distal symphyseal resistive damper 342, that is, the symphyseal resistive damper 342 that is furthest from the trapezius grapnel 312 relative to the other symphyseal resistive dampers 342, is further distal from the trapezius grapnel 312 than the distal vertebra support 340, that is, the vertebra support 340 that is furthest from the trapezius grapnel 312 relative to the other vertebra supports 312.

As will be explained in greater detail below, the harness 395 (see FIGS. 36 and 37) is mechanically coupled to the trapezius grapnel and is adapted to snugly anchor onto a human torso to maintain engagement of the trapezius grapnel with the human trapezius muscles and thereby maintain correct anatomical positioning of the third spinal support device 300.

Figure 30:
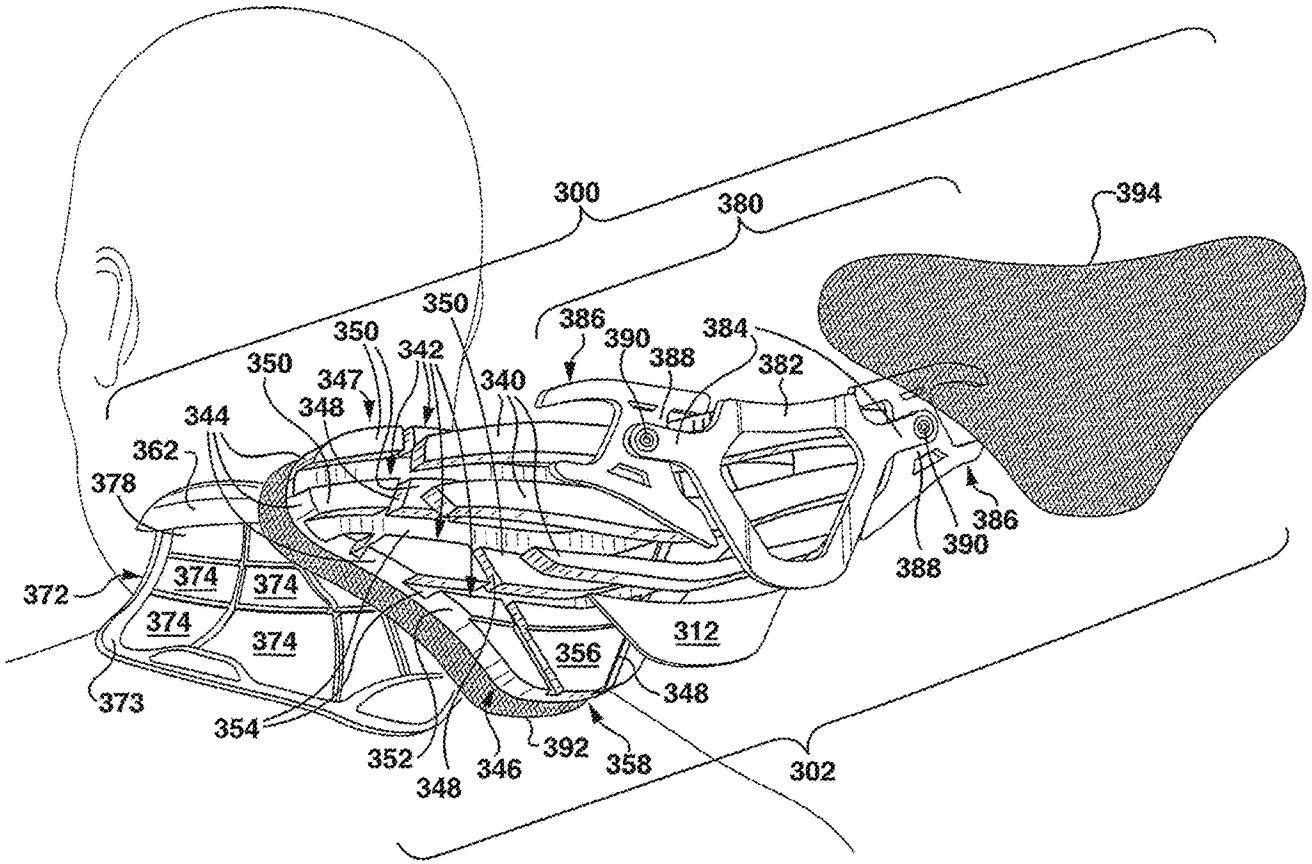
FIG. 30 is an exploded top dorsal perspective view of the spinal support device of FIG. 27, in accordance with some embodiments.
Figure 31:
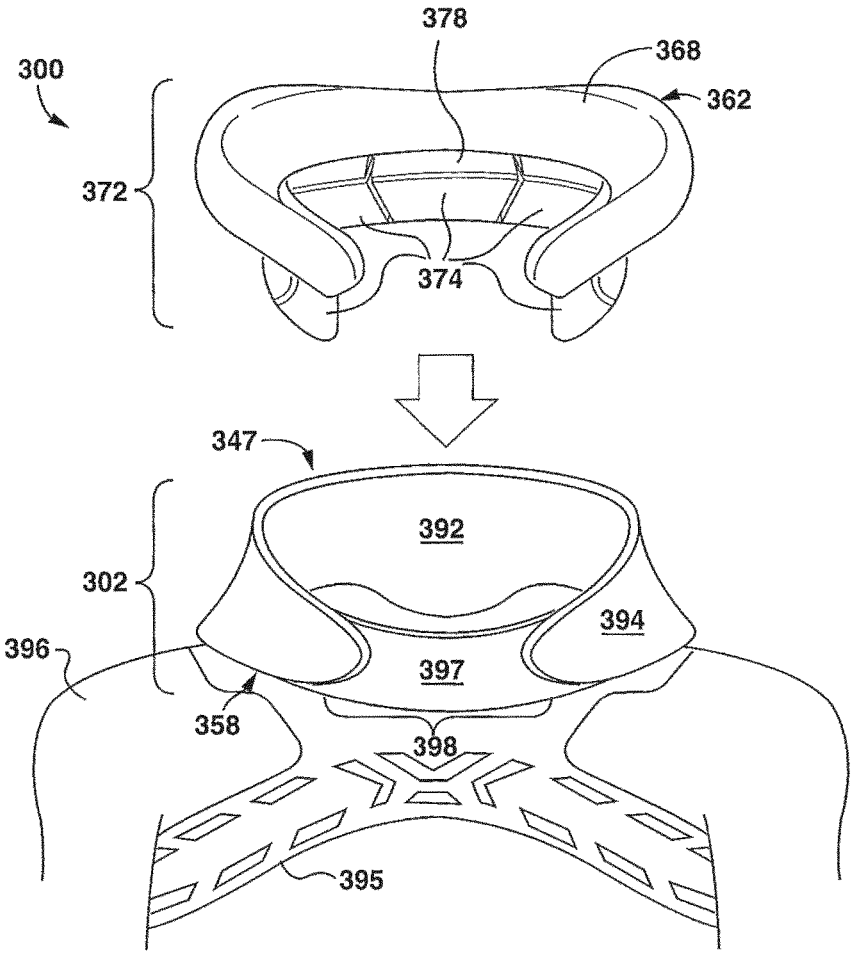
FIG. 31 is a partially exploded top ventral perspective view of the spinal support device of FIG. 27, in accordance with some embodiments.

As best seen in FIG. 30, in the exemplary third spinal support device 300, the symphyseal resistive dampers 342 are formed by ridges 344 on a monolithic collar member 346 formed from energy-absorbing material, with the distal symphyseal resistive damper 342 forming the cranial end 347 of the monolithic collar member 346. The monolithic collar member 346 may be formed, for example, from an elastomeric material or a suitable force-reactive polymer. In the illustrated embodiment, the ridges 344 include longitudinal gaps 348 which divide each symphyseal resistive damper into a plurality of discrete symphyseal resistive elements 350. The longitudinal gaps 348 provide for flexibility, stretching, and articulation of the collar member and, in the illustrated embodiment, extend beyond the ridges into the underlying substrate 352 of the monolithic collar member 346. The vertebra supports 340 are disposed in the longitudinally extending channels 354 between the ridges 344. Thus, the force-directing frame comprises a plurality of discrete force-directing elements (vertebra supports 340) spaced from one another by the symphyseal resistive dampers 342 extending between adjacent ones of the discrete force-directing elements, and the monolithic collar member 346 also includes a recessed region 356 at the caudal end 358 thereof, e.g., the end opposite the cranial end 347, which receives the trapezius grapnel 312. Thus, the monolithic collar member 346 extends from the trapezius grapnel 312 at the caudal end 358 of the monolithic collar member 346 to and including the distal symphyseal resistive damper 342 forming the cranial end 347 of the monolithic collar member 346. An additional symphyseal resistive damper 342 is formed between the trapezius grapnel 312 and the proximal vertebra support 340, that is, the vertebra support 340 that is closest to the trapezius grapnel 312 relative to the other vertebra supports 312.

The use of the monolithic collar member 346 to form the symphyseal resistive dampers 342 represents merely one exemplary embodiment. In other embodiments, the collar member and the symphyseal resistive dampers may be separate and discrete (e.g. non-monolithic) components. For example, the symphyseal resistive dampers may comprise separate pieces bonded to or otherwise secured on a collar member.

As can be seen in FIGS. 27 to 29, the vertebra supports 340 and the symphyseal resistive joints formed by the symphyseal resistive dampers 342 are sized and positioned for dorsal alignment with respective alternating human vertebrae 360. As shown in FIGS. 27 to 29, the C1 vertebra (atlas bone) is denoted by reference 360A, the C2 vertebra is denoted by reference 360B, the C3 vertebra is denoted by reference 360C, the C4 vertebra is denoted by reference 360D, the C5 vertebra is denoted by reference 360E, the C6 vertebra is denoted by reference 360F, the C7 vertebra is denoted by reference 360G and the T1 vertebra is denoted by reference 360H. Embodiments of the third exemplary spinal support device 300 may be provided in a number of different sizes to accommodate individuals of different ages, heights, sizes, and genders. For a given size of spinal support device 300, the exact alignment of the vertebra supports 340 and the symphyseal resistive joints formed by the symphyseal resistive dampers 342 with the vertebrae 360 will depend on a number of factors, including the size of the wearer's trapezius muscles and the length of the wearer's neck. Thus, for the same size of spinal support device 300, the alignment may be shifted relatively cranially or relatively caudally from one subject to another. FIGS. 27 and 28 show a relatively more cranial alignment in which the vertebra supports 340 are in registration with and positioned to dorsally cradle the C2 vertebra 360B, the C4 vertebra 360D and the C6 vertebra 360F, and the symphyseal resistive joints formed by the symphyseal resistive dampers 342 are in registration with and positioned to dorsally cradle the C3 vertebra 360C, the C5 vertebra 360E and the C7 vertebra 360G. FIG. 29 shows a relatively more caudal alignment in which the vertebra supports 340 are in registration with and positioned to dorsally cradle the C3 vertebra 360C, the C5 vertebra 360E and the C7 vertebra 360G, and the resistive joints formed by the symphyseal resistive dampers 342 are in registration with and positioned to dorsally cradle the C4 vertebra 360D, the C6 vertebra 360F and the T1 vertebra 360H.

In both the relatively more cranial alignment (FIGS. 27 and 28) and the relatively more caudal alignment (FIG. 29), the relative positions of the trapezius grapnel 312, the vertebra supports 340 and the symphyseal resistive joints formed by the symphyseal resistive dampers 342 allow the cervical spine support portion 302 to mimic the natural articulation of a human spine. Similarly to the first and second exemplary spinal support devices 100, 200, the symphyseal resistive joints formed by the symphyseal resistive dampers 342 provide increasing resistance as they undergo increasing deformation in response to an applied force causing flexion/extension/rotation of the spine and can thereby reduce angular/rotational acceleration (whiplash) of the head and neck from impact to the head or body. Thus, the frame elements (vertebra supports 340 as well as the flange portion 270 described below) are configured to divert at least a portion of the internal contortion forces within the cervical spine through the frame elements to the deformable regions (symphyseal resistive dampers 342 as well as symphyseal resistive flange portion 368). The energy-absorbing material forming the symphyseal resistive dampers 342 and the symphyseal resistive flange portion 368 damps the diverted internal contortion forces by deformation of the rate-sensitive material. Accordingly, when the third spinal support device 300 is secured on a wearer's neck, at least a portion of the forces applied to the hard tissue (vertebrae) are diverted away from the soft tissue (e.g. muscle, intervertebral discs) to the dampers (symphyseal resistive dampers 342 and symphyseal resistive flange portion 368) by transfer of the forces from the hard tissue through the force-directing frame (vertebra supports 340 as well as the flange portion 270) to the dampers whereby the dampers absorb the transferred portion of the forces and thereby limit internal forces applied to the soft tissue by the hard tissue.

Figure 32A:
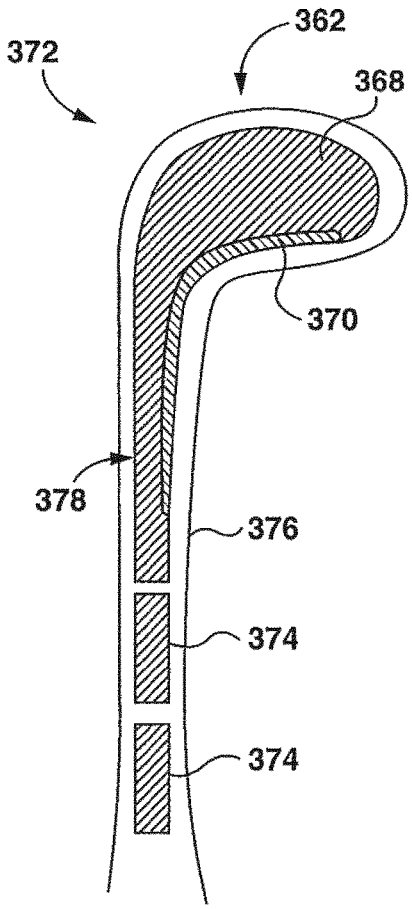
FIGS. 32A and 32B are partial cross-sectional views taken along the line 32A/B-32A/B in FIG. 31, in accordance with some embodiments.
Figure 32B:
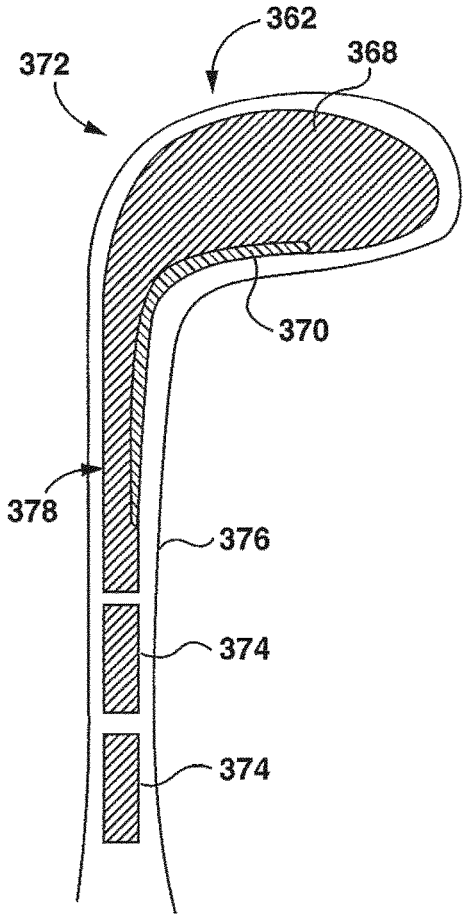

In order to couple movement of a subject's head to the third spinal support device 300, the third spinal support device 300 further comprises an atlas support flange 362 that is mechanically coupled to and supported by the cervical spine support portion 302 distal from the trapezius grapnel 312. The atlas support flange 362 is disposed cranially of the cranial end 347 of the collar member 346 and extends dorsally outwardly therefrom so that, when the third exemplary spinal support device 300 is worn, the atlas support flange 362 will be interposed between the wearer's occipital bone 364 and the distal symphyseal resistive damper 342, generally in registration with the wearer's atlas bone 360A. The atlas support flange 362 provides a mechanical linkage between the wearer's occipital bone 364 and the distal symphyseal resistive damper 342 so that when the wearer's head moves (e.g. pivots) dorsally, such as from an impact, energy is transferred from the wearer's skull through the atlas support flange 362 to the distal symphyseal resistive damper 342 and thereby to the cervical spine support portion 302. In some embodiments, such as for sports where no helmet is worn, the atlas support flange 362 may directly engage the wearer's head; in other embodiments, such as for helmeted sports, the atlas support flange 362 may engage the helmet, for example at the dorsal base of the helmet. The atlas support flange 362 may have different sizes or shapes depending on its intended use. For example, as shown in FIGS. 32A and 32B, an atlas support flange 362 that is intended for use in hockey (FIG. 32A) may have a smaller volume than one intended for use in American/Canadian football (FIG. 32B). The atlas support flange 362 enables the third exemplary spinal support device to be used with standard, unmodified helmets.

In the illustrated embodiment, as best seen in FIGS. 32A and 32B, the atlas support flange 362 comprises a symphyseal resistive flange portion 368 and a semi-rigid resilient flange portion 370 which, when the atlas support flange 362 is engaged with the cervical spine support portion 302, is interposed between the symphyseal resistive flange portion 368 and the distal symphyseal resistive damper 342. The symphyseal resistive flange portion 368 may be made from the same material as the collar member 346, for example, from an elastomeric material or a suitable force-reactive polymer. The semi-rigid resilient flange portion 270 may be made from, for example, suitable flexible polymers. The semi-rigid resilient flange portion 270 is also a frame element, and assists in energy transfer from the skull or helmet through the atlas support flange 262 to the distal symphyseal resistive damper 342. The symphyseal resistive flange portion 368 also provides progressively increasing resistance to deformation, and can thereby provide further mechanical resistance to (e.g. braking/deceleration of) of whiplash-related and concussion-related movement.

As shown in FIG. 30, in the illustrated embodiment the atlas support flange 362 is integrated with and extends outwardly from a liner 372 disposed on an innermost surface of the cervical spine support portion 302 such that, in use, the liner 372 will be positioned between the wearer's neck and the cervical spine support portion 302. In the illustrated embodiment, the liner comprises a frame 373 (FIG. 30) and a plurality of discrete, spaced apart resilient members 374 laminated within an envelope of breathable mesh 376 (see FIGS. 32A and 32B—the breathable mesh envelope 376 is not shown in FIGS. 30 and 31 for clarity of illustration). The breathable mesh 376 and the spacing between the resilient members 374 facilitate airflow along the subject's neck to improve comfort when wearing the spinal support device 300. In a preferred embodiment, as shown in the drawings, the atlas support flange 362, including both the symphyseal resistive flange portion 268 and the semi-rigid resilient flange portion 370, is generally L-shaped in cross-section and includes a depending brace 378 forming part of the liner 372, and is encapsulated within the breathable mesh 376 along with the resilient members 374. In a preferred embodiment, the liner 372, and therefore the atlas support flange 362, is selectively engageable with and disengageable from the cervical spine support portion 302, and to assist in fitting the spinal support device 300 to a subject, liners 372 may be provided with different thicknesses by using resilient members 374 and a depending brace 378 of desired thickness. The liner 372 may be engaged with and disengaged from the cervical spine support portion 302 in a number of ways, including friction and/or pressure between a wearer's neck and the inner surface of the cervical spine support portion 302 or positive engagement mechanisms such as hook-and-loop fasteners or snap fasteners, among others. Thus, the spinal support device 300 has an engagement surface that conforms to external surface contours of the subject's neck.

Figure 33:
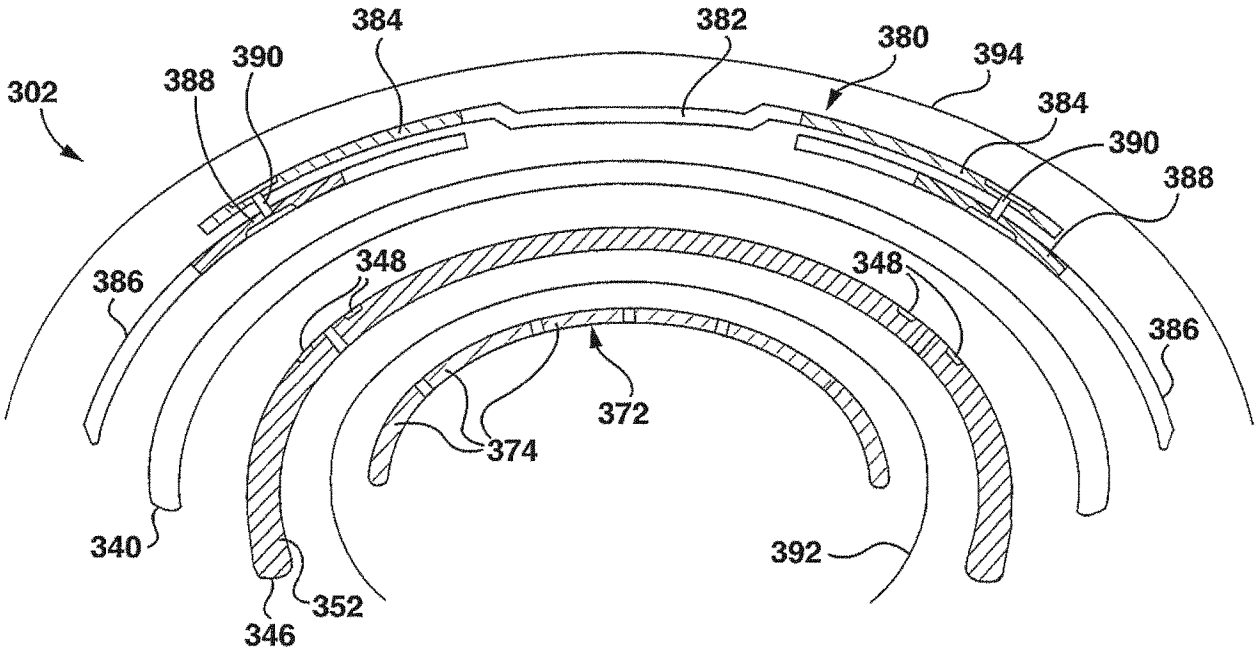
FIG. 33 is a cross-sectional view of a cervical spine support portion of the spinal support device of FIG. 27, taken along the line 33-33 in FIG. 34, in accordance with some embodiments.
Figure 34:
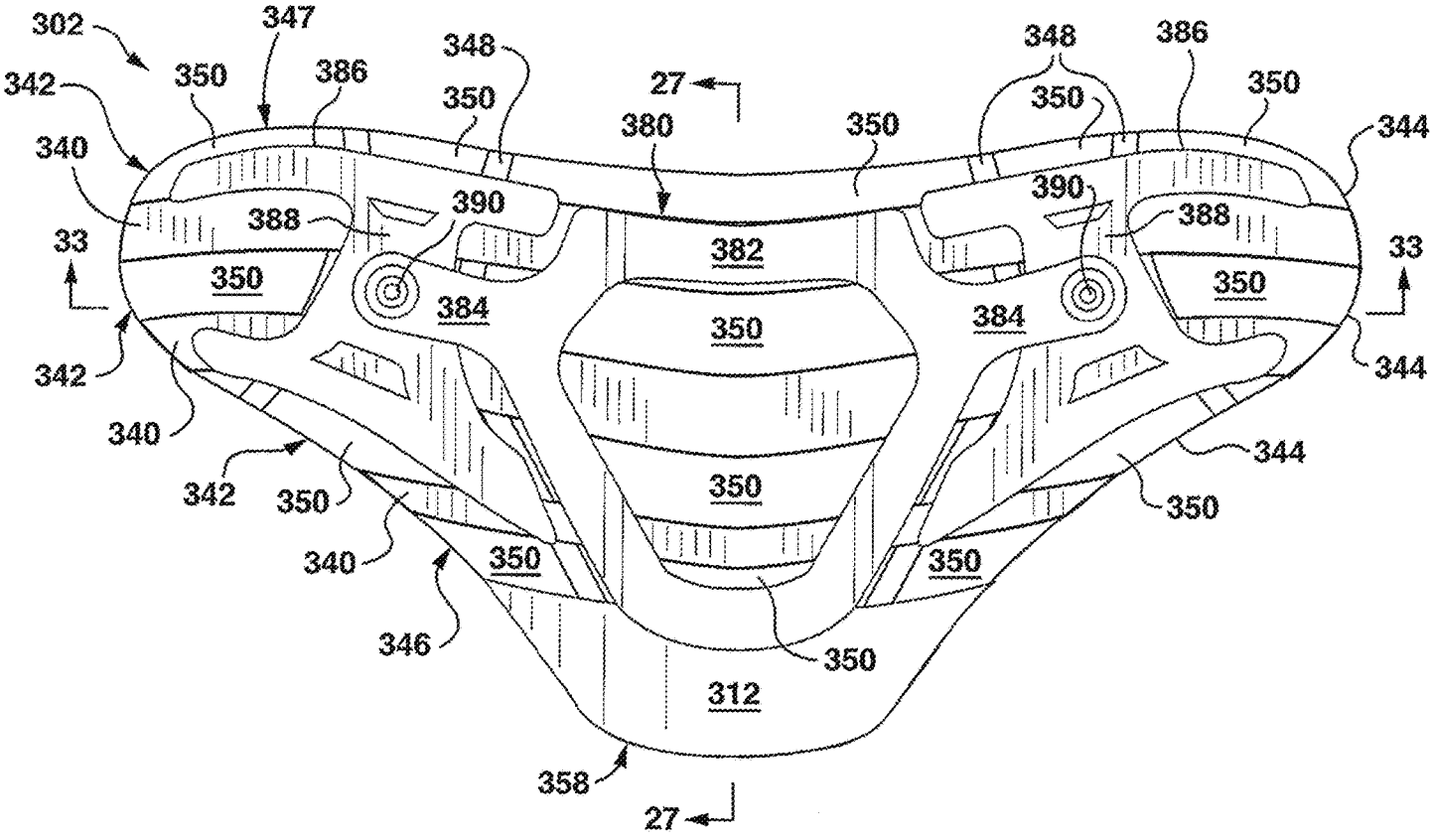
FIG. 34 is a dorsal view of the cervical spine support portion and a trapezius grapnel of the spinal support device of FIG. 27, in accordance with some embodiments.
Figure 35:
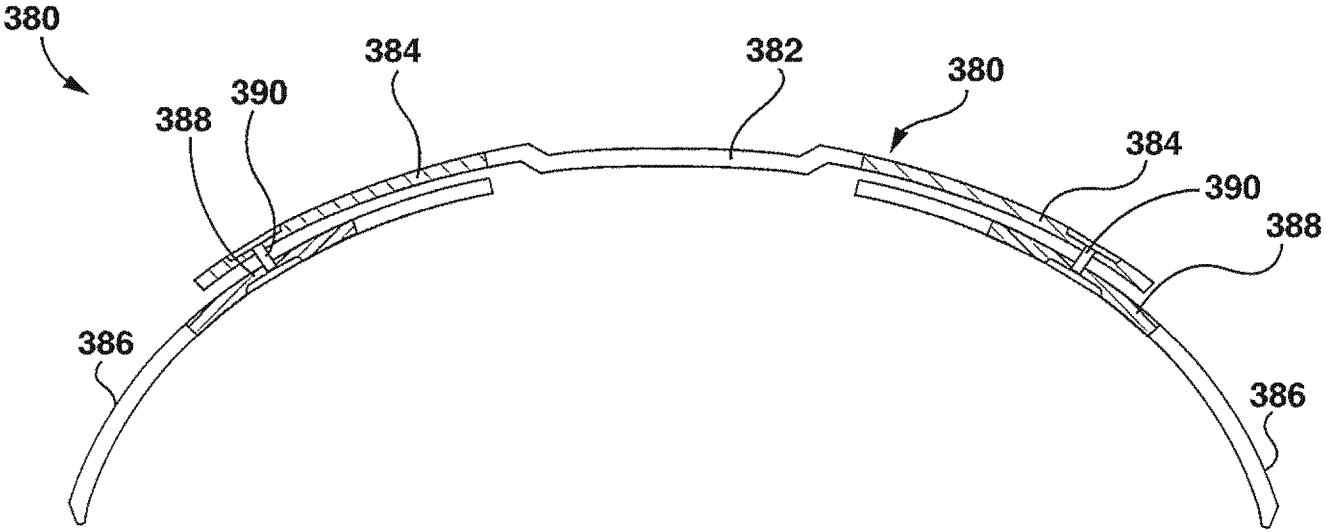
FIG. 35 is a plan view of a resilient C-shaped retainer of the spinal support device of FIG. 27, in accordance with some embodiments.

With reference now to FIGS. 33 to 35, in a preferred embodiment the spinal support device 300 further comprises a resilient C-shaped retainer 380 engaging the monolithic collar member 346. The retainer 380 assists in returning the cervical spine support portion 302 to its neutral penannular shape following distortion, such as from movement by a wearer. In the illustrated embodiment, the retainer 380 comprises a curved central open scutiform frame 382 having two outwardly extending arms 384, and two outer H-frames 386 whose crossbars 388 are coupled to the arms 384 of the central open scutiform frame 382 by fasteners 390 such as rivets or the like. The fasteners 390 extend through the arms 384 of the central open scutiform frame 382, through the crossbars 388 of the outer H-frames 386 and through the monolithic collar member 346. The retainer 380 may be made from, for example, a suitable flexible polymer. As shown in FIGS. 30 and 33, the retainer 380, the vertebra supports 340 and the monolithic collar member 346 may all be laminated between inner and outer layers 392, 394 of textile, fabric, or similar material so as to provide the cervical spine support portion 302 with an exterior sheath. In the illustrated embodiment, lamination between the inner and outer layers 392, 394 secures the trapezius grapnel 312 and the other vertebra supports 312 in position on the monolithic collar member 346, and a layer of thermoplastic polyurethane (TPU) is coated onto the exterior surface of the exterior sheath formed by the inner and outer layers 392, 394 to provide further structural reinforcement Other techniques, such as adhesive or bonding, may also be used to secure the trapezius grapnel 312 and the other vertebra supports 312 on the monolithic collar member 346.

As noted above, the third spinal support device 300 further comprises a harness 395 (not shown in FIG. 30; see FIGS. 36 and 37), which is secured to the cervical spine support portion 302 to maintain correct anatomical positioning of the third spinal support device 300. Thus, the harness 395 serves as a fastener adapted to secure the wearable article (spinal support device 300) externally and non-invasively on the subject in registration with the cervical spine in close topographical engagement the surface contours of the neck so that forces are transferred from the hard tissues (vertebrae) to the force-directing frame (vertebra supports 340 as well as the flange portion 270). Like the first and second exemplary spinal support devices 100, 200, the third exemplary spinal support device 300 may be integrated into a torso article such as a vest, compression shirt, or the like. For example, as shown in FIGS. 36 and 37, the harness 395 to which the cervical spine support portion 302 is formed from (TPU) and is laminated or otherwise suitably secured to a shirt 396 or similar article. In the illustrated embodiment, the harness 395 is secured to the cervical spine portion 302 by attachment, for example by stitching, to the exterior sheath formed by the inner and outer layers 392, 394 (FIG. 30) with further structural reinforcement being provided by bonding the harness to the layer of TPU disposed on the exterior surface of the exterior sheath. In other embodiments, the harness may be made from other suitable materials. Moreover, the harness design shown in the drawings, which loops across the chest, under the arms and between the shoulder blades so as to encircle the torso, is merely exemplary harness arrangement, and any suitable harness arrangement which provides snug anchoring to the torso may be used.

The spinal support device 300 is preferably provided with a throat band 397 extending across an aperture 398 of the cervical spine support portion. For example, the throat band 397 may be stitched to or otherwise secured to the exterior sheath formed by the inner and outer layers 392, 394 of material, and may be elasticized or otherwise resilient or may take the form of a strap provided with a buckle or other fastener. In some embodiments, for example where the spinal support device 300 is intended for use in ice hockey, the throat band 397 and the inner and outer layers 392, 394 may be made from a suitable cut-resistant material. For example, certain sports may require throat protection meeting certain cut-resistance standards.

Reference is now made to FIGS. 38 to 48B, which show another exemplary wearable article in the form of a fourth exemplary spinal support device 400. In the fourth exemplary spinal support device 400, a force-directing frame 402 is formed by two spaced-apart curved frame elements, namely a cranial frame element 404A and a caudal frame element 404B, which are shaped and dimensioned to be anatomically complementary to the anterior and lateral portions of a human neck (e.g. cervical spine region). The frame elements 404A, 404B are coupled to a quantity of rate-sensitive material 406 in the form of a monolithic penannular collar member 408 which is also shaped and dimensioned to be anatomically complementary to the anterior and lateral portions of a human neck. Certain exemplary techniques for coupling the frame elements 404A, 404B to the rate-sensitive material 406 will be described further below.

The frame elements 404A, 404B form three deformable regions 410A, 410B, 410C within the force-directing frame 402, with the rate-sensitive material 406 disposed within the deformable regions 410A, 410B, 410C. A superior deformable region 410A is formed superiorly (cranially) of the cranial frame element 404A, an inferior deformable region 404B is formed inferiorly (caudally) of the caudal frame element 404B and an intermediate deformable region 410C is formed between the cranial frame element 404A and the caudal frame element 404B. A portion of the rate-sensitive material 406 forming the collar member 408 is disposed within each of the superior deformable region 410A, the inferior deformable region 404B and the intermediate deformable region 410C. When the fourth exemplary spinal support device 400 is secured on the subject's neck, the frame elements 404A, 404B will divert at least a portion of the internal contortion forces within the neck through one or both of the frame elements 404A, 404B to one or more of the superior deformable region 410A, the inferior deformable region 404B and the intermediate deformable region 410C. The rate-sensitive material 406 in the superior deformable region 410A, the inferior deformable region 404B and/or the intermediate deformable region 410C thereby damps the diverted internal contortion forces by deformation of the rate-sensitive material 406 therein.

Figure 41:
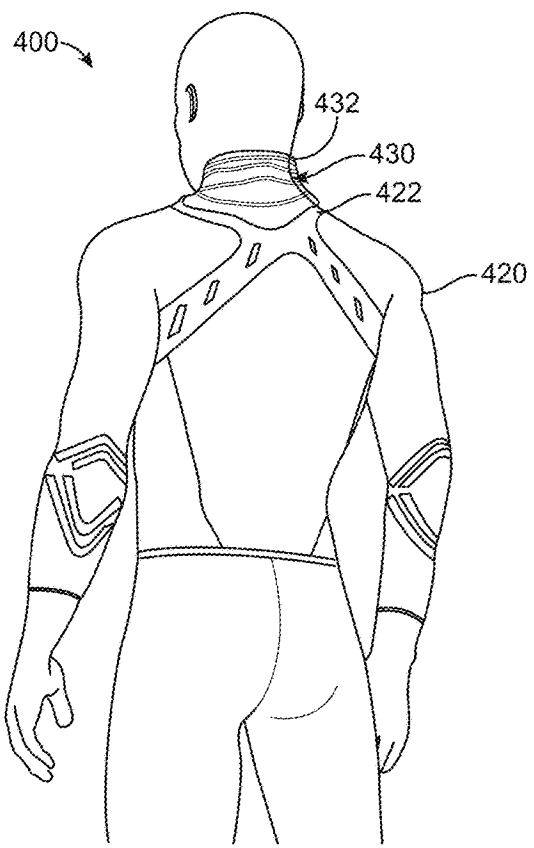
FIG. 41 is a rear perspective view of the spinal support device of FIG. 38 harnessed to a human, in accordance with some embodiments.
Figure 40:
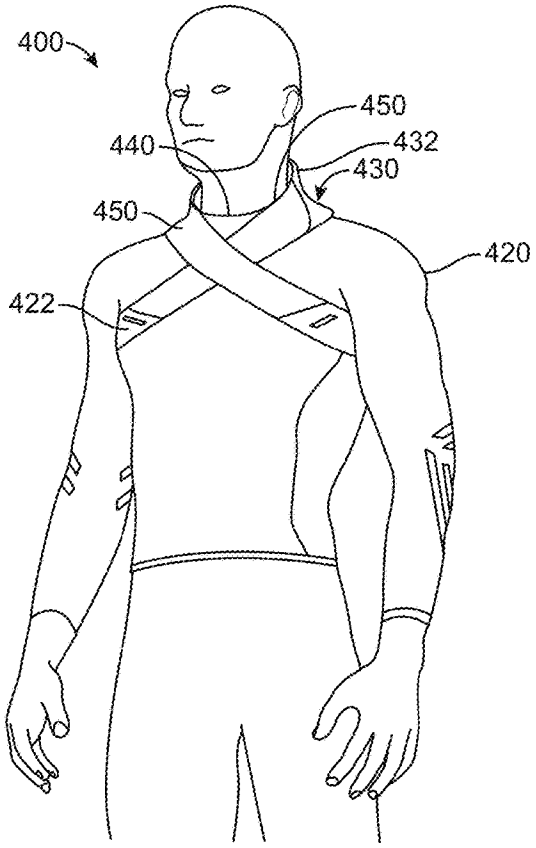
FIG. 40 is a front perspective view of the spinal support device of FIG. 38 harnessed to a human, in accordance with some embodiments.
Figure 42:
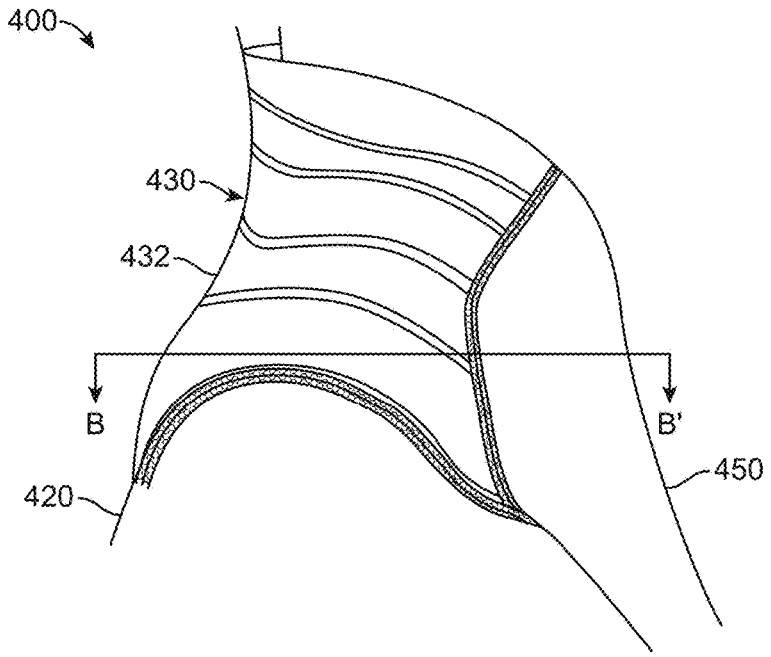
FIG. 42 is a side elevation view of a portion of the spinal support device of FIG. 38, in accordance with some embodiments.
Figure 43:
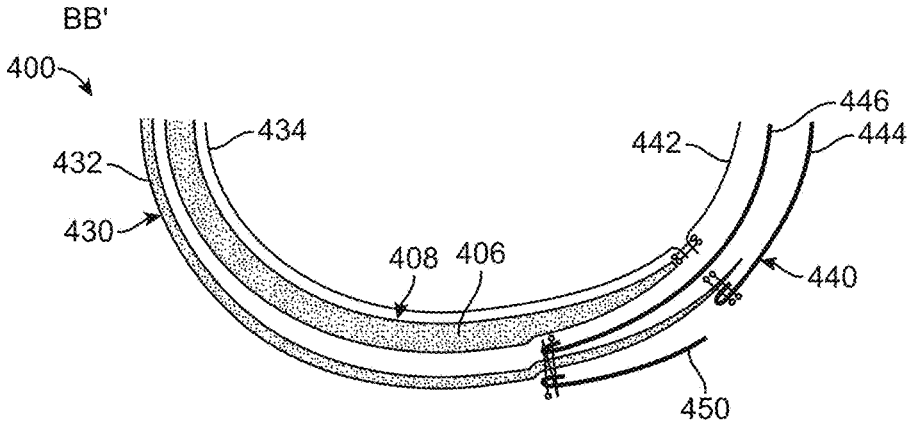
FIG. 43 is a cross-sectional view taken along the line B-B' in FIG. 42, in accordance with some embodiments.
Figure 44:
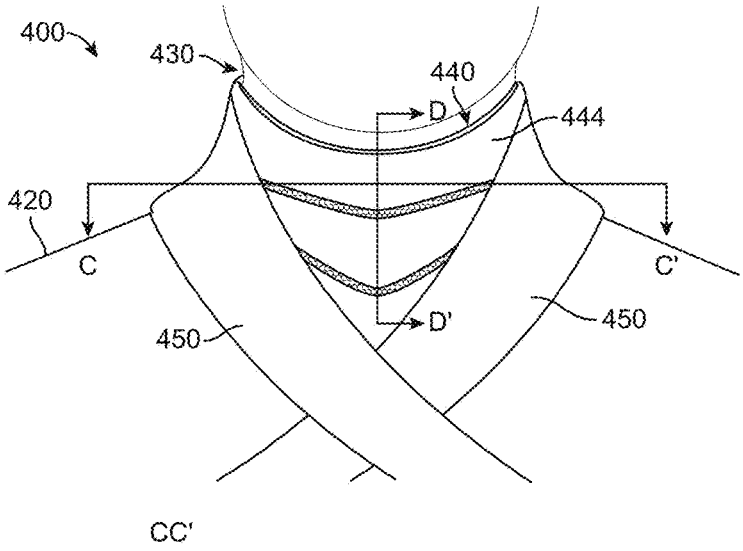
FIG. 44 is a front elevation view of a portion of the spinal support device of FIG. 38, in accordance with some embodiments.
Figure 45:
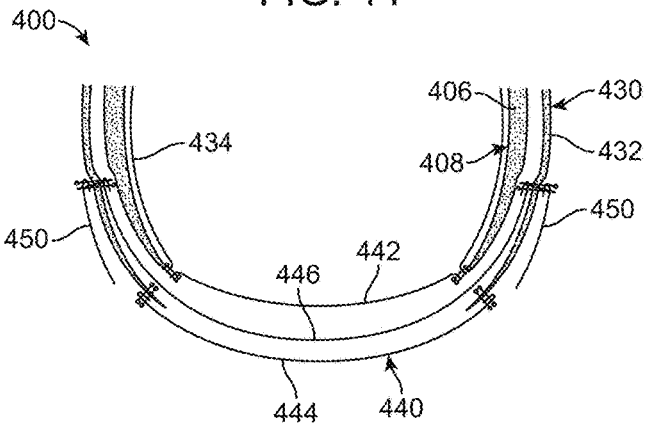
FIG. 45 is a cross-sectional view taken along the line C-C' in FIG. 44, in accordance with some embodiments.
Figure 46A:
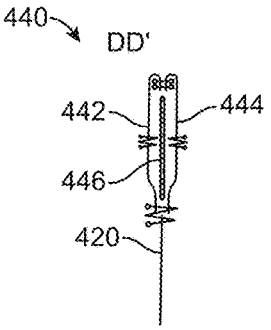
FIG. 46A is a cross-sectional view taken along the line D-D' in FIG. 44 showing a first construction for a ventral liner, in accordance with some embodiments.
Figure 46B:
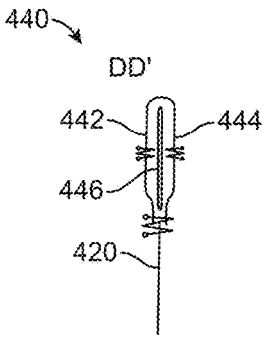
FIG. 46B is a cross-sectional view taken along the line D-D' in FIG. 44 showing a second construction for a ventral liner, in accordance with some embodiments.

As shown in FIGS. 40 and 41, the fourth exemplary spinal support device 400 is secured externally and non-invasively on the subject in registration with the neck and in close topographical engagement therewith by way of a fastener comprising a compression shirt 420 with an integrated harness 422, which arrangement will be described further below.

Figure 39B:
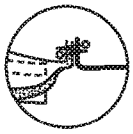
FIG. 39B shows a first alternate compression shirt fastening for the spinal support device of FIG. 38, in accordance with some embodiments.
Figure 39C:
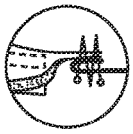
FIG. 39C shows a second alternate compression shirt fastening for the spinal support device of FIG. 38, in accordance with some embodiments.
Figure 39A:
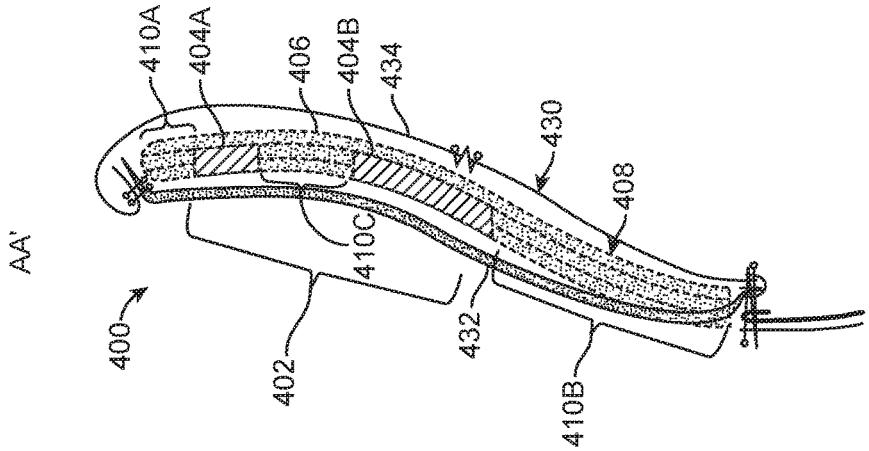
FIG. 39A is a cross-sectional view taken along the line A-A' in FIG. 38, in accordance with some embodiments.

Referring now specifically to FIGS. 38 and 39A-C, in the fourth exemplary spinal support device 400 the force-directing frame 402 and the rate-sensitive material 406 are encapsulated within an envelope 430 formed by a molded foam overlay 432 and a dorsal liner 434 formed from a suitable textile material (e.g. a resilient textile such as that marketed under the brand name Lycra®) and which may be secured to the overlay 432 by stitching or other suitable technique. The use of the overlay 432 allows the dorsal liner 434 to better conform to the shape of the collar member 408 without the textile material "tenting"; in other embodiments the foam overlay may be omitted and the collar member 408 may be molded directly onto a textile layer. While the overlay 432 may provide some additional structure and/or impact protection depending on the material, the primary functionality of the spinal support device 400 is provided by the cooperation of the force-directing frame 402 and the rate-sensitive material 406. The fourth exemplary spinal support device 400 may be secured to the compression shirt 420 by binding, as shown in FIG. 39A, by overlock as shown in FIG. 39B, by cover stitch as shown in FIG. 39C, or by any other suitable technique.

Reference is now made to FIGS. 42 through 48B. As best seen in FIGS. 42 through 45, in preferred embodiments the fourth exemplary spinal support device 400 further comprises a ventral liner 440 extending across the opening of the collar member 408 and secured to the compression shirt 420. In the illustrated embodiment, the fourth exemplary spinal support device 400 is adapted for use in ice hockey and the ventral liner 440 is a cut-resistant liner. More particularly, in the illustrated embodiment the ventral liner 440 comprises an inner layer 442 of resilient textile (e.g. Lycra®) secured to the dorsal liner 434 and an outer layer 444 of resilient textile secured to the overlay 432, and a layer of cut-resistant fabric 446 conforming to applicable regulations is disposed between the inner layer 442 and the outer layer 444 and secured to the overlay 432. The inner layer 442 and outer layer 444 may each be a separate piece as shown in FIG. 46A, or may be formed from a single piece folded over the cut-resistant fabric 446 as shown in FIG. 46B.

Figure 48A:
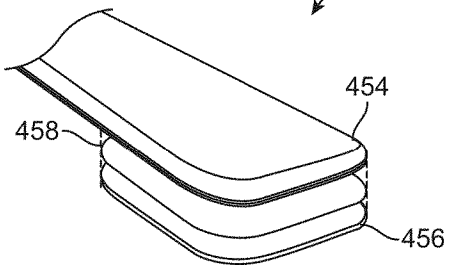
FIG. 48A is an exploded view showing construction of an exemplary adjustment strap of the spinal support device of FIG. 38, in accordance with some embodiments.
Figure 48B:
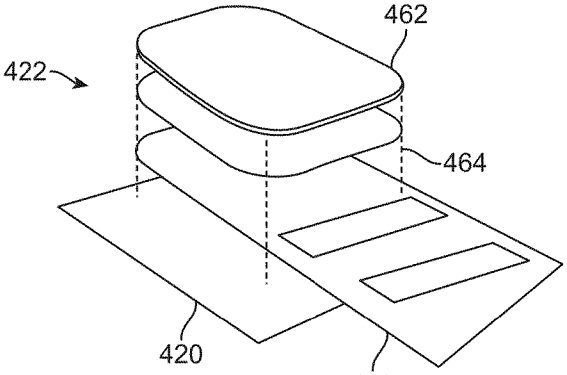
FIG. 48B is an exploded view showing construction of an exemplary harness of the spinal support device of FIG. 38, in accordance with some embodiments.
Figure 47:
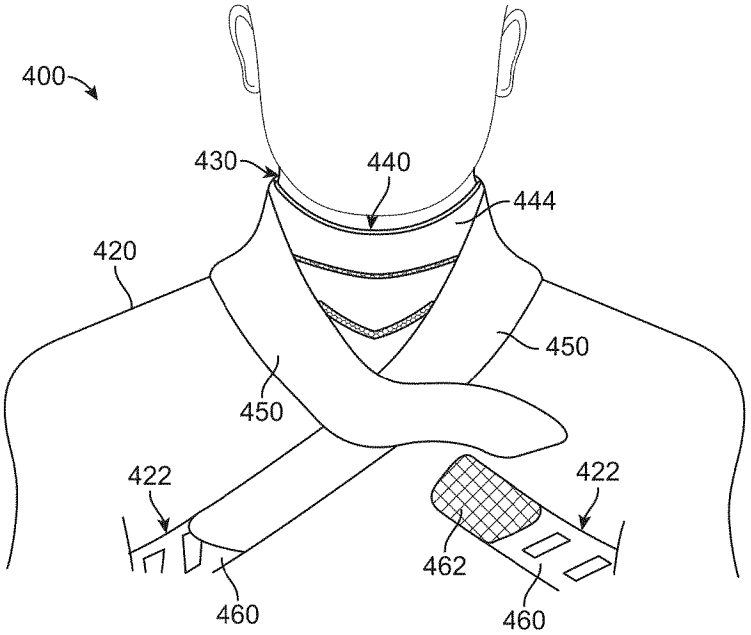
FIG. 47 is a front elevation view of a portion of the spinal support device of FIG. 38 showing fastening thereof, in accordance with some embodiments.

As noted above, the fourth exemplary spinal support device 400 is secured by way of a fastener comprising a compression shirt 420 with an integrated harness 422. As best seen in FIGS. 42 to 45 and 47 to 48B, the fastener further comprises opposed adjustment straps 450 that are secured to the overlay 432 as well as to the cut-resistant fabric 446. As shown in FIG. 47, the adjustment straps 450 cross over the subject's chest and the ends of the adjustment straps 450 may be adjustably affixed to the integrated harness 422 on the compression shirt 420 by way of mating hook-and-loop fastener material 452 such as that marketed under the brand name Velcro®. FIGS. 48A and 48B show exemplary constructions for the adjustment straps 450 and for the compression shirt 420 and integrated harness 422, respectively. As shown in FIG. 48A, in the exemplary embodiment each adjustment strap 450 comprises a laminate 454 formed from three layers of resilient textile (e.g. Lycra®) bonded together by TPU layers interposed between the textile layers, with a hook or loop fabric patch 456 bonded to the end of the adjustment strap 450 by a correspondingly sized layer 458 of TPU film. As shown in FIG. 48B, the harness 422 comprises a TPU overlay 460 bonded to the fabric of the compression shirt 420 and a hook or loop fabric patch 462 (mated to the hook or loop fabric patch 456 on the adjustment strap 450) bonded to the TPU overlay 460 by a correspondingly sized layer 464 of TPU film. In some instances, the adjustment straps 450 allow the spinal support device to be snugly fitted onto the neck and/or torso of the subject. In some instances, the snug fit of the spinal support device provides support to the head, neck, and/or spine without requiring the spinal support device to be coupled to a helmet.

Figure 49:
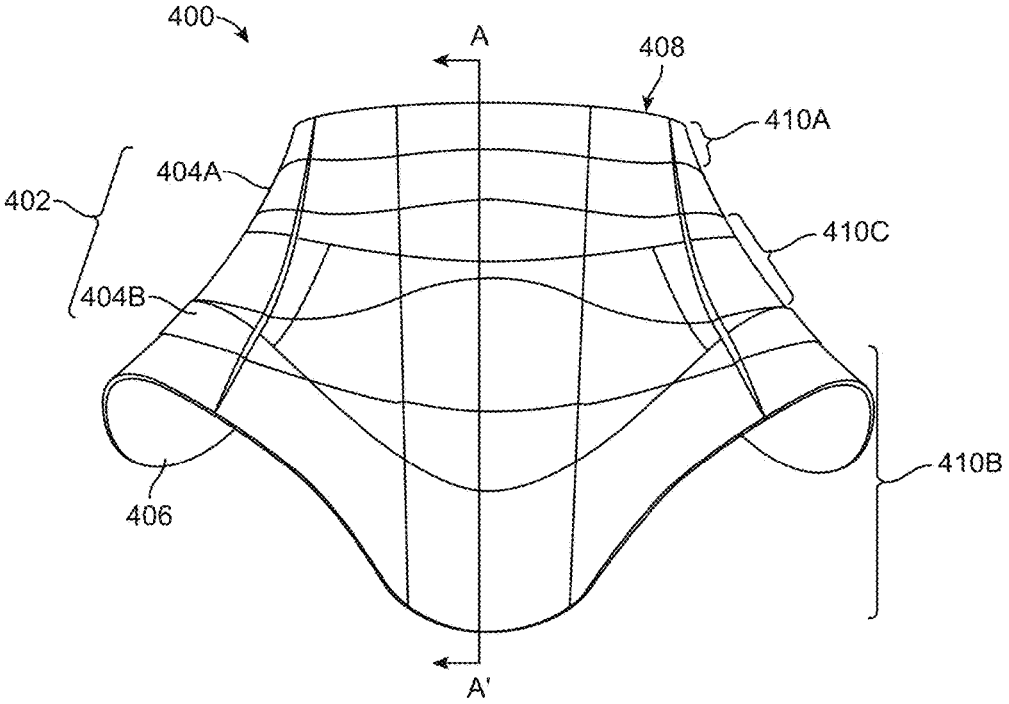
FIG. 49, FIG. 50A, and FIG. 50B show two exemplary methods for forming frame elements and a collar member of the spinal support device of FIG. 38 and coupling them together.
Figure 50A:
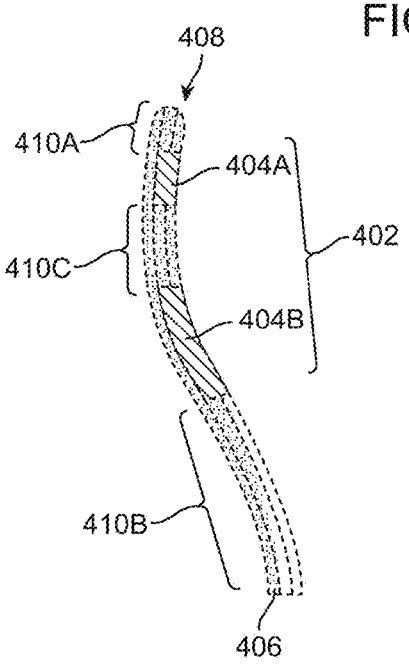
Figure 50B:
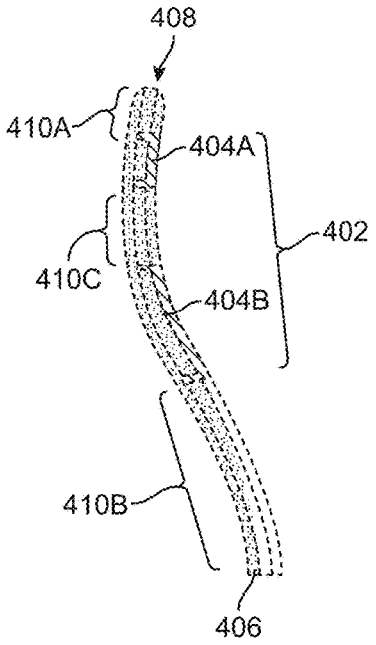
Figure 51:
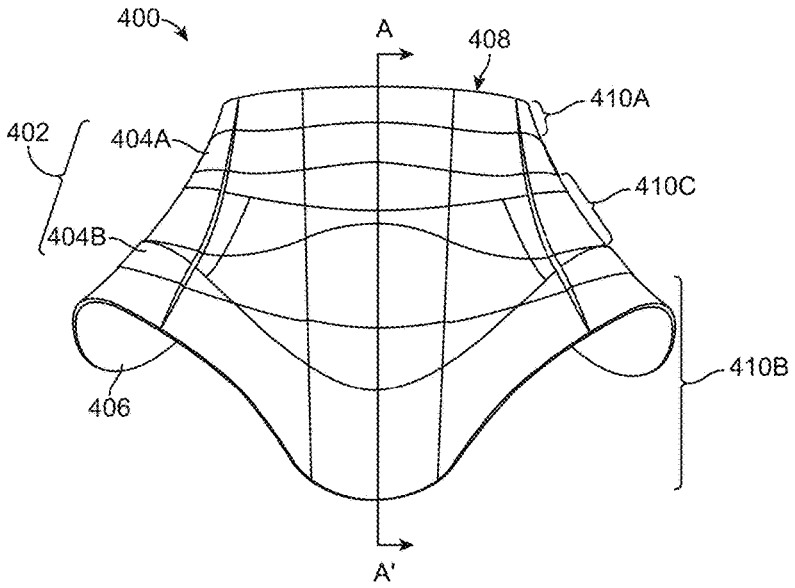
FIG. 51, FIG. 52A, and FIG. 52B show another two exemplary methods for forming frame elements and a collar member of the spinal support device of FIG. 38 and coupling them together.
Figure 52A:
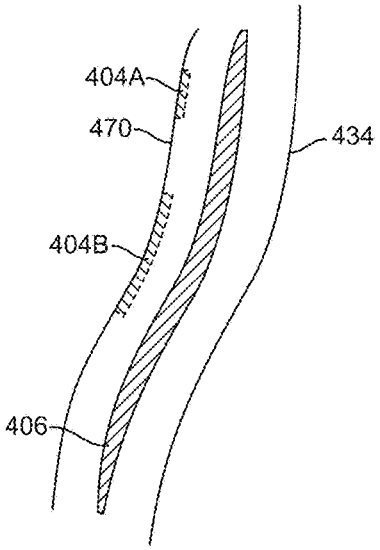
Figure 52B:
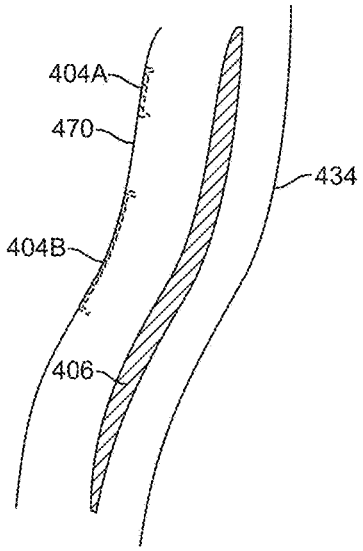
Figure 53:
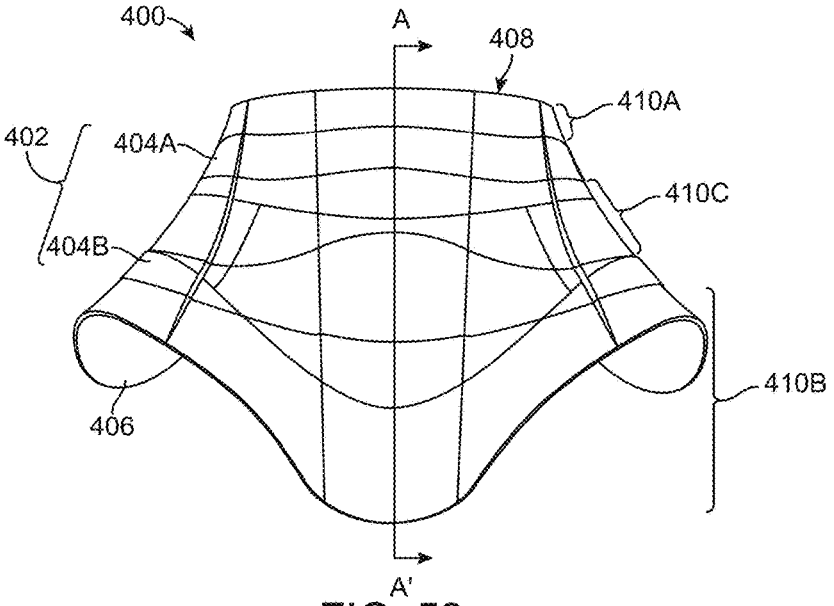
FIG. 53, FIG. 54A, and FIG. 54B show another two exemplary methods for forming frame elements and a collar member of the spinal support device of FIG. 38 and coupling them together.

Reference is now made to FIGS. 49 through 54B, which show two exemplary methods for forming the frame elements 404A, 404B and the collar member 408 of rate-sensitive material 406 and coupling them together. In each case, the frame elements 404A, 404B are overmoulded to an exterior layer 470 comprising a resilient textile (e.g. Lycra®) with a TPU film; the exterior layer will replace the overlay 432. The exterior layer 470 with overmoulded frame elements 404A and 404B is and then placed in a mould, and the dorsal liner 434, also comprising a resilient textile (e.g. Lycra®) with a TPU film, is also placed into the mould. The rate-sensitive material 406 is then added to the mould and formed into the collar member 408. FIGS. 49, 51, and 53 are included by way of reference to show the locations of the cross-sectional views in FIGS. 50A, 50B, 52A, 52B, 53A, and 53B.

Figure 54A:
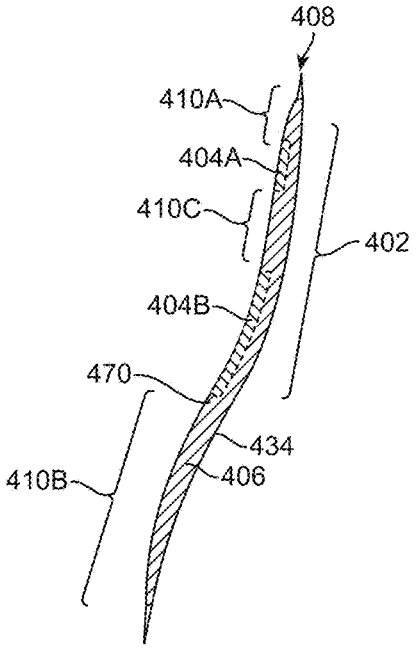
Figure 54B:
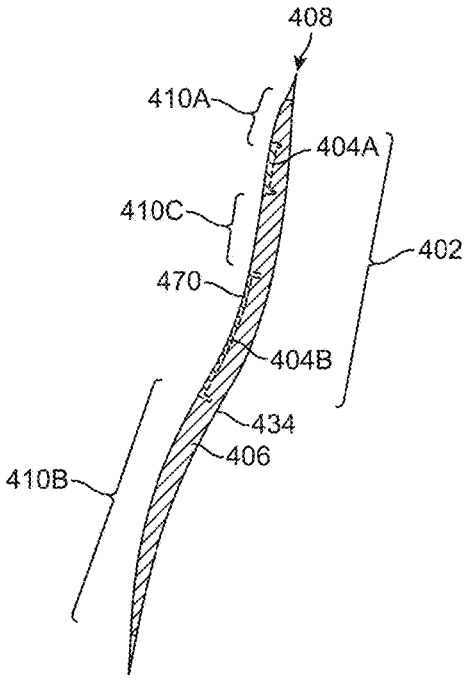

FIGS. 50A, 52A and 54A show a first arrangement in which the frame elements 404A, 404B are formed from a high density polyurethane foam and generally solid in cross-section along their length; FIGS. 50B, 52B and 54B show a second arrangement in which the frame elements 404A, 404B are formed from TPU having a generally channel-iron cross-section across their length.

Figure 56:
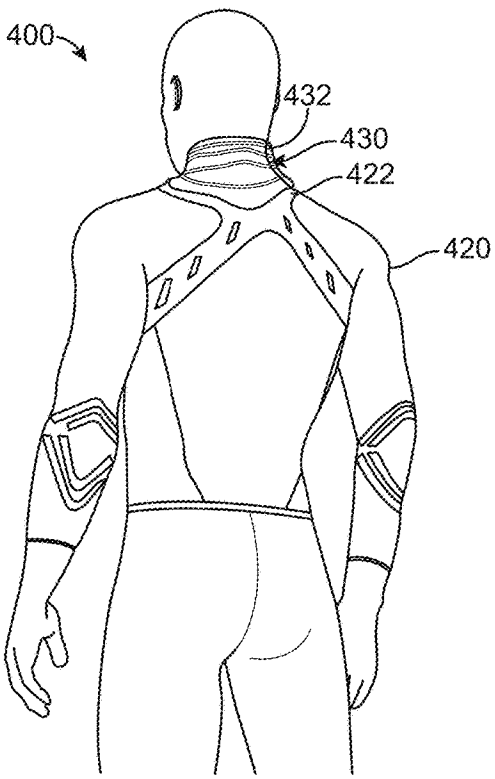
FIG. 55, FIG. 56, and FIG. 57 show an alternate structure for a compression shirt, integrated harness and adjustment straps of the spinal support device of FIG. 38, in accordance with some embodiments.
Figure 55:
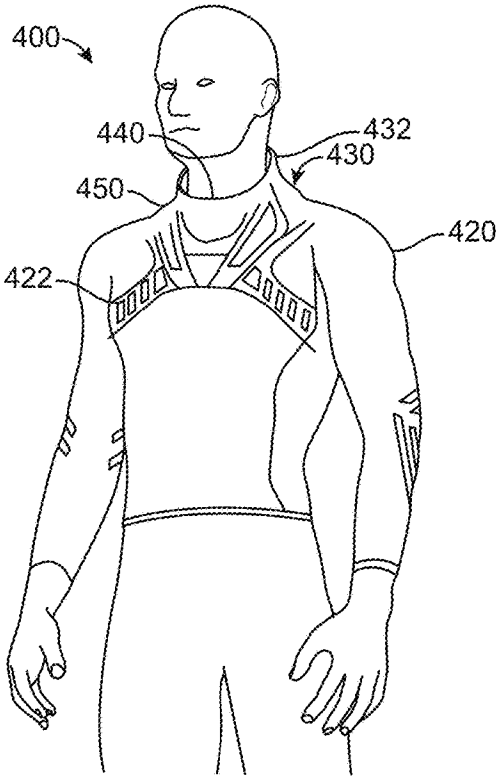
Figure 57:
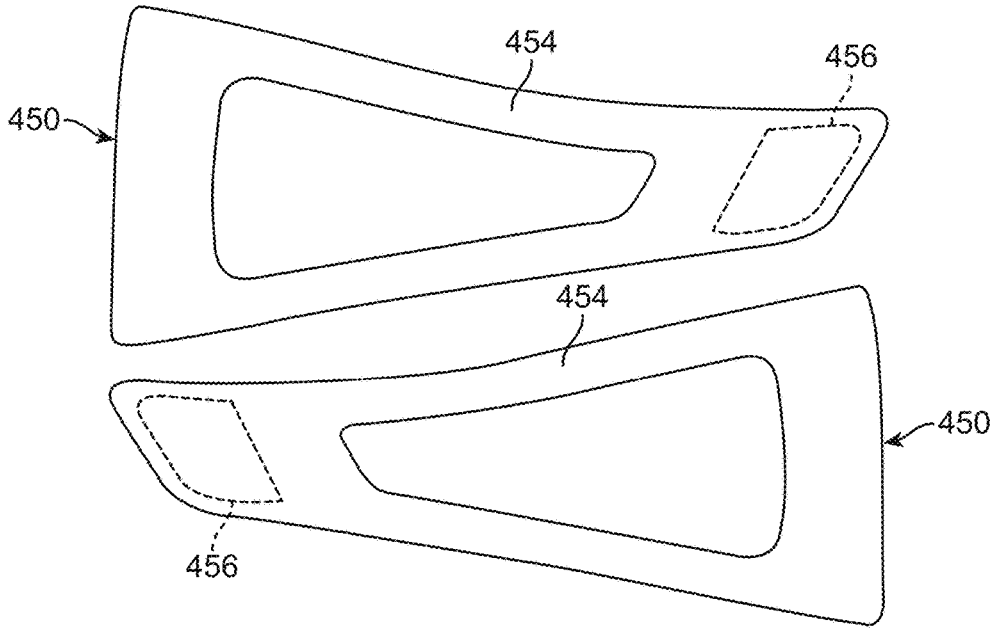

FIGS. 55 to 57 show an alternate structure for the compression shirt 420, integrated harness 422, and adjustment straps 450.

Figure 38:
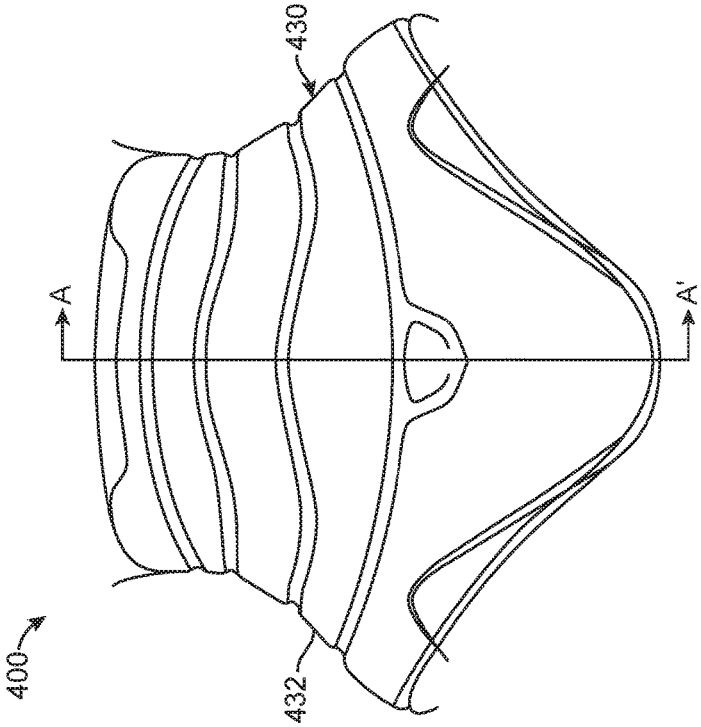
FIG. 38 is a rear elevation view of a portion of a fourth exemplary spinal support device, in accordance with some embodiments.
Figure 58:
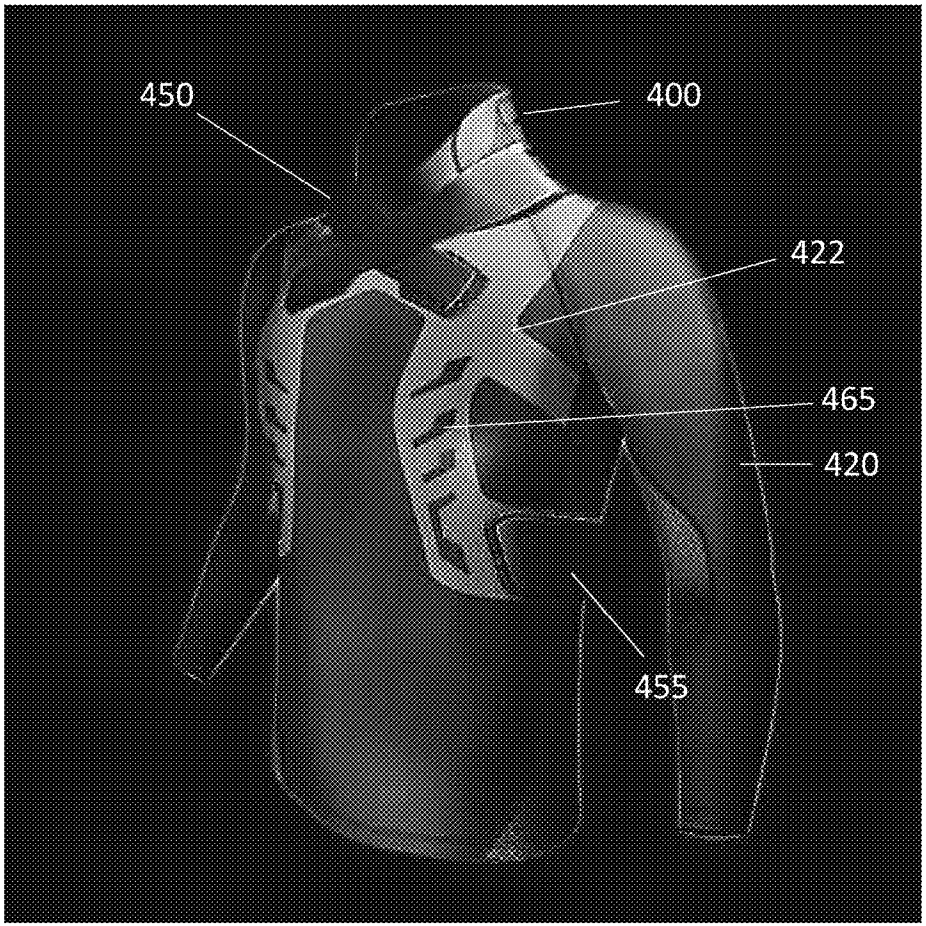
FIG. 58 shows a front perspective view of an alternate structure for a compression shirt, integrated harness, and adjustment straps of the spinal support device of FIG. 38, in accordance with some embodiments.
Figure 59:
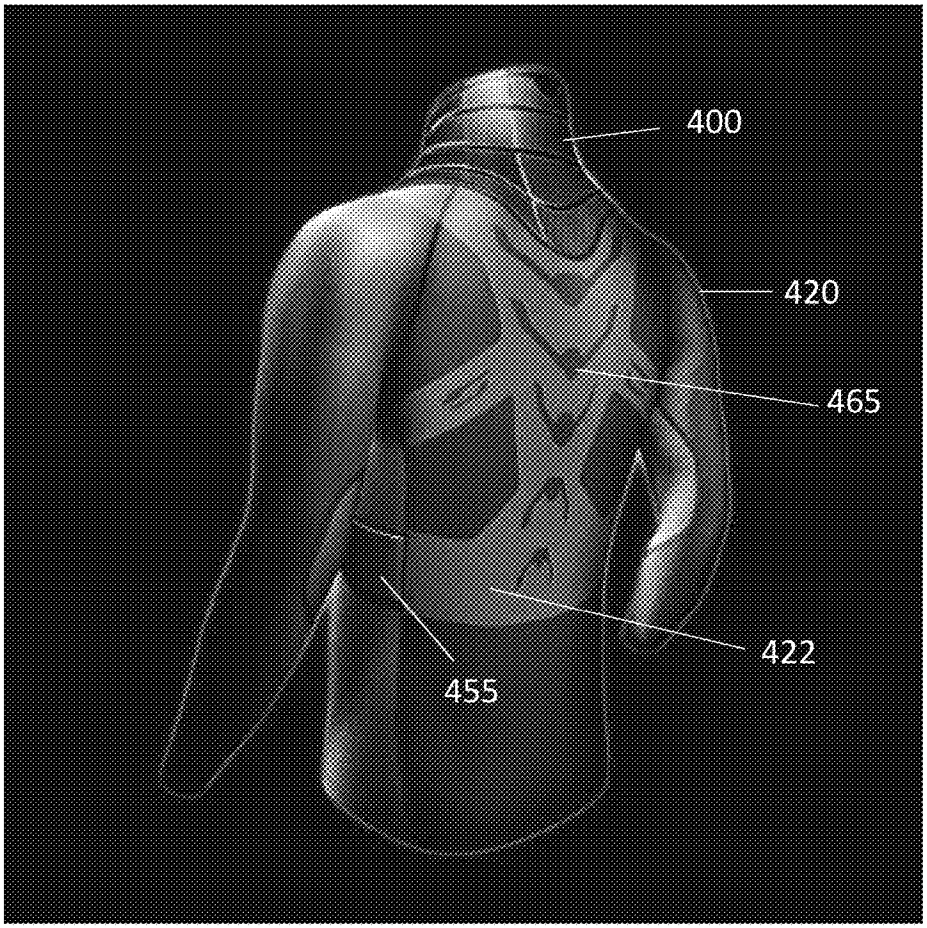
FIG. 59 shows a rear perspective view of an alternate structure for a compression shirt, integrated harness, and adjustment straps of the spinal support device of FIG. 38, in accordance with some embodiments.
Figure 60:
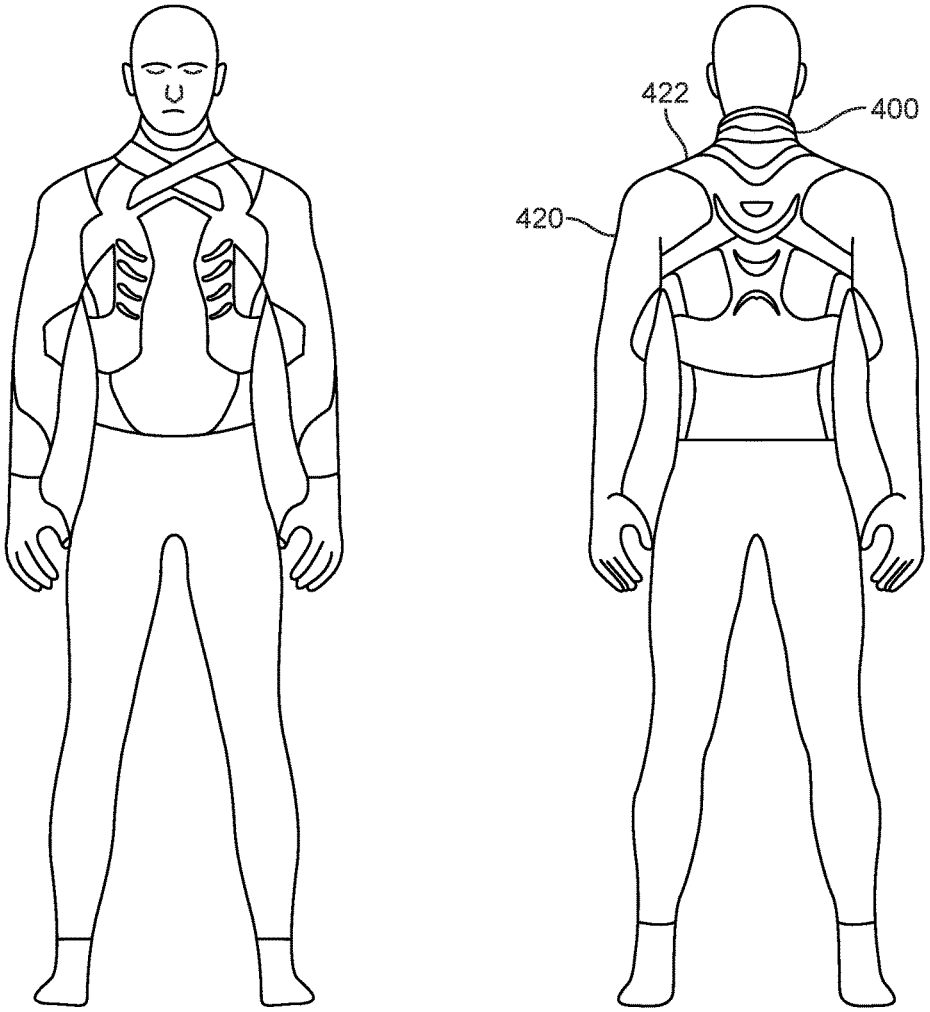
FIG. 60 shows front and rear views of an alternate structure for a compression shirt, integrated harness, and adjustment straps of the spinal support device of FIG. 38, optionally integrated with compression pants or leggings in accordance with some embodiments.

FIGS. 58 to 60 show other alternate structures for the compression shirt 420, integrated harness 422, and adjustment straps 450 of the spinal support device 400 of FIG. 38. In some instances, the spinal support device 400 comprises a cervical or neck support device, adjustment straps 450, and an integrated harness 422. In some instances, the spinal support device 400 is or comprises a cervical or neck support device and does not include adjustment straps 450 and/or an integrated harness 422. FIG. 58 provides a front perspective view of the spinal support device 400 with compression shirt 420, integrated harness 422, and adjustment straps 450. FIG. 59 provides a rear perspective view of the spinal support device 400 with compression shirt 420, integrated harness 422, and adjustment straps 450. FIG. 60 provides front and rear views of the spinal support device 400 with compression shirt 420, integrated harness 422, and adjustment straps 450. The spinal support device shown in FIGS. 58 to 60 may be a variation on the spinal support device of FIG. 38. In some cases, the spinal support device comprises a cervical spinal support portion such as a collar as shown, for example, in FIGS. 58 to 60. In some instances, the spinal support device comprises a spinal support portion capable of supporting one or more regions of the non-cervical spine to complement the cervical spinal support portion. The regions of the spine include cervical, thoracic, lumbar, and sacral regions. The spinal support portion may comprise an upper spinal support portion and a lower spinal support portion. In some instances, the spinal support portion extends along the back or spine of a subject. In some instances, the spinal support portion extends along at least a portion, most or the full length of the back or spine of a subject. The spinal support portion may extend along at least 5%, 10%, 20%, 30%, 40%, 50%, 60%, 70%, 80%, 90%, 95%, or 99% a full length of the back of spine of the subject. In some instances, the spinal support portion extends along a partial length of the back or spine of a subject. In some instances, while the cervical spinal support portion protects at least the cervical region of the spine, the spinal support portion protects one or more of the thoracic, lumbar, and sacral regions of the spine. For example, in some instances, the spinal support portion protects the thoracic region of the spine. In some instances, the spinal support portion protects the thoracic and lumbar regions of the spine. In some instances, the spinal support portion protects the thoracic, lumbar, and sacral regions of the spine. In some instances, the spinal support portion provides partial spinal support such as, for example, upper spinal support or upper and middle spinal support. In some instances, the spinal support portion provides full spinal support. For example, the harness 422 may comprise the spinal support portion extending along the back of the subject wearing the harness. The spinal support portion may be positioned inferior to the cervical support portion. In some instances, the spinal support portion is coupled, attached, and/or integrated with the cervical support portion of the spinal support device. Alternatively, the spinal support portion is separate from the cervical support portion, and may instead be coupled, attached, and/or integrated with the harness itself. In some instances, the spinal support portion is separate from both the cervical support portion and the harness, and instead comprises its own fastener for being fit or worn by a subject. In some instances, the spinal support device does not comprise a spinal support portion. For example, the spinal support device 400 shown in FIGS. 58 to 60 comprises a cervical support portion, a harness, and adjustment straps.

In some instances, the harness design shown in the drawings loops across the chest, under the arms, across the sides, and between the shoulder blades so as to encircle the torso to provide snug anchoring to the torso. The harness 422 may include loops across the chest, under the arms and between the shoulder blades so as to encircle the torso. The harness 422 may include a loop across the middle and/or lower back, as shown in FIG. 59, which is often integrated or coupled to a spinal support portion vertically positioned along the spine. In some instances, the harness is detachable from the collar and/or compression shirt. In some instances, the harness is not detachable from the collar and/or compression shirt. In some instances, the harness comprises an elastomeric overlay. In some instances, the harness comprises a thermoplastic polyurethane (TPU) overlay.

In some instances, TPU comprises polyester TPU, polyether TPU, polycaprolactone TPU, or any combination thereof. In some instances, TPU comprises aromatic TPU, aliphatic TPU, or any combination thereof. TPU is a block copolymer composed of hard blocks (e.g., composed of a chain extender and isocyanate) and soft blocks (e.g., composed of polyol and isocyanate). Adjustment of the relative ratios of hard blocks and soft blocks allows for the generation of TPU with varying physical properties. In some instances, the harness is attached, coupled, adhered, or integrated to the compression shirt (or other article of clothing such as a shirt, jacket, or sweater) by lamination. In some instances, the harness is laminated onto the compression shirt. In some instances, the harness is laminated onto one or more layers of a material (e.g., Lycra) that is laminated onto the shirt. In some instances, the harness comprises one or more openings (e.g., gaps in the harness material) 465 for providing flexion and/or mobility. For example, in some instances, the harness comprises TPU configured to resist stretching. The harness can comprise one or more openings 465 at the rear to allow forward flexion and/or full range of motion. In some instances, the harness comprises one or more openings 465 at the front to allow backward flexion and/or full range of motion.

FIGS. 58 to 60 also show the integrated harness 422 having at least one side adjustment strap 455 integrated or coupled to the compression shirt 420. In some instances, the at least one side adjustment strap 455 is secured to the overlay 432 as well as to the cut-resistant fabric 446. As shown in FIG. 58, a side adjustment strap 455 crosses over the subject's side or oblique, and the ends of the side adjustment strap may be adjustably affixed to the integrated harness 422 on the compression shirt 420 by way of mating hook-and-loop fastener material 452 such as that marketed under the brand name Velcro®. FIG. 60 shows exemplary constructions for two side adjustment straps and for the compression shirt 420 and integrated harness 422, respectively. In some instances, the side adjustment strap 455 is attached to the harness as shown in FIG. 59. Accordingly, the side adjustment strap 455 is able to secure the entire spinal support system (e.g., spinal support device, harness, and compression shirt) to the subject, and keep the spinal support device such as the collar in FIG. 58 in place, effectively balancing the front and rear tension of the harness around the subject. For example, the straps allow the subject to properly secure the device to the appropriate areas, with the comfort of subject-defined tension. In some instances, the side adjustment strap 455 is sewn onto the harness and/or compression shirt. In some instances, the side adjustment strap is attached along the dorsal (rear) side of the harness towards one end, and attaches to the ventral (front) side of the harness towards the other end using Velcro®. In some instances, the side adjustment strap is attached without using Velcro®, such as for example, a buckle.

In some embodiments, the spinal support device does not require certain structural elements to provide support and/or stability. For example, in some instances, the spinal support device does not comprise an exoskeleton and/or wearable articles. In some instances, the spinal support device does not comprise a hinge point. In some instances, the spinal support device does not attach to a helmet. In some instances, the spinal support device does not comprise or attach to a compression shirt. In some instances, the spinal support device does not comprise or attach to a harness. In some instances, the spinal support device is coupled to a harness that is not integrated into a shirt or other article of clothing. In some instances, the harness is worn over a shirt or other article of clothing (e.g., compression shirt). In some instances, the spinal support device does not comprise adjustment straps.

Figure 61A:
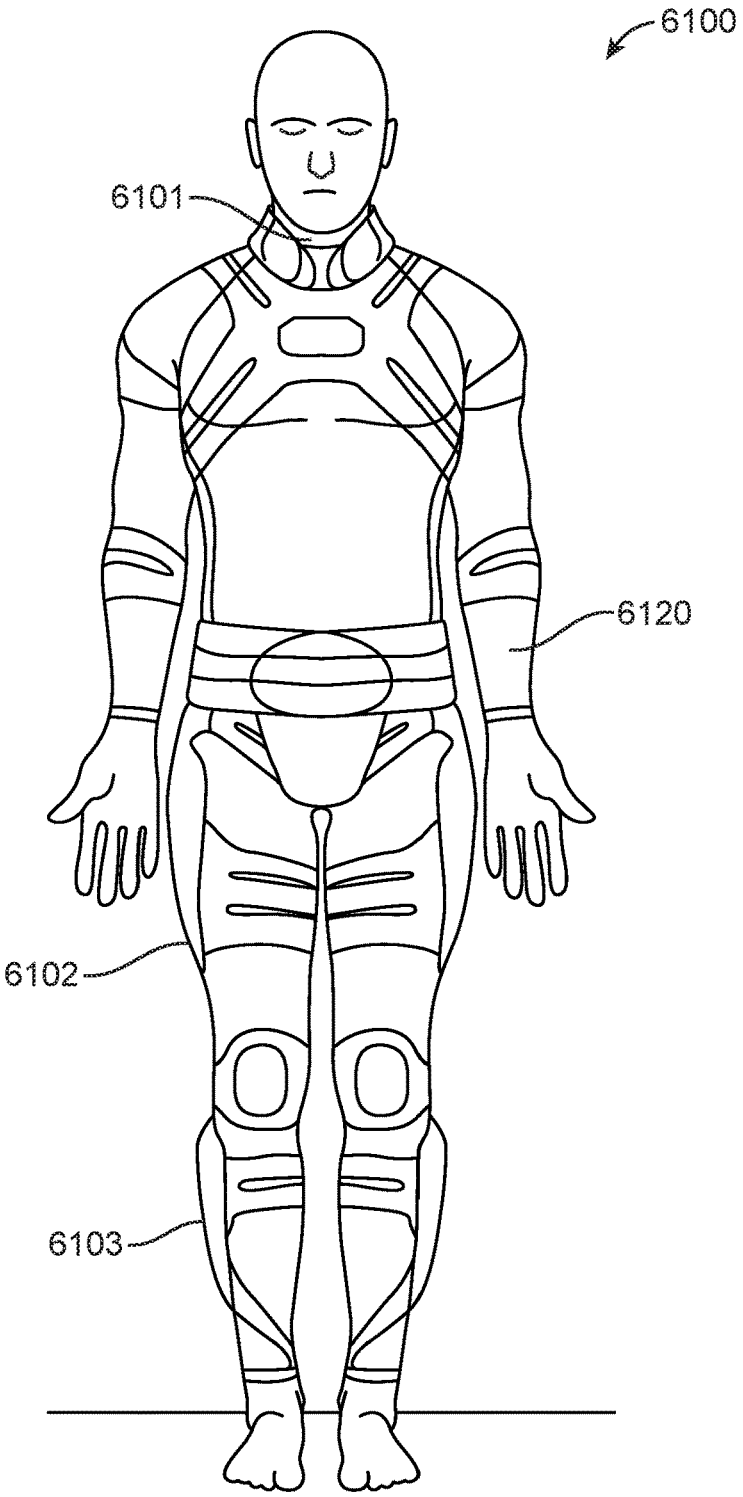
FIG. 61A shows a front view of an exemplary article, in accordance with some embodiments.

Provided herein per FIGS. 61A-62C is an exemplary first compression article. FIG. 61A shows a front view of an exemplary first compression article, in accordance with some embodiments. FIG. 61B shows a back view of the exemplary first compression article of FIG. 61A. FIG. 61C shows a side view of the exemplary first compression article of FIG. 61A. FIG. 61D shows a detailed front view of the exemplary first compression article of FIG. 61A. FIG. 61E shows a detailed back view of the exemplary first compression article of FIG. 61A. FIG. 61F shows a detailed side view of the exemplary first compression article of FIG. 61A.

Shown in FIGS. 61A-62C is an exemplary first compression article 6100 comprising a base layer 6120, a compression element, and a support element. As shown the support element comprises a neck support 6101, a thigh support 6102, a shin support 6103, and a spine support 6104. As shown the compression element comprises a chest compression 6105, a shoulder compression 6106, an elbow compression 6107, a thigh compression 6108, a knee compression 6109, a shin compression 6110, an ankle compression 6111, and a waist compression 6112. In some embodiments, the compression article 6100 further comprises a gripping element (not shown) on an interior surface of a base layer of the article.

As seen, the exemplary first compression article 6100 comprises one neck support 6101, two thigh supports 6102, two shin supports 6103, one spine support 6104, one chest compression 6105, two shoulder compressions 6106, two elbow compressions 6107, two thigh compressions 6108, two knee compressions 6109, two shin compressions 6110, two ankle compressions 6111, one waist compression 6112 and one base layer 6120. As used herein, support and support element have equivalent meaning and are used interchangeably. An article comprising any combination of the aforementioned support elements is contemplated herein. Alternatively, in some embodiments, the exemplary first compression article 6100 comprises 1, 2, 3, 4, 5, 6, 7 8, 9, or 10 or more of each of the neck support 6101, the thigh support 6102, the shin support 6103, the spine support 6104, the chest compression 6105, the shoulder compression 6106, the elbow compression 6107, the thigh compression 6108, the knee compression 6109, the shin compression 6110, the ankle compression 6111, the waist compression 6112, the gripping element, or any combination thereof.

In some embodiments, at least one of a support element and a compression element are permanently or removably attached to the base layer 6120. In some embodiments, at least one of the support element, the compression element, and the gripping element is laminated or printed adjacent to the base layer. In some embodiments, at least one of the support element, the compression element, and the gripping element is removably attached to the base layer 6120. In some embodiments, at least one of the support element, the compression element, and the gripping element is removably attached to the interior surface of the base layer 6120. In some embodiments, at least one of the support element and the compression element is attached to the exterior surface of the base layer 6120. In some embodiments, at least one of the support element, the compression element, and the gripping element is removably attached to the base layer 6120 by a fastener, optionally wherein the fastener comprises a strap a buckle, a hook and loop fastener, a zipper, a button, a hook, an eye, a lace, a magnet, a clasp, a clip, a screw, a bolt, a nut, a tie, or any combination thereof.

In some embodiments, at least one a support element and a compression element, the base layer 6120, and the gripping element are formed of fabric, thread, wood, fiberglass, carbon fiber, metal, a polymer, a gel, a foam, a composite, or any combination thereof. In some embodiments, the polymer comprises thermoplastic polyurethane, silicone, polyester, spandex, or any combination thereof. In some embodiments, at least two of a support element and a compression element, the base layer 6120, and the gripping element are formed of the same material. In some embodiments, at least two of a support element and a compression element, the base layer 6120, and the gripping element are formed of different materials.

In some embodiments, the at least one of the compression element comprises a polymeric material or composite material. In some embodiments, at least one of the compression elements comprises silicone, nylon, Lycra, rubber, neoprene, vinyl, polyurethane, or any combination thereof. In some embodiments, the at least one support element comprises an elastomeric polymer. In some embodiments, the at least one support element comprises a gel, a foam, a non-Newtonian fluid, or any combination thereof. In some embodiments, the foam comprises a non-Newtonian fluid. In some embodiments, the foam comprises a shear thickening non-Newtonian fluid. In some embodiments, the non-Newtonian foam is encapsulated within a pouch. In some embodiments, the non-Newtonian fluid is encapsulated in a pouch. In some embodiments, the non-Newtonian fluid comprises a shear thickening non-Newtonian fluid. In some embodiments, the at least one support element comprises a non-Newtonian foam and a non-Newtonian fluid. In some embodiments, the at least one support element comprises a Newtonian foam material positioned between the body surface of the subject and the non-Newtonian material.

A non-Newtonian material, or a rate-sensitive material, does not follow Newton's law of viscosity, and has a viscosity that is proportional to its instant or previous shear rate. A non-Newtonian material is generally classified as a shear-thinning or a shear-thickening non-Newtonian material, whereby the viscosity of shear-thinning and shear-thickening non-Newtonian materials decreases and increases under shear, respectively. The magnitude by which the viscosity of a fluid is altered by shear stress is referred to as a power rule number, wherein shear thickening non-Newtonian materials exhibit a power rule number of greater than 1, and wherein shear thinning non-Newtonian materials exhibit a power rule number of less than 1. Further, non-Newtonian materials can be classified as a non-Newtonian fluid or a non-Newtonian solid, which exist as a fluid or solid, respectively, under zero shear stress. In some embodiments, solid non-Newtonian materials can be easily incorporated into a wearable article.

In some embodiments, a force-reactive or rate-sensitive material comprises a foam material and a dilatant (e.g. non-Newtonian fluid). In some embodiments, the force-reactive material comprises a foam matrix. In some embodiments, the foam matrix is made up of a soft, elastomeric polymer. Examples of elastomeric polymers include polyurethane, polybutadiene, chloroprene, polychloroprene, neoprene, isobutylene and isoprene copolymer, styrene-butadiene copolymer, butadiene-acrylonitrile copolymer, ethylene-propylene copolymer, polyacrylic rubber, epichlorohydrin, fluoroelastomer, perfluoroelastomer, polyether block amides, ethylene-vinyl acetate, polysulfide rubber, and elastolefin. In some embodiments, the foam matrix comprises a solid foamed polymer. In some embodiments, the foam matrix comprises a synthetic polymer. In some embodiments, a dilatant is dispersed within the foam matrix. In some embodiments, the dilatant is present in the foam matrix at a percentage by volume (v/v) of at least about 5%, about 10%, about 15%, about 20%, about 25%, about 30%, about 35%, about 40%, about 45%, about 50%, about 55%, about 60%, about 65%, about 70%, about 75%, or about 80%. In some embodiments, the polyborodimethylsiloxane is present in the foam matrix at a percentage by volume (v/v) of at most about 5%, about 10%, about 15%, about 20%, about 25%, about 30%, about 35%, about 40%, about 45%, about 50%, about 55%, about 60%, about 65%, about 70%, about 75%, or about 80%.

An exemplary force-reactive or rate-sensitive material comprising a non-Newtonian fluid is a polyurethane foam comprising polyborodimethylsiloxane. In some embodiments, the force-reactive material comprises a foam material such as polyurethane foam and a dilatant. In some embodiments, the dilatant is a polymer-based material such as polyborodimethylsiloxane. In some embodiments, the polyborodimethylsiloxane is present in the foam matrix at a percentage by volume (v/v) of at least about 5%, about 10%, about 15%, about 20%, about 25%, about 30%, about 35%, about 40%, about 45%, about 50%, about 55%, or about 60%. In some embodiments, the polyborodimethylsiloxane is present in the foam matrix at a percentage by volume (v/v) of at most about 5%, about 10%, about 15%, about 20%, about 25%, about 30%, about 35%, about 40%, about 45%, about 50%, about 55%, or about 60%.

In some embodiments, the dilatant comprises colloidal silica particles suspended in polyethylene glycol. In some embodiments, the silica particles are suspended at a percentage by volume (v/v) of at least about 40%, about 45%, about 50%, about 55%, about 60%, about 65%, about 70%, about 75%, or about 80%. In some embodiments, the silica particles are suspended at a percentage by volume (v/v) of at most about 40%, about 45%, about 50%, about 55%, about 60%, about 65%, about 70%, about 75%, or about 80%.

Preferably, the rate-sensitive materials are solid materials (the term "solid" including foam), although the use of non-solid rate-sensitive materials is also contemplated. For example, a liquid rate-sensitive material may be encapsulated within an envelope that is impermeable to that liquid and used in wearable articles according to the present disclosure. In some embodiments, the solid rate-sensitive material comprises a foam matrix with a dispersed dilatant.

In some embodiments, at least one of the support element, the compression element, the gripping element, and the base layer 6120 comprises two or more layers. In some embodiments, at least one of the support element, the compression element, the gripping element, and the base layer 6120 is durable, waterproof, stain-proof, hypoallergenic, antibacterial, self-healing, heat resistant, friction resistant, or any combination thereof. In some embodiments, at least one of the support element, the compression element, the gripping element, and the base layer 6120 is formed of a polymeric material or composite material.

In some embodiments, the at least one support element is configured to provide stress relief, load transfer, fatigue relief, or any combination thereof to the wearer. In some embodiments, the at least one support element is configured to provide resistance to movement of at least one of a muscle, a joint, or a bone of a wearer, wherein the resistance increases with increasing force of the movement. In some embodiments, the at least one support element is configured to exert the force on at least one of the muscle, the joint, or the bone of a wearer throughout the wearer's full or partial range of motion in one or more degrees of freedom. In some embodiments, the force comprises a continuous force, a proportional force, a derivative force, or any combination thereof. In some embodiments, at least one of the proportional force and the derivative force is based on a linear position, an angular position, a velocity, or an acceleration of the bone, the muscle, or the joint of the wearer. In some embodiments, the muscle comprises a bicep, a triceps, a deltoid, a forearm, a thigh, a calf, a trapezius, a glute, a neck, a chest, an oblique, an upper back, a lower back, or an abdominal muscle. In some embodiments, the joint comprises an ankle, a knee, a hip, a spine, a wrist, an elbow, or a shoulder joint. In some embodiments, the bone comprises an ankle, a knee, a hip, a spine, a wrist, an elbow, a shoulder, a tibia, a fibula, an arm, a neck, or a rib bone. In some embodiments, the neck support comprises a penannular collar member that is anatomically complementary with a neck of the wearer. In some embodiments, the neck support comprises an elastomeric material or a force-reactive polymer positioned around a rear and lateral sides of a neck of the wearer. In some embodiments, at least one of the neck support, the spine support, the thigh support, and the shin support comprises a furrow. In some embodiments, at least one of the neck support, the spine support, the thigh support, and the shin support comprises a plurality of furrows comprising 2, 3, 4, 5, 6, 7, 8, 9, or 10 or more furrows. In some embodiments, two or more of the plurality of furrows have equivalent sizes or shapes. In some embodiments, two or more of the plurality of furrows have non-equivalent sizes or shapes. In some embodiments, the furrow is configured to flex or fold along a set line, arch, or plane. In some embodiments, the furrow is configured to prevent or inhibit motion of the wearer in one or more degrees of freedom. In some embodiments, the at least one compression element is configured to provide stress support, load transfer, fatigue relief, or any combination thereof to the wearer. In some embodiments, the at least one compression element is configured to exert a force on a muscle a bone, or a joint of a wearer. In some embodiments, the at least one compression element is configured to exert a force on muscle, bone, or joint of a wearer throughout a full or partial range of motion of the muscle, bone, or joint. In some embodiments, the force comprises a continuous force, a proportional force, a derivative force, or any combination thereof. In some embodiments, at least one of the proportional force and the derivative force are based on a linear position, an angular position, a velocity, or an acceleration of the bone, the muscle, or the joint of the wearer. In some embodiments, the muscle comprises a bicep, a triceps, a deltoid, a forearm, a thigh, a calf, a trapezius, a glute, a neck, a chest, or abdominal muscle. In some embodiments, the joint comprises an ankle, a knee, a hip, a spine, a wrist, an elbow, or a shoulder joint. In some embodiments, the bone comprises an ankle, a knee, a hip, a spine, a wrist, an elbow, a shoulder, a tibia, a fibula, an arm, a neck, or a rib bone. In some embodiments, the article further comprises a harness secured to at least one support element. In some embodiments, the harness is integrated into the base layer. In some embodiments, the harness is laminated or printed adjacent to the base layer. In some embodiments, the article further comprises at least one adjustable tension element. In some embodiments, the at least one adjustable tension element comprises at least one of a chest tension element, an abdominal tension element, a waist tension element, a thigh tension element, or a shin tension element. In some embodiments, the at least one adjustable tension element comprises a strap, a fastener, a buckle, a hook and loop fastener, a zipper, a button, a hook, an eye, a lace, a magnet, a clasp, a clip, a screw, a bolt, a nut, a tie, or any combination thereof. In some embodiments, the article is a shirt, a pair of pants, or a full body suit. In some embodiments, the base layer has bilateral symmetry.

Shown in FIGS. 61A-62E is an exemplary first compression article 6100 comprising a base layer 6120 having an interior surface and an exterior surface. In some embodiments, the interior surface has a first coefficient of friction ($\mu$1) relative to a body surface of the subject. In some embodiments, the base layer 6120 has a first modulus of elasticity (E1). In some embodiments, the at least one compression element has a second modulus of elasticity (E2) that is greater than E1.

Figure 61B:
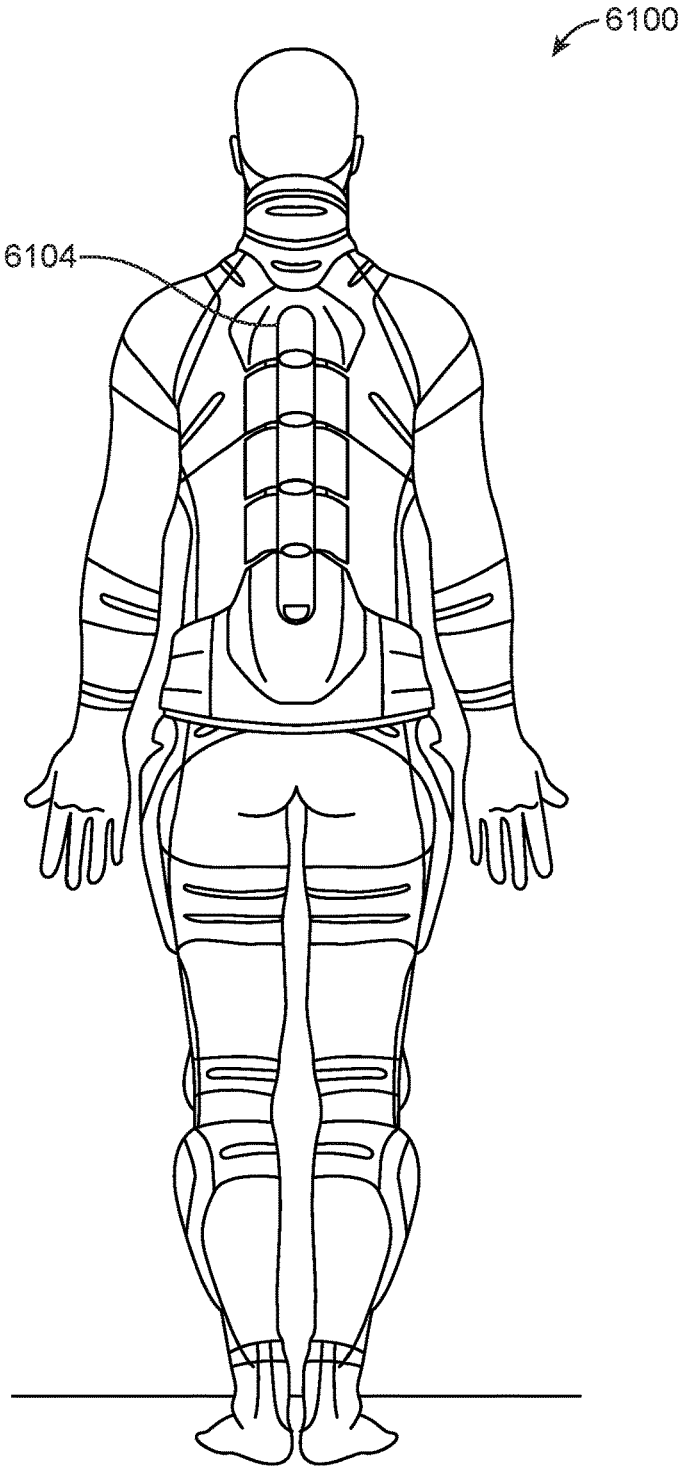
FIG. 61B shows a back view of the exemplary article of FIG. 61A, in accordance with some embodiments.
Figure 61C:
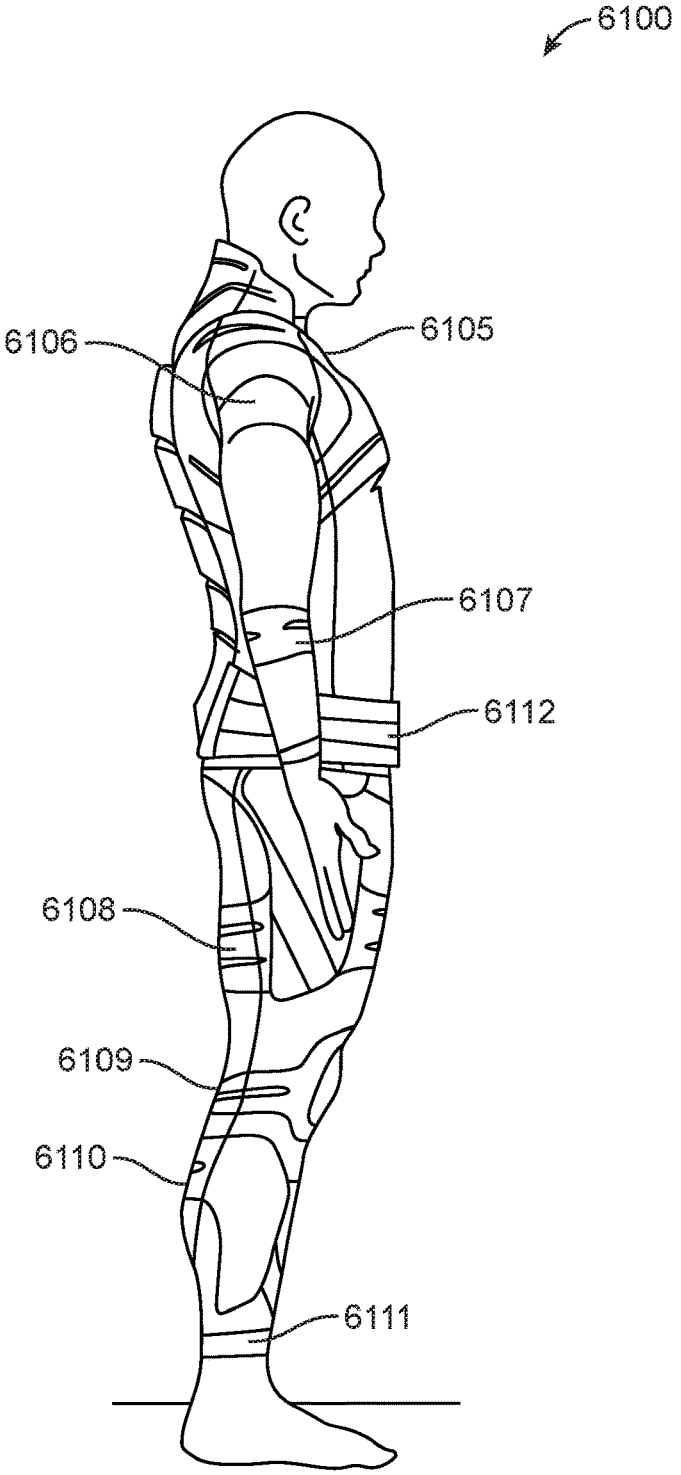
FIG. 61C shows a side view of the exemplary article of FIG. 61A, in accordance with some embodiments.
Figure 61D:
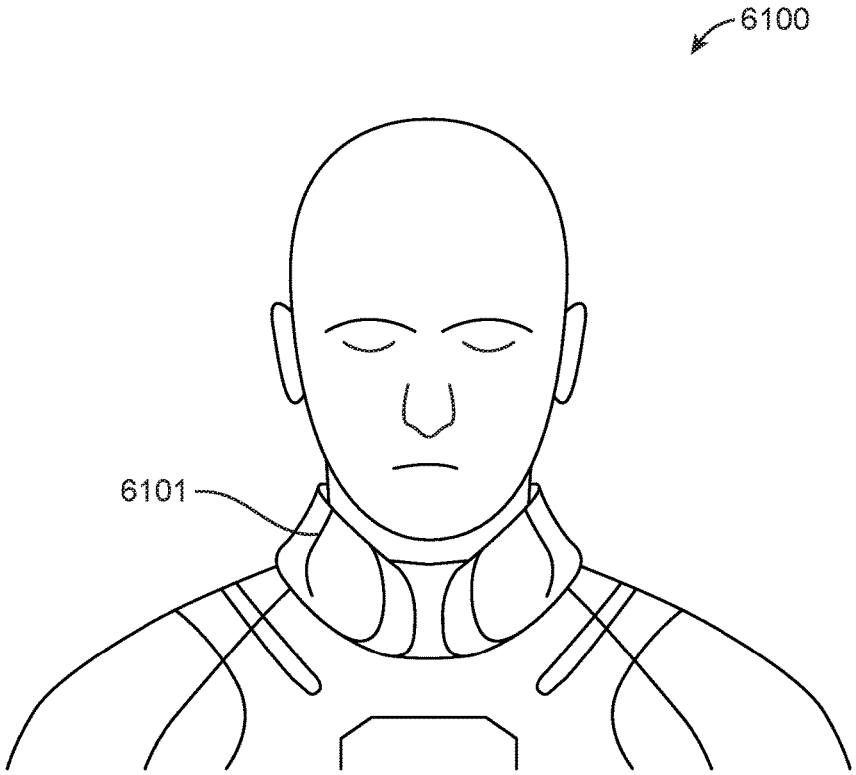
FIG. 61D shows a detailed front view of the exemplary article of FIG. 61A, in accordance with some embodiments.
Figure 61E:
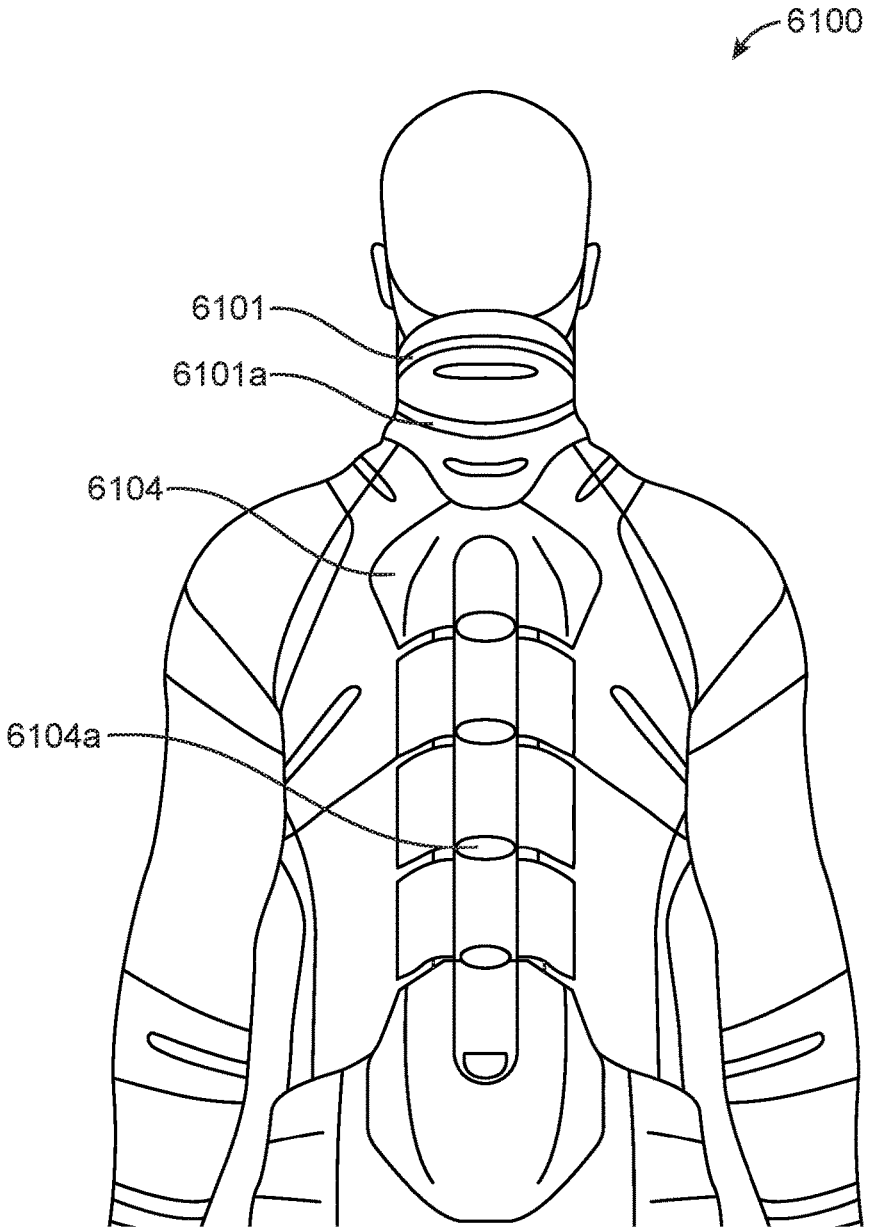
FIG. 61E shows a detailed back view of the exemplary article of FIG. 61A, in accordance with some embodiments.
Figure 61F:
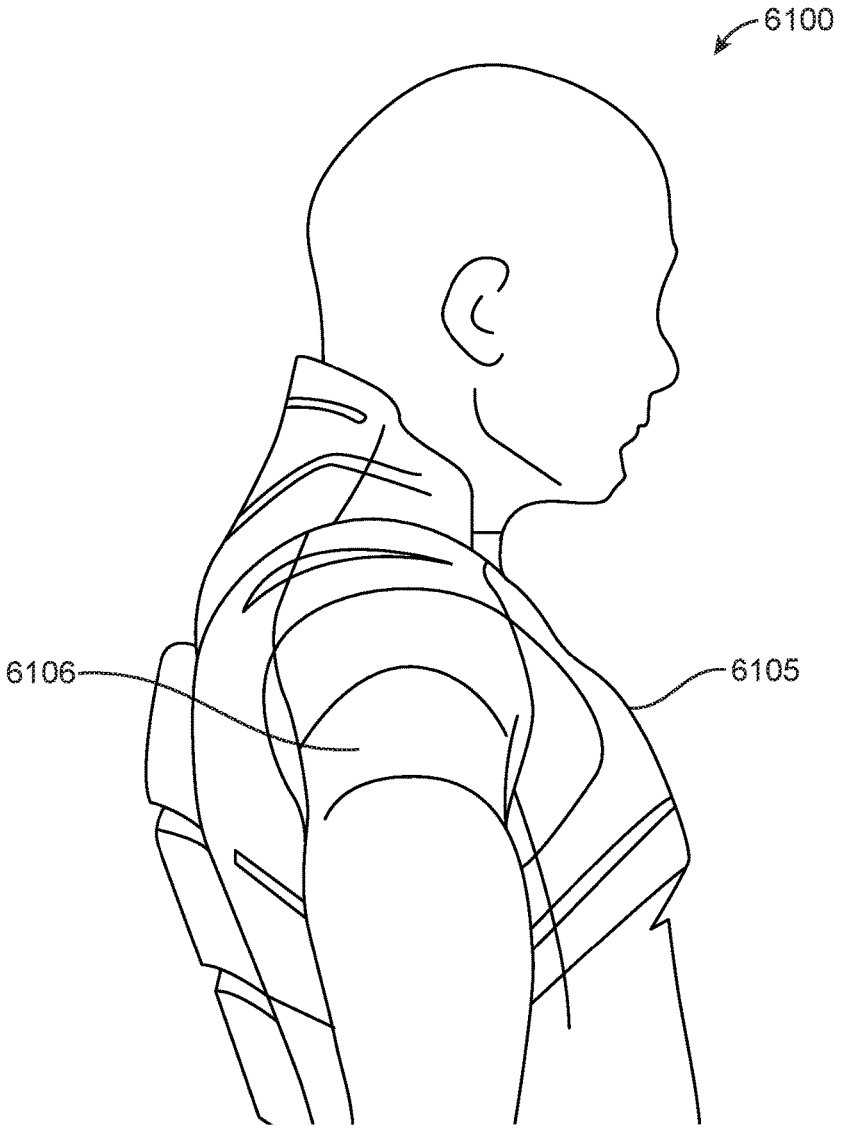
FIG. 61F shows a detailed side view of the exemplary article of FIG. 61A, in accordance with some embodiments.

As seen in FIGS. 61A, 61D, and 61E, the neck support 6101 is configured to support the neck of a subject. In some embodiments, the neck support 6101 is configured to maintain continuous contact with the neck of a subject throughout the neck's full range of motion or partial range of motion. In some embodiments, the neck support 6101 is configured to exert a force on the neck of a subject throughout the neck's full range of motion or partial range of motion. In some embodiments, the neck support 6101 is configured to exert a continuous force, a proportional force, or a derivative force on the spine of a subject. In some embodiments, the force exerted by the neck support 6101 on the subject corresponds to at least one of the linear or angular position, velocity, and acceleration of the subject's neck. In some embodiments, the neck support 6101 contacts or is rigidly or flexibly connected to at least one of the spine support 6104, the chest compression 6105, the shoulder compression 6106, and the base layer 6120. In some embodiments, the neck support 6101 comprises one or more independent portions, wherein two or more of the independent portions are permanently or removably connected. In some embodiments, the two or more independent portions are rigidly or flexibly connected to each other.

In some embodiments, the at least one support element comprises a cervical support device. In some embodiments, the cervical support device comprises the neck support 6101. In some embodiments, the cervical support device comprises the non-Newtonian material integrated into the base layer by at least one laminated layer. In some embodiments, the cervical support device comprises an inner mesh liner positioned within an interior of the base layer in contact with a wearer's neck.

In some embodiments, the neck support 6101 has a thickness that is uniform in at least one of a radial direction and a linear direction. In some embodiments, the neck support 6101 has a non-uniform thickness. In some embodiments, the neck support 6101 has lateral symmetry. As seen in FIG. 61E, the neck support 6101 may comprise one or more furrows 6101*a*. In some embodiments, the one or more furrows 6101*a* are configured to flex or fold along a set line, arch, or plane. In some embodiments, the one or more furrows 6101*a* are configured to prevent or allow motion of the neck in one or more directions. In some embodiments, two or more of the furrows 6101*a* have equivalent sizes or shapes. In some embodiments, two or more of the furrows 6101*a* have inequivalent sizes or shapes. In some embodiments, at least one of the furrows 6101*a* lies generally parallel to a transverse plane of the subject. In some embodiments, at least one of the furrows 6101*a* extends radially about the neck of the subject. In some embodiments, at least one of the furrows 6101*a* extends radially and normally about the neck of the subject. In some embodiments, at least one of the furrows 6101*a* terminates at an edge of the neck support 6101. In some embodiments, at least one of the furrows 6101*a* terminates without intersecting an edge of the neck support 6101. As seen in FIG. 61E, the neck support 6101 comprises 4 furrows 6101*a*. Alternatively, in some embodiments, the neck support 6101 comprises 1, 2, 3, 4, 5, 6, 7, 8, 9, or 10 or more furrows.

As seen in FIGS. 61B and 61E, the spine support 6104 is configured to support the spine of a subject. In some embodiments, the spine support 6104 is configured to maintain continuous contact with the spine of a subject throughout the spine's full range of motion or partial range of motion. In some embodiments, the spine support 6104 is configured to exert a force on the spine of a subject throughout the spine's full range of motion or partial range of motion. In some embodiments, the spine support 6104 is configured to exert a continuous force, a proportional force, or a derivative force on the spine of a subject. In some embodiments, the force exerted by the spine support 6104 on the subject corresponds to at least one of the linear or angular position, velocity, and acceleration of the subject's spine. In some embodiments, the spine support 6104 contacts or is rigidly or flexibly connected to at least one of the neck support 6101, the chest compression 6105, the shoulder compression 6106, the waist compression 6112, and the base layer 6120. In some embodiments, the spine support 6104 comprises one or more independent portions, wherein two or more of the independent portions are permanently or removably connected. In some embodiments, the two or more independent portions are rigidly or flexibly connected to each other.

In some embodiments, the spine support 6104 has a thickness that is uniform in at least one of a radial direction and a linear direction. In some embodiments, the spine support 6104 has a non-uniform thickness. In some embodiments, the spine support 6104 has lateral symmetry. As seen in FIG. 61E, the spine support 6104 may comprise one or more furrows 6104*a*. In some embodiments, the one or more furrows 6104*a* are configured to flex or fold along a set line, arch, or plane. In some embodiments, the one or more furrows 6104*a* are configured to prevent or allow motion of the spine in one or more directions. In some embodiments, two or more of the furrows 6104*a* have equivalent sizes or shapes. In some embodiments, two or more of the furrows 6104*a* have inequivalent sizes or shapes. In some embodiments, at least one of the furrows 6104*a* lies generally parallel to a transverse plane of the subject. In some embodiments, at least one of the furrows 6104*a* extends radially about the spine of the subject. In some embodiments, at least one of the furrows 6104*a* extends radially and normally about the spine of the subject. In some embodiments, at least one of the furrows 6104*a* terminates at an edge of the spine support 6104. In some embodiments, at least one of the furrows 6104*a* terminates without intersecting an edge of the spine support 6104. As seen in FIG. 61E, the spine support 6104 comprises 4 furrows 6104*a*. Alternatively, in some embodiments, the spine support 6104 comprises 1, 2, 3, 4, 5, 6, 7, 8, 9, or 10 or more furrows.

As seen in FIGS. 61A-C, the thigh support 6102 of the first exemplar compression article is configured to protect at least one of the thigh and the underlying hip bones of a subject. In some embodiments, the thigh support 6102 is configured to maintain continuous contact with the thigh of a subject throughout the thigh's full range of motion or partial range of motion. In some embodiments, the thigh support 6102 is configured to exert a continuous force on the thigh of a subject throughout the thigh's full range of motion or partial range of motion. In some embodiments, the force exerted by the thigh support 6102 on the subject corresponds to at least one of the linear or angular position, velocity, and acceleration of the subject's thigh. In some embodiments, the thigh support 6102 contacts or is rigidly or flexibly connected to at least one of the spine support 6104, the shin support 6103, the waist compression 6108, the knee compression 6109, the thigh compression 6112, and the base layer 6120. In some embodiments, the thigh support 6102 comprises one or more independent portions, wherein two or more of the independent portions are permanently or removably connected. In some embodiments, the two or more independent portions are rigidly or flexibly connected to each other.

In some embodiments, the thigh support 6102 has a thickness that is uniform in at least one of a radial direction and a linear direction. In some embodiments, the thigh support 6102 has a non-uniform thickness. In some embodiments, the thigh support 6102 has lateral symmetry. In some embodiments, the thigh support 6102 comprises a left thigh support and a right thigh support configured for use on the left and right side of the subject, respectively. In some embodiments, the left thigh support is equivalent to the right thigh support. In some embodiments, the left thigh support is a mirrored equivalent of the right thigh support about one or more planes.

As seen in FIGS. 61A-C, the shin support 6103 is configured to protect at least one of the shin and the underlying leg bones of a subject. In some embodiments, the shin support 6103 is configured to maintain continuous contact with the shin of a subject throughout the shin's full range of motion or partial range of motion. In some embodiments, the shin support 6103 is configured to exert a continuous force on the shin of a subject throughout the shin's full range of motion or partial range of motion. In some embodiments, the force exerted by the shin support 6103 on the subject corresponds to at least one of the linear or angular position, velocity, and acceleration of the subject's shin. In some embodiments, the shin support 6103 contacts or is rigidly or flexibly connected to at least one of the spine support 6104, the thigh support 6103, the ankle compression 6111, the knee compression 6109, the shin compression 6112, and the base layer 6120. In some embodiments, the shin support 6103 comprises one or more independent portions, wherein two or more of the independent portions are permanently or removably connected. In some embodiments, the two or more independent portions are rigidly or flexibly connected to each other.

In some embodiments, the shin support 6103 has a thickness that is uniform in at least one of a radial direction and a linear direction. In some embodiments, the shin support 6103 has a non-uniform thickness. In some embodiments, the shin support 6103 has lateral symmetry. In some embodiments, the shin support 6103 comprises a left shin support and a right shin support configured for use on the left and right side of the subject, respectively. In some embodiments, the left shin support is equivalent to the right shin support. In some embodiments, the left shin support is a mirrored equivalent of the right shin support about one or more planes.

As seen in FIGS. 61A-C, the shin support 6103 is configured to protect at least one of the shin and the underlying leg bones of a subject. In some embodiments, the shin support 6103 is configured to maintain continuous contact with the shin of a subject throughout the shin's full range of motion or partial range of motion. In some embodiments, the shin support 6103 is configured to exert a continuous force on the shin of a subject throughout the shin's full range of motion or partial range of motion. In some embodiments, the force exerted by the shin support 6103 on the subject corresponds to at least one of the linear or angular position, velocity, and acceleration of the subject's shin. In some embodiments, the shin support 6103 contacts or is rigidly or flexibly connected to at least one of the spine support 6104, the thigh support 6103, the ankle compression 6111, the knee compression 6109, the shin compression 6112, and the base layer 6120. In some embodiments, the shin support 6103 comprises one or more independent portions, wherein two or more of the independent portions are permanently or removably connected. In some embodiments, the two or more independent portions are rigidly or flexibly connected to each other.

In some embodiments, the shin support 6103 has a thickness that is uniform in at least one of a radial direction and a linear direction. In some embodiments, the shin support 6103 has a non-uniform thickness. In some embodiments, the shin support 6103 has lateral symmetry. In some embodiments, the shin support 6103 comprises a left shin support and a right shin support configured for use on the left and right side of the subject, respectively. In some embodiments, the left shin support is equivalent to the right shin support. In some embodiments, the left shin support is a mirrored equivalent of the right shin support about one or more planes.

As shown in FIG. 61C, the exemplary first compression article 6100 comprises a chest compression 6105, a shoulder compression 6106, an elbow compression 6107, a thigh compression 6108, a knee compression 6109, a shin compression 6110, an ankle compression 6111, and a waist compression.

As shown in FIG. 61C, the chest compression 6105 is configured to maintain at least one of a position and a pressure of the first compression article 6100 on the chest of the subject. In some embodiments, the chest compression 6105 is configured to maintain at least one of a position and a pressure of the neck support 6101 against the neck of the subject, the spine support 6104 against the spine of the subject, or both. In some embodiments, the chest compression 6105 is configured to maintain continuous contact with the chest of a subject throughout the chest's full range of motion or partial range of motion. In some embodiments, the chest compression 6105 is configured to exert a continuous force on the chest of a subject throughout the chest's full range of motion or partial range of motion. In some embodiments, the force exerted by the chest compression 6105 on the subject corresponds to at least one of the linear or angular position, velocity, and acceleration of the subject's chest. In some embodiments, the chest compression 6105 contacts or is rigidly or flexibly connected to at least one of the spine support 6104, the neck support 6101, and the base layer 6120.

As shown in FIG. 61A and C, the chest compression 6105 is configured to surround the right shoulder, the left shoulder, and the neck of the subject. Alternatively, in some embodiments, the chest compression 6105 is configured surround at least one of the right shoulder, the left shoulder, and the neck of the subject. Per FIG. 61A and C, the chest compression 6105 bifurcates and coalesces beneath and above each shoulder of the subject. Alternatively, in some embodiments, the chest compression 6105 is contiguous beneath and above each shoulder of the subject, or splits into multiple segments above each shoulder of the subject.

As shown in FIGS. 61C, the shoulder compression 6106 is configured to maintain at least one of a position and a pressure of the first compression article 6100 on the shoulder of the subject. In some embodiments, the shoulder compression 6106 is configured to maintain continuous contact with the shoulder of a subject throughout the shoulder's full range of motion or partial range of motion. In some embodiments, the shoulder compression 6106 is configured to exert a continuous force on the shoulder of a subject throughout the shoulder's full range of motion or partial range of motion. In some embodiments, the force exerted by the shoulder compression 6106 on the subject corresponds to at least one of the linear or angular position, velocity, and acceleration of the subject's shoulder.

As shown in FIG. 61C, the shoulder compression 6106 is configured surround at least a portion of the right shoulder or the left shoulder of the subject. Alternatively, in some embodiments, the shoulder compression 6106 is configured surround at least one of the right shoulder, the left shoulder, and the neck of the subject. In some embodiments, the shoulder compression 6106 is continuous. In some embodiments, the shoulder compression 6106 bifurcates and coalesces at least once. In some embodiments, the shoulder compression 6106 comprises a left shoulder compression 6106 and a right shoulder compression 6106 configured for use on the left and right shoulder of the subject, respectively. In some embodiments, the left shoulder compression 6106 is equivalent to the right shoulder compression 6106. In some embodiments, the left shoulder compression 6106 is a mirrored equivalent of the right shoulder compression 6106 about one or more planes.

As shown in FIG. 61C, the shoulder compression 6106 is configured to maintain at least one of a position and a pressure of the first compression article 6100 on the shoulder of the subject. In some embodiments, the shoulder compression 6106 is configured to maintain continuous contact with the shoulder of a subject throughout the shoulder's full range of motion or partial range of motion. In some embodiments, the shoulder compression 6106 is configured to exert a continuous force on the shoulder of a subject throughout the shoulder's full range of motion or partial range of motion. In some embodiments, the force exerted by the shoulder compression 6106 on the subject corresponds to at least one of the linear or angular position, velocity, and acceleration of the subject's shoulder.

As shown in FIG. 61C, the shoulder compression 6106 is configured surround at least a portion of the right shoulder or the left shoulder of the subject. Alternatively, in some embodiments, the shoulder compression 6106 is configured surround at least one of the right shoulder, the left shoulder, and the neck of the subject. In some embodiments, the shoulder compression 6106 is continuous. In some embodiments, the shoulder compression 6106 bifurcates and coalesces at least once. In some embodiments, the shoulder compression 6106 comprises a left shoulder compression 6106 and a right shoulder compression 6106 configured for use on the left and right shoulder of the subject, respectively. In some embodiments, the left shoulder compression 6106 is equivalent to the right shoulder compression 6106. In some embodiments, the left shoulder compression 6106 is a mirrored equivalent of the right shoulder compression 6106 about one or more planes.

Figure 62A:
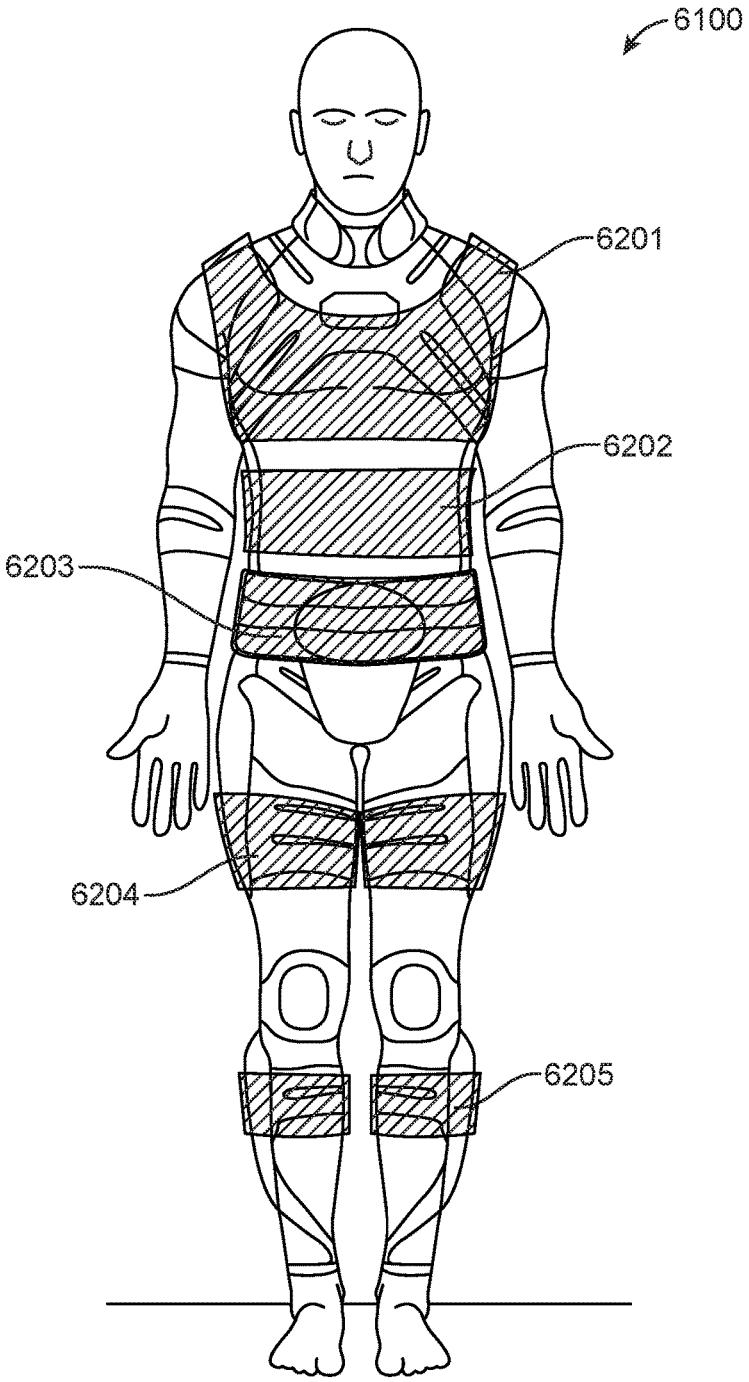
FIG. 62A shows a front view of the adjustable tension areas of the exemplary article of FIG. 61A, in accordance with some embodiments.
Figure 62B:
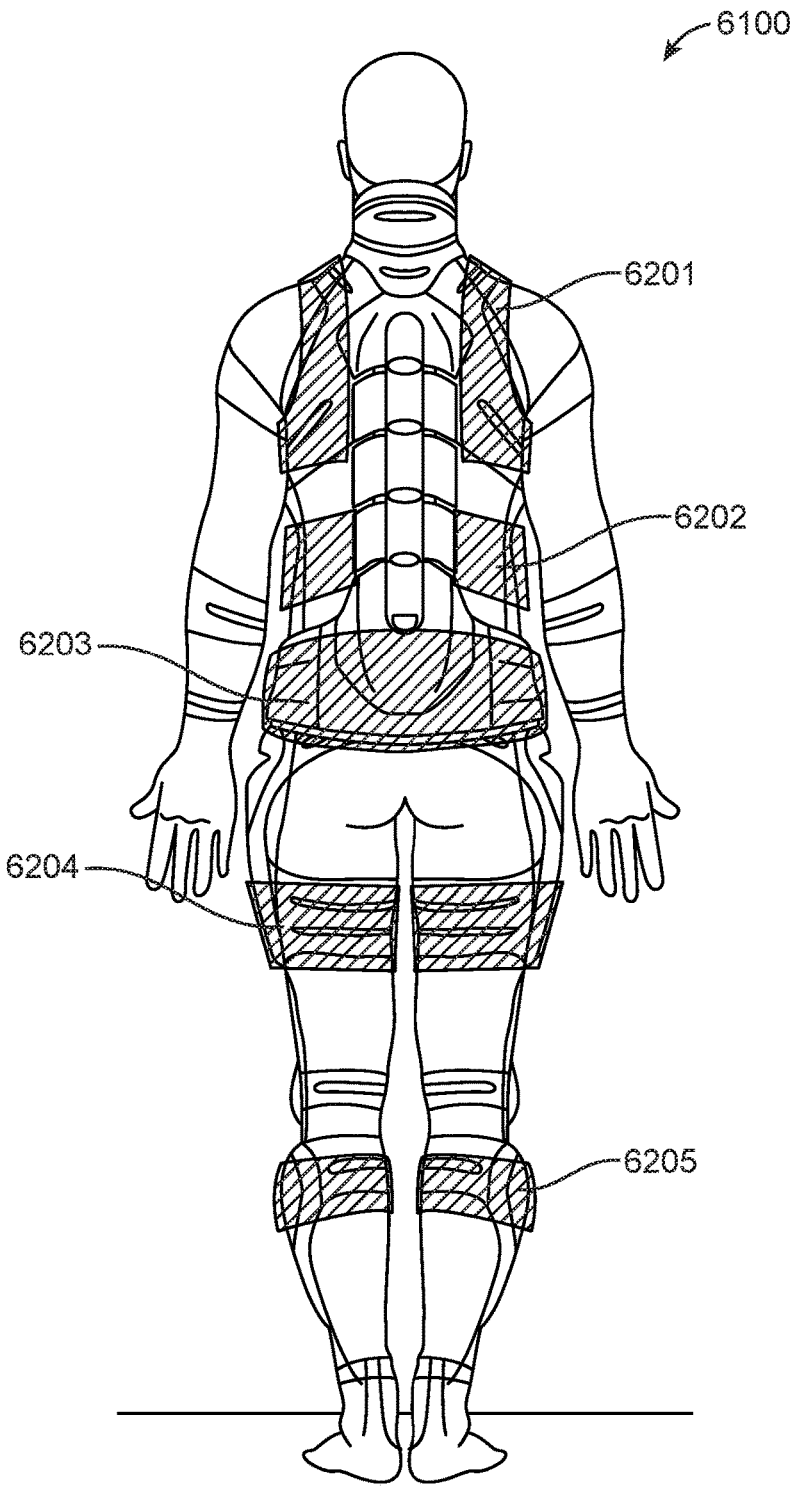
FIG. 62B shows a back view of the adjustable tension areas of the exemplary article of FIG. 61A, in accordance with some embodiments.
Figure 62C:
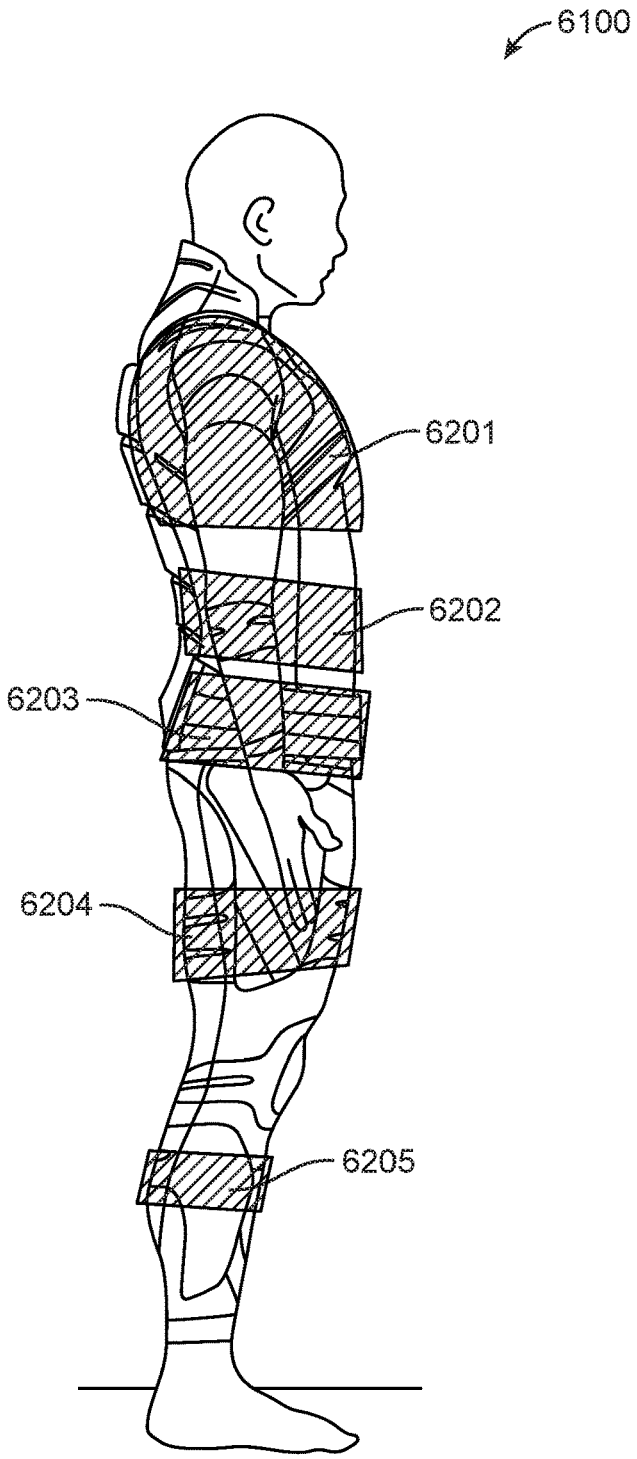
FIG. 62C shows a side view of the adjustable tension areas of the exemplary article of FIG. 61A, in accordance with some embodiments.

FIGS. 62A-C show the adjustable tension areas of an exemplary first compression article. FIG. 62A shows a front view of the adjustable tension areas of the exemplary first compression article of FIG. 61A, in accordance with some embodiments. FIG. 62B shows a back view of the adjustable tension areas of the exemplary first compression article of FIG. 61A, in accordance with some embodiments. FIG. 62C shows a side view of the adjustable tension areas of the exemplary first compression article of FIG. 61A, in accordance with some embodiments.

Shown in FIGS. 62A-C is the exemplary first compression article 6100 comprising a chest tensioner 6201, an abdominal tensioner 6202, a waist tensioner 6203, a thigh tensioner 6204, and an ankle tensioner 6205. As seen, the exemplary first compression article 6100 may comprise one chest tensioner 6201, one abdominal tensioner 6202, one waist tensioner 6203, two thigh tensioners 6204, and two ankle tensioners 6205. Alternatively, in some embodiments, the exemplary first compression article 6100 comprises 1, 2, 3, 4, 5, 6, 7 8, 9, or 10 or more of each of the chest tensioner 6201, the abdominal tensioner 6202, the waist tensioner 6203, the thigh tensioner 6204, and the ankle tensioner 6205.

In some embodiments, at least one of the chest tensioner 6201, the abdominal tensioner 6202, the waist tensioner 6203, the thigh tensioner 6204, and the ankle tensioner 6205 are permanently attached to at least one of the neck support 6101, the thigh support 6102, the shin support 6103, the spine support 6104, the chest compression 6105, the shoulder compression 6106, the elbow compression 6107, the thigh compression 6108, the knee compression 6109, the shin compression 6110, the ankle compression 6111, the waist compression 6112, and the base layer 6120. In some embodiments, at least one of the chest tensioner 6201, the abdominal tensioner 6202, the waist tensioner 6203, the thigh tensioner 6204, and the ankle tensioner 6205 are removably attached to at least one of the neck support 6101, the thigh support 6102, the shin support 6103, the spine support 6104, the chest compression 6105, the shoulder compression 6106, the elbow compression 6107, the thigh compression 6108, the knee compression 6109, the shin compression 6110, the ankle compression 6111, the waist compression 6112, and the base layer 6120. In some embodiments, at least a portion of at least one of the chest tensioner 6201, the abdominal tensioner 6202, the waist tensioner 6203, the thigh tensioner 6204, and the ankle tensioner 6205 are attached to the first compression article 6100.

In some embodiments, at least one of the chest tensioner 6201, the abdominal tensioner 6202, the waist tensioner 6203, the thigh tensioner 6204, and the ankle tensioner 6205 comprise a belt, a band, a strap, a hook and loop fastener, a clasp, a rope, a string, a hook, a cinch, or any combination thereof. In some embodiments, at least one of the chest tensioner 6201, the abdominal tensioner 6202, the waist tensioner 6203, the thigh tensioner 6204, and the ankle tensioner 6205 have one or more adjustable lengths or diameters configured to be adjusted by the subject to fit their body. In some embodiments, at least one of the chest tensioner 6201, the abdominal tensioner 6202, the waist tensioner 6203, the thigh tensioner 6204, and the ankle tensioner 6205 is elastic. In some embodiments, at least one of the chest tensioner 6201, the abdominal tensioner 6202, the waist tensioner 6203, the thigh tensioner 6204, and the ankle tensioner 6205 is rigid.

In some embodiments, at least one of the chest tensioner 6201, the abdominal tensioner 6202, the waist tensioner 6203, the thigh tensioner 6204, and the ankle tensioner 6205 are formed of fabric, thread, wood, fiberglass, carbon fiber, metal, a polymer, a gel, a foam, a composite, or any combination thereof. In some embodiments, at least one of the chest tensioner 6201, the abdominal tensioner 6202, the waist tensioner 6203, the thigh tensioner 6204, and the ankle tensioner 6205 are formed of the same material. In some embodiments, at least one of the chest tensioner 6201, the abdominal tensioner 6202, the waist tensioner 6203, the thigh tensioner 6204, and the ankle tensioner 6205 are formed of different materials.

In some embodiments, at least one of the chest tensioner 6201, the abdominal tensioner 6202, the waist tensioner 6203, the thigh tensioner 6204, and the ankle tensioner 6205 is configured to exert a continuous force, an adjustable, a proportional force, or a derivative force on the body of a subject. In some embodiments, at least one of the chest tensioner 6201, the abdominal tensioner 6202, the waist tensioner 6203, the thigh tensioner 6204, and the ankle tensioner 6205 is configured to exert a continuous force, a proportional force, or a derivative force on the body of a subject throughout the subjects partial or full range of motion in at least one degree of freedom.

Figure 63A:
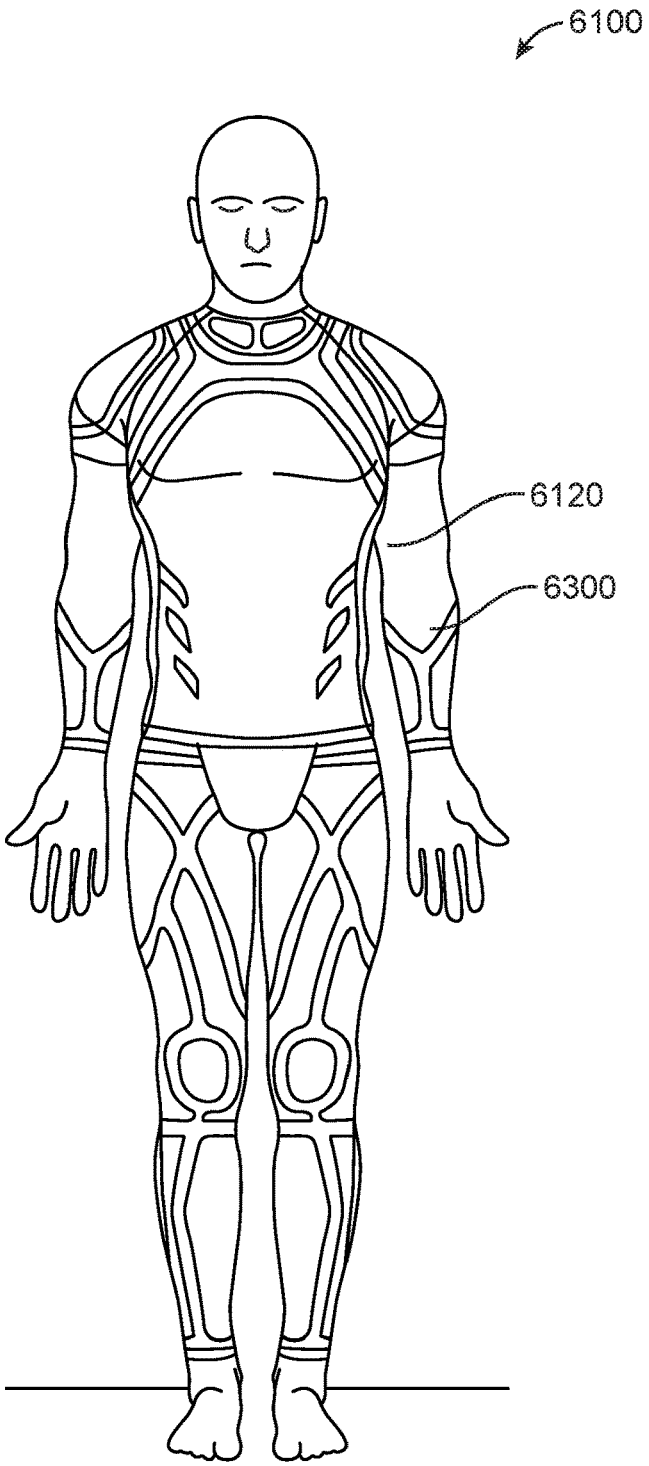
FIG. 63A shows a front view of the adjustable tension areas of the exemplary article of FIG. 61A, in accordance with some embodiments.
Figure 63B:
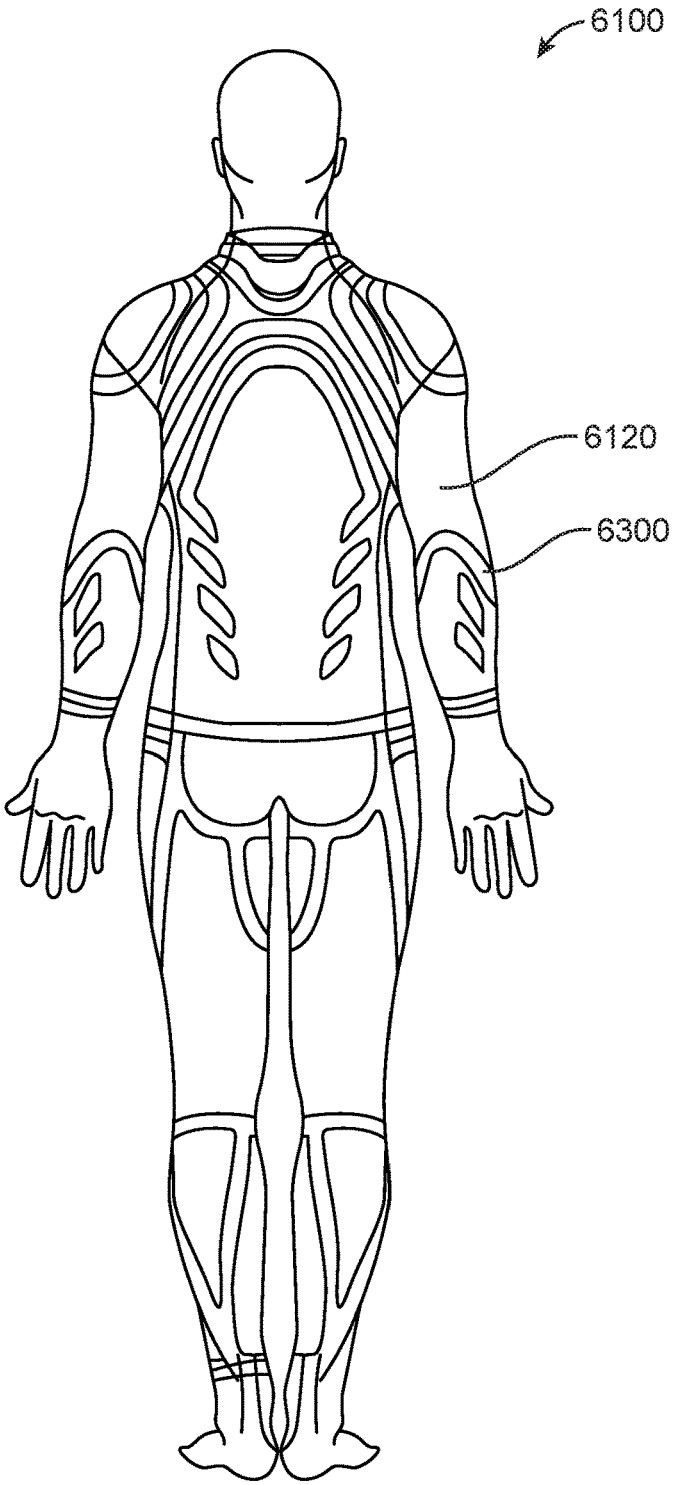
FIG. 63B shows a back view of the adjustable tension areas of the exemplary article of FIG. 61A, in accordance with some embodiments.
Figure 63C:
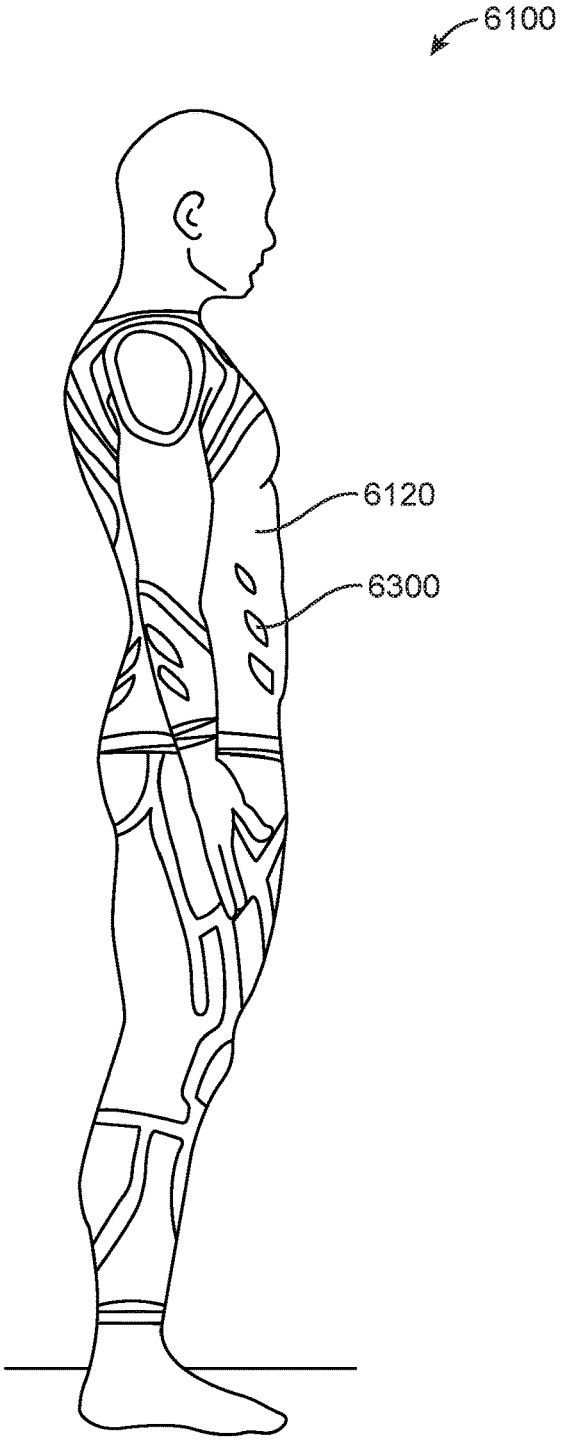
FIG. 63C shows a side view of the adjustable tension areas of the exemplary article of FIG. 61A, in accordance with some embodiments.

Provided herein per FIGS. 63A-C is an exemplary second compression article. FIG. 63A shows a front view of the exemplary second compression article, in accordance with some embodiments. FIG. 63B shows a side view of the exemplary second compression article, in accordance with some embodiments. FIG. 63C shows a back view of the exemplary second compression article, in accordance with some embodiments.

As shown in FIGS. 63A-C, the exemplary second compression article 6100 comprises a base layer 6120, and at least one gripping element (not shown). In some embodiments, the at least one gripping element comprises 2, 3, 4, 5, 6, 7, 8, 9, or 10 or more gripping elements. In some embodiments, the gripping element comprises at least one of a shoulder gripping element, an arm gripping element, a forearm gripping element, a chest gripping element, a rib gripping element, a thigh gripping element, a shin gripping element, a knee gripping element, a collar gripping element, a buttocks gripping element, a hip gripping element, a neck gripping element, a wrist gripping element, and an ankle gripping element.

In some embodiments, the gripping element is configured to contact a body of the subject, wherein the gripping element has a second coefficient of friction ($\mu 2$) relative to the body surface, wherein the second coefficient of friction ($\mu 2$) is greater than the first coefficient of friction ($\mu 1$). In some embodiments, the at least one gripping element is configured to exert at least one of a normal and a tangential force upon the body surface of the wearer. In some embodiments, the at least one gripping element is configured to exert at least one of a normal and a tangential force upon the body surface of the wearer to prevent substantial shifting of the article across the skin of the wearer. In some embodiments, the at least one gripping element comprises a surface texture configured to exert a tangential force upon the body surface of the wearer.

Gripping elements can provide traction to the interior surface of an article to prevent slipping or shifting when worn on the body of a subject. In some embodiments, gripping elements are made of a material having a coefficient of friction with skin that is relatively higher than the coefficient of friction of the base layer. Gripping elements provide an important function of maintaining optimal positioning of the support element (e.g. a neck support element or cervical/spinal support device) to protect and/or support the corresponding anatomy of the subject wearing the article. For example, an article that shifts substantially during the course of being worn by a subject may cause the neck support element protecting the neck to shift out of alignment and no longer be positioned snugly around the subject's neck. Thus, the neck support element may no longer provide the desired protection from injury such as in the case of a sudden impact or acceleration to the head of the subject. Accordingly, the gripping elements provide more than a comfortable fit, but actually are an important feature that improves the corresponding function of support element (s). This innovative combination of gripping and support elements helps produce a superior article for providing support and/or protection when worn by a subject.

Another aspect provided herein is a method for forming an article wearable by a subject, comprising: providing a base layer having an interior surface and an exterior surface, wherein the interior surface has a first coefficient of friction (1) relative to a body surface of the subject, and wherein the base layer has a first modulus of elasticity (E1); coupling at least one gripping element to the interior surface of the base layer, wherein the at least one gripping element is configured to contact a body of the subject, and wherein the at least one gripping element has a second coefficient of friction (μ2) relative to the body surface, wherein μ2 is greater than μ1; coupling at least one compression element to the base layer, wherein the at least one compression element has a second modulus of elasticity (E2) that is greater than E1; and coupling at least one support element comprising a non-Newtonian material to the base layer.

In some embodiments, the method further comprises laminating or printing the compression element or gripping element adjacent to the base layer. In some embodiments, the printing is three-dimensional printing. In some embodiments, at least one of the support element, the compression element, and the gripping element is irremovably attached to the base layer. In some embodiments, at least one of the support element, the compression element, and the gripping element is removably attached to the base layer. In some embodiments, the at least one support element comprises a neck support. In some embodiments, the neck support comprises a penannular collar member that is anatomically complementary with a neck of the wearer. In some embodiments, the neck support comprises an elastomeric material or a force-reactive polymer positioned around a rear and lateral sides of a neck of the wearer. In some embodiments, the at least one support element comprises a spine support comprising at least one furrow configured to flex or fold along a set line, arch, or plane.

Another aspect provided herein is a method for mounting an article 6100 on a body of a subject, comprising: providing the article comprising a base layer 6200, at least one gripping element 6300, at least one compression element, and at least one support element; and mounting the article on a body of the subject. In some embodiments, the base layer 6200 has an interior surface and an exterior surface. In some embodiments, the interior surface has a first coefficient of friction (μ1) relative to a body surface of the subject. In some embodiments, the base layer 6200 has a first modulus of elasticity (E1). In some embodiments, the least one gripping element 6300 is coupled to the interior surface of the base layer 6200. In some embodiments, the at least one gripping element 6300 is configured to contact a body of the subject. In some embodiments, the at least one gripping element 6300 has a second coefficient of friction (μ2) relative to the body surface. In some embodiments, μ2 is greater than μ1. In some embodiments, the at least one compression element coupled to the base layer 6200. In some embodiments, the at least one compression element has a second modulus of elasticity (E2) that is greater than E1. In some embodiments, the at least one support element comprises a non-Newtonian material. In some embodiments, the at least one support element is coupled to the base layer 6200. In some embodiments, the interior surface and the at least one gripping element 6300 contact the body surface of the subject.

In some embodiments, when mounted on the body of the subject, the at least one gripping element 6300 contacts the body surface of the subject such that the article slides by at most 5 centimeters, 4 centimeters, 3 centimeters, 2 centimeters, or 1 centimeter. In some embodiments, when mounted on the body of the subject, the at least one gripping element 6300 contacts the body surface of the subject such that the article slides by at most 20°, 15°, 10°, 5°, or 1° about a point on the body of the subject. In some embodiments, when mounted on the body of the subject, the at least one gripping element 6300 contacts the body surface of the subject such that the article slides in a first direction by at most about 25%, 20%, 15%, 10%, 5%, or 1% of the length of the gripping element 6300 in the first direction.

In some embodiments, when mounted on the body of the subject, the at least one support element provide stress relief, load transfer, fatigue relief, or any combination thereof to the subject. In some embodiments, when mounted on the body of the subject, the non-Newtonian material of the at least one support element comprises: a first viscosity (v1) allowing unrestricted motion by the subject when the motion exerts a first force (F1) upon the at least one support element; and a second viscosity (v2) restricting motion by the subject when the motion exerts a second force (F2) upon the at least one support element, wherein F2 is greater than F1 and v2 is greater than v1. In some embodiments, when mounted on the body of the subject, the at least one support element provides resistance to movement of at least one of a muscle, a joint, or a bone of the subject, wherein the resistance increases with increasing force of the movement. In some embodiments, when mounted on the body of the subject, the at least one support element exerts a force on at least one of a muscle, a joint, or a bone of the subject throughout a full or partial range of motion in one or more degrees of freedom. In some embodiments, when mounted on the body of the subject, the at least one compression element provides stress support, load transfer, fatigue relief, or any combination thereof to the subject. In some embodiments, when mounted on the body of the subject, the at least one compression element is configured to exert a force on a muscle, bone, or joint of a wearer throughout a full or partial range of motion of the muscle, bone, or joint.

Figure 64A:
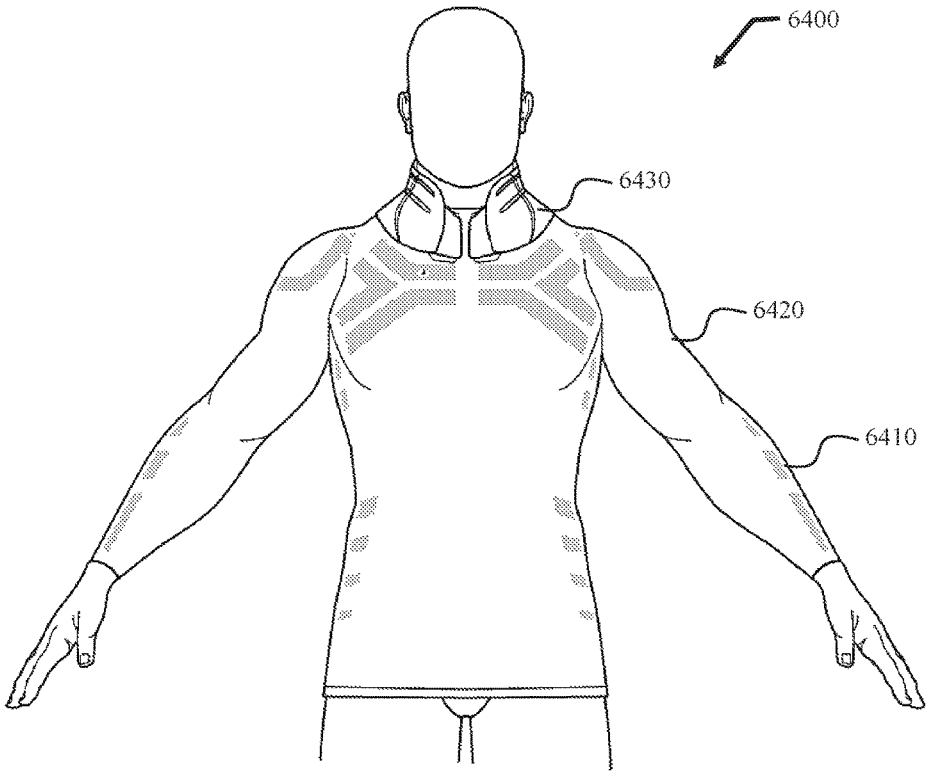
FIG. 64A shows a front view of an exemplary long-sleeved second article, in accordance with some embodiments.
Figure 64B:
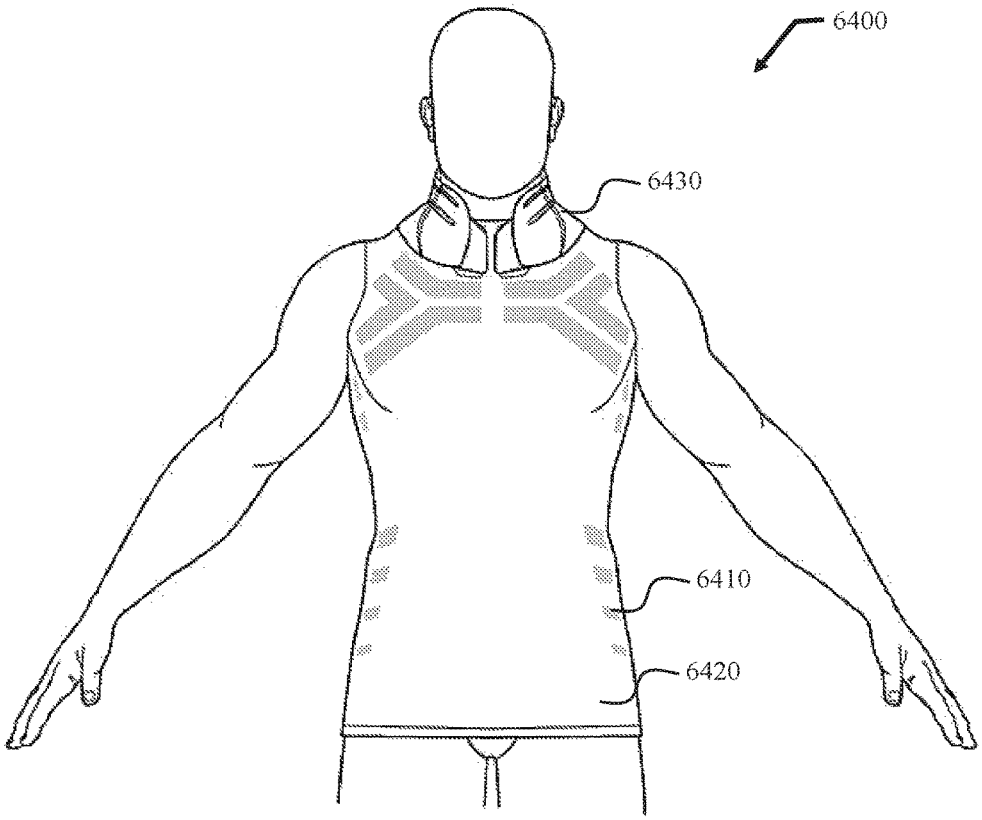
FIG. 64B shows a front view of an exemplary no-sleeve second article, in accordance with some embodiments.
Figure 64C:
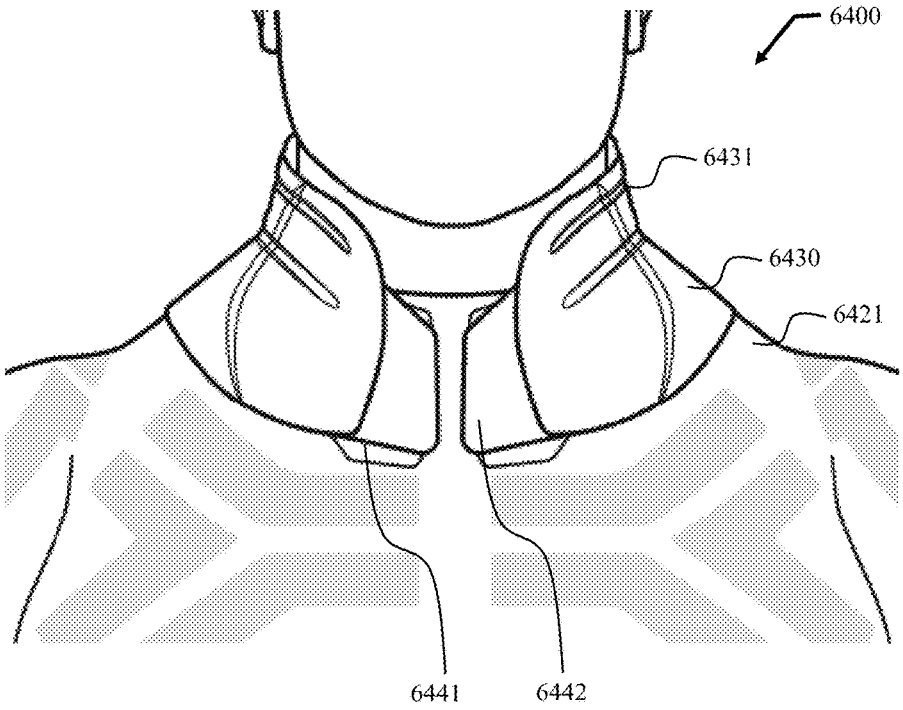
FIG. 64C shows a detailed front view of the exemplary second article of FIG. 64A, in accordance with some embodiments.
Figure 64D:
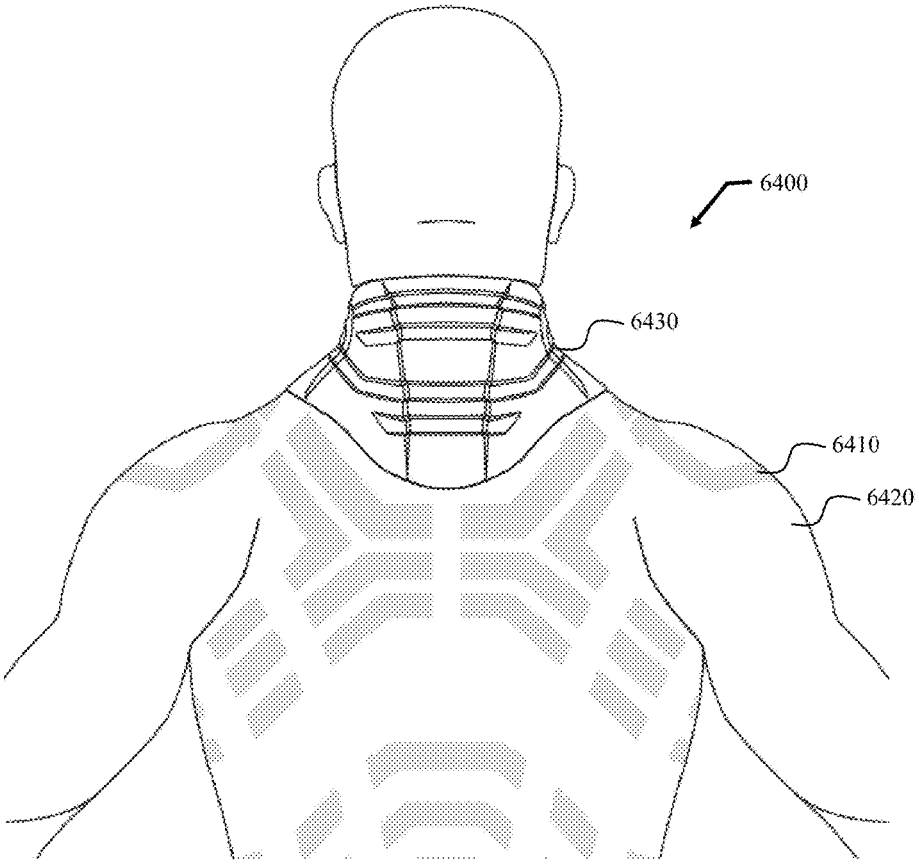
FIG. 64D shows a back view of the exemplary second article of FIG. 64A, in accordance with some embodiments.
Figure 64E:
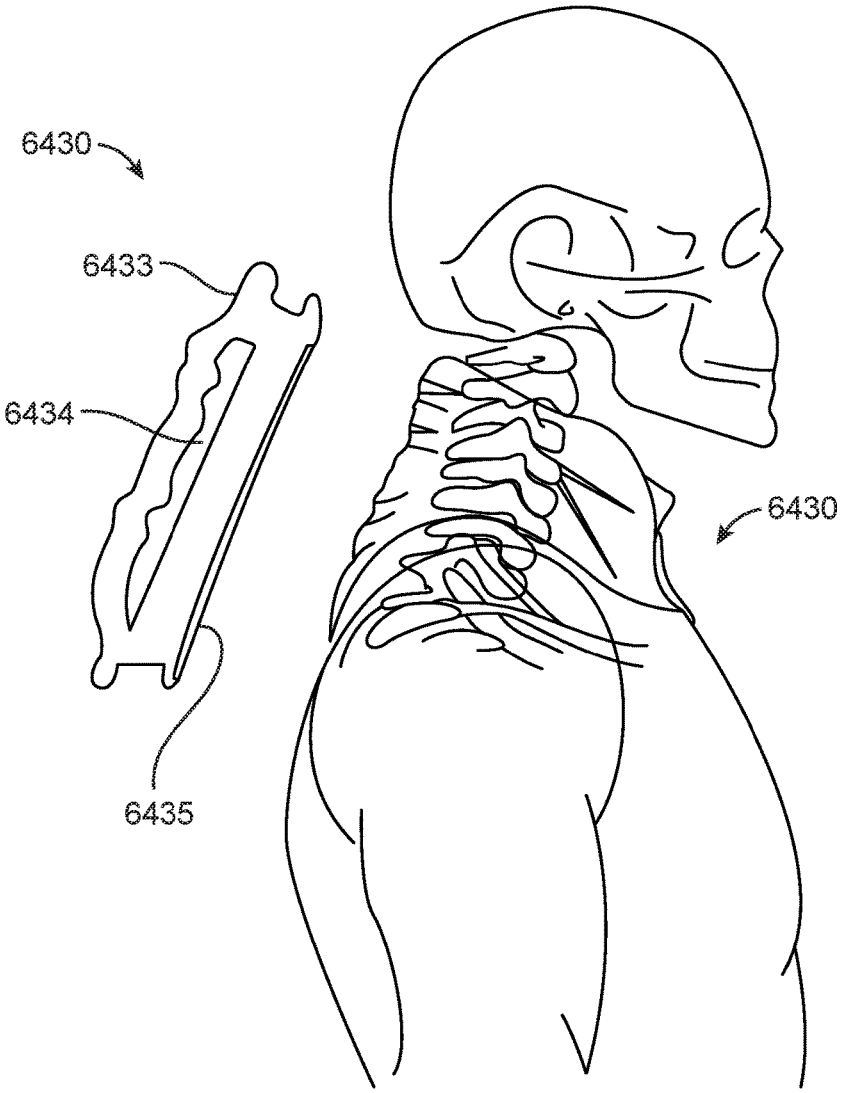
FIG. 64E shows a cross-sectioned side view of the exemplary second article of FIG. 64A, with a detailed view of a neck support element in accordance with some embodiments.

Shown in FIGS. 64A-E is an exemplary third compression article. FIG. 64A shows a front view of an exemplary long-sleeved third compression article, in accordance with some embodiments. FIG. 64B shows a front view of an exemplary no-sleeve third compression article, in accordance with some embodiments. FIG. 64C shows a detailed front view of the exemplary third compression article of FIG. 64A, in accordance with some embodiments. FIG. 64D shows a back view of the exemplary third compression article of FIG. 64A, in accordance with some embodiments. FIG. 64E shows a cross-sectioned side view of the exemplary second compression article of FIG. 64A, in accordance with some embodiments.

Per FIGS. 64A-C the exemplary third compression article 6400 comprises a base layer 6420, at least one gripping element 6410, and a neck support 6430. In some embodiments, the at least one gripping element 6410 comprises 2, 3, 4, 5, 6, 7, 8, 9, or 10 or more gripping elements 6410. In some embodiments, the gripping element 6410 comprises at least one of a shoulder gripping element, an arm gripping element, a forearm gripping element, a chest gripping element, a rib gripping element, a thigh gripping element, a shin gripping element, a knee gripping element, a collar gripping element, a buttocks gripping element, a hip gripping element, a neck gripping element, a wrist gripping element, and an ankle gripping element.

In some embodiments, the gripping element 6410 is configured to contact a body of the subject, wherein the gripping element has a second coefficient of friction (μ2) relative to the body surface, wherein the second coefficient of friction (μ2) is greater than the first coefficient of friction (μ1). In some embodiments, the at least one gripping element 6410 is configured to exert at least one of a normal and a tangential force upon the body surface of the wearer. In some embodiments, the at least one gripping element 6410 is configured to exert at least one of a normal and a tangential force upon the body surface of the wearer to prevent substantial shifting of the article across the skin of the wearer. In some embodiments, the at least one gripping element 6410 comprises a surface texture configured to exert a tangential force upon the body surface of the wearer.

As shown in FIG. 64A, the exemplary second compression article 6400 may comprise a long-sleeve second compression article 6400. In some embodiments, the long-sleeve second compression article 6400 is configured for use in winter sports and/or full body contact sports. Alternatively, per FIG. 64A, the exemplary second compression article 6400 may comprise a short-sleeve second compression article 6400. In some embodiments, the short-sleeve second compression article 6400 is configured for use in summer sports and/or reduced-contact sports.

As seen in FIGS. 64A-E, the neck support 6430 is configured to support the neck of a subject. In some embodiments, the neck support 6430 is configured to maintain continuous contact with the neck of a subject throughout the neck's full range of motion or partial range of motion. In some embodiments, the neck support 6430 is configured to exert a force on the neck of a subject throughout the neck's full range of motion or partial range of motion. In some embodiments, the neck support 6430 is configured to exert a continuous force, a proportional force, or a derivative force on the spine of a subject. In some embodiments, the force exerted by the neck support 6430 on the subject corresponds to at least one of the linear or angular position, velocity, and acceleration of the subject's neck. In some embodiments, the neck support 6430 comprises a cervical support device.

In some embodiments, the neck support 6430 is permanently attached to the base layer 6420. In some embodiments, the neck support 6430 is laminated or printed adjacent to the base layer. In some embodiments, the neck support 6430 is removably attached to the base layer 6420. In some embodiments, the neck support 6430 is removably attached to the interior surface of the base layer 6420. In some embodiments, the neck support 6430 is attached to the exterior surface of the base layer 6420.

In some embodiments, the neck support 6430 comprises one or more independent portions, wherein two or more of the independent portions are permanently or removably connected. In some embodiments, the two or more independent portions are rigidly or flexibly connected to each other. In some embodiments, the neck support 6430 has a thickness that is uniform in at least one of a radial direction and a linear direction. In some embodiments, the neck support 6430 has a non-uniform thickness. In some embodiments, the neck support 6430 has lateral symmetry.

As seen in FIG. 64C, the neck support 6430 may comprise one or more furrows 6431. In some embodiments, the one or more furrows 6431 are configured to flex or fold along a set line, arch, or plane. In some embodiments, the one or more furrows 6431 are configured to prevent or allow motion of the neck in one or more directions. In some embodiments, two or more of the furrows 6431 have equivalent sizes or shapes. In some embodiments, two or more of the furrows 6431 have inequivalent sizes or shapes. In some embodiments, at least one of the furrows 6431 lies generally parallel to a transverse plane of the subject. In some embodiments, at least one of the furrows 6431 extends radially about the neck of the subject. In some embodiments, at least one of the furrows 6431 extends radially and normally about the neck of the subject. In some embodiments, at least one of the furrows 6431 terminates at an edge of the neck support 6430. In some embodiments, at least one of the furrows 6431 terminates without intersecting an edge of the neck support 6430. As seen in FIG. 61E, the neck support 6430 comprises 4 furrows 6431. Alternatively, in some embodiments, the neck support 6430 comprises 1, 2, 3, 4, 5, 6, 7, 8, 9, or 10 or more furrows 6431.

As seen in FIG. 64C, the neck support 6430 may comprise one or more neck compression elements 6441 6442. In some embodiments, the neck compression element 6441 6442 is permanently attached to the neck support 6430, the base layer 6420, or both. In some embodiments, the neck compression element 6441 6442 is removably attached to the neck support 6430, the base layer 6420, or both. In some embodiments, the neck compression element 6441 6442 is configured to adjust a baseline tension of the neck support 6430 on the user. Per FIG. 64C, the neck compression element 6441 6442 comprises two neck compression elements 6441 6442. Alternatively, the neck compression element 6441 6442 comprises 3, 4, 5, 6, 7, 8, 9, or 10 or more neck compression elements 6441 6442. Per FIG. 64C, the neck compression element 6441 6442 comprises fastener such as a hook and loop fastener. Alternatively, In some embodiments, the neck compression element 6441 6442 comprises strap a buckle, a zipper, a button, a hook, an eye, a lace, a magnet, a clasp, a clip, a screw, a bolt, a nut, a tie, or any combination thereof.

In some embodiments, per FIG. 64E, the neck support 6430 comprises a neck support body 6433 surrounding a non-Newtonian foam 6434, and a liner 6435 attached to neck support body 6433. In some embodiments, the neck support body 6433 is formed of laminated Lycra. In some embodiments, the neck support body 6433 is permanently attached to the non-Newtonian foam 6434, and the liner 6435. In some embodiments, the neck support body 6433 is removably attached to the non-Newtonian foam 6434, and the liner 6435. In some embodiments, the liner 6435 comprises a mesh liner.

Devices, articles, systems and methods of the present disclosure may be combined with or modified by other devices, systems or methods, such as those disclosed in, for example, PCT/CA2016/051296, which is entirely incorporated herein by reference.

Terms and Definitions

Unless otherwise defined, all technical terms used herein have the same meaning as commonly understood by one of ordinary skill in the art to which this invention belongs. As used in this specification and the appended claims, the singular forms "a," "an," and "the" include plural references unless the context clearly dictates otherwise. Any reference to "or" herein is intended to encompass "and/or" unless otherwise stated. As used in this specification and the claims, unless otherwise stated, the term "about," and "approximately" refers to variations of less than or equal to +/−1%, +/−2%, +/−3%, +/−4%, +/−5%, +/−6%, +/−7%, +/−8%, +/−9%, +/−10%, +/−11%, +/−12%, +/−14%, +/−15%, or +/−20% depending on the embodiment.

As used herein, the term "rate-sensitive material" refers to a material whose resistance to applied forces is dependent on the rate at which the force is applied, and more particularly to materials whose resistance to applied force increases the faster the force is applied. The term "rate-sensitive material" includes materials described as "rate dependent", "non-Newtonian" and/or having "non-linear properties" such as, for example, viscoelastic foam.

As used herein, the term "anatomically complementary" refers to a structure or shape adapted to receive the body region, or be received on the body region, with which it is to be used so as to engage and support the body region.

As used herein, the term "friction" refers to a force resisting the relative motion of materials or surfaces sliding against each other. Friction can refer to any of dry friction, fluid friction, lubricated friction, skin friction, and internal friction.

As used herein, the term "coefficient of friction" refers to a dimensionless scalar value describing the ratio between the frictional force between two materials or surfaces and the force pressing them together. For example, a low coefficient of friction indicates a low amount of friction between two surfaces relative to the force pressing them together (e.g. ice on a linoleum surface). Coefficient of friction can refer to static friction or kinetic friction. Different materials can be compared based on their respective coefficient of friction values relative to a common surface or material. For example, a polyester material and a silicone material can be compared based on their coefficient of friction against the skin of a subject.

As used herein, the term "close topographical engagement" refers to a shaping of the parts, and does not require direct physical contact between the wearable article and the body region, but rather that there be sufficient engagement to permit effective transmission of forces from the body region to the wearable article.

As used herein, the term "anatomically non-restrictive" as used herein, means that the wearable article, when secured in close topographical engagement on the relevant body region, permits that body region to move through substantially normal ranges of motion.

As used herein, the terms "inferior" and "superior" are used herein in their anatomical sense, and are synonymous with "cranial" (toward the skull) and caudal (toward the hips), respectively While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. While human spinal support devices have been described and illustrated as examples of wearable articles and articles constructed according to the principles of the present disclosure, it is to be understood these principles are not limited to spinal support devices, and that wearable articles and articles may be adapted to other body regions and/or other subjects without departing from the scope of the present claims.

What is claimed is:

1. An article wearable by a subject, comprising:

a) a base layer having an interior surface and an exterior surface, wherein the interior surface has a first coefficient of friction (μ1) relative to a body surface of the subject, and wherein the base layer has a first modulus of elasticity (E1);

b) at least one gripping element coupled to the interior surface of the base layer, wherein the at least one gripping element is configured to contact a body of the subject, and wherein the at least one gripping element has a second coefficient of friction (μ2) relative to the body surface, wherein μ2 is greater than μ1;

c) at least one compression element coupled to the base layer, wherein the at least one compression element has a second modulus of elasticity (E2) that is greater than E1; and d) at least one support element comprising a neck support element integrated into the base layer, the neck support element comprising a force-reactive polymer comprising a non-Newtonian material, wherein the neck support element is dimensioned (i) to have close topographical engagement with a neck of the subject and (ii) to extend at most up to an occipital bone of the subject, wherein the neck support element comprises a single body surrounding the force-reactive polymer and is configured to provide increasing resistance in response to an increasing degree of an applied force.

2. The article of claim 1, wherein the non-Newtonian material comprises:

a) a first viscosity (v1) in response to a first motion by the subject that exerts a first force (F1) upon the at least one support element; and b) a second viscosity (v2) in response to a second motion by the subject that exerts a second force (F2) upon the at least one support element, wherein F2 is greater than F1and v2 is greater than v1 such that the at least one support element produces a greater resistance to the second motion than to the first motion.

3. The article of claim 1, wherein the at least one support element comprises an elastomeric polymer.

4. The article of claim 3, wherein the elastomeric polymer forms a foam matrix comprising the non-Newtonian material.

5. The article of claim 4, wherein the non-Newtonian material is a shear thickening non-Newtonian fluid.

6. The article of claim 1, wherein the at least one support element comprises a pouch encapsulating the non-Newtonian material.

7. The article of claim 1, wherein the at least one support element is configured to provide resistance to movement of at least one of a muscle, a joint, or a bone of the subject, wherein the resistance increases with increasing force of the movement.

8. The article of claim 1, wherein the at least one support element further comprises at least one of:

a) a thigh support element;

b) a shin support element; or c) a spine support element.

9. The article of claim 1, wherein the neck support element comprises a penannular collar member having a shape that is configured to be anatomically complementary with the neck of the subject.

10. The article of claim 1, wherein the neck support element is configured to be positioned around a rear and lateral sides of the neck of the subject.

11. The article of claim 1, wherein the at least one gripping element comprises a polymeric or composite material.

12. The article of claim 1, wherein the at least one gripping element comprises a textured surface.

13. The article of claim 1, further comprising at least one tensioner.

14. The article of claim 13, wherein the at least one tensioner comprises at least one of a chest tensioner, an abdominal tensioner, a waist tensioner, a thigh tensioner, or a shin tensioner.

15. The article of claim 1, wherein the at least one compression element comprises a polymeric material or composite material.

16. The article of claim 1, wherein the at least one compression element comprises a material formed from silicone, nylon, rubber, neoprene, vinyl, polyurethane, or any combination thereof.

17. The article of claim 1, wherein the article comprises a long-sleeve shirt, a short-sleeve shirt, a no-sleeve shirt, a pair of pants, or a full body suit.

18. A method for forming an article wearable by a subject, comprising:

a) providing a base layer having an interior surface and an exterior surface, wherein the interior surface has a first coefficient of friction (μ1) relative to a body surface of the subject, and wherein the base layer has a first modulus of elasticity (E1);

b) coupling at least one gripping element to the interior surface of the base layer, wherein the at least one gripping element is configured to contact a body of the subject, and wherein the at least one gripping element has a second coefficient of friction (μ2) relative to the body surface, wherein μ2 is greater than μ1;

c) coupling at least one compression element to the base layer, wherein the at least one compression element has a second modulus of elasticity (E2) that is greater than E1; and d) integrating at least one support element comprising a neck support element into the base layer, wherein the neck support element comprises a force-reactive polymer comprising a non-Newtonian material, and wherein the neck support element is dimensioned (i) to have close topographical engagement with a neck of the subject, and (ii) to extend at most up to an occipital bone of the subject, wherein the neck support element comprises a single body surrounding the force-reactive polymer and is configured to provide increasing resistance in response to an increasing degree of an applied force.

19. The method of claim 18, further comprising laminating or printing the compression element or gripping element adjacent to the base layer.

20. The method of claim 18, wherein at least one of the support element, the compression element, and the gripping element is irremovably attached to the base layer.

21. The method of claim 18, wherein the neck support element comprises a penannular collar member that is anatomically complementary with the neck of the subject.

22. The method of claim 18, wherein the neck support element is positioned around a rear and lateral sides of a neck of the subject.

23. A method for mounting an article on a body of a subject, comprising:

a) providing the article comprising:

i) a base layer having an interior surface and an exterior surface, wherein the interior surface has a first coefficient of friction (μ1) relative to a body surface of the subject, and wherein the base layer has a first modulus of elasticity (E1);

ii) at least one gripping element coupled to the interior surface of the base layer, wherein the at least one gripping element is configured to contact a body of the subject, and wherein the at least one gripping element has a second coefficient of friction (μ2) relative to the body surface, wherein μ2 is greater than μ1;

iii) at least one compression element coupled to the base layer, wherein the at least one compression element has a second modulus of elasticity (E2) that is greater than E1; and iv) at least one support element comprising a neck support element integrated into the base layer, the neck support element comprising a force-reactive polymer comprising a non-Newtonian material, wherein the neck support element is dimensioned (i) to have close topographical engagement with a neck of the subject and (ii) to extend at most up to an occipital bone of the subject, wherein the neck support element comprises a single body surrounding the force-reactive polymer and is configured to provide increasing resistance in response to an increasing degree of an applied force; and b) mounting the article on the body of the subject, wherein when mounted on the body of the subject, the interior surface and the at least one gripping element contact the body surface of the subject at μ2 greater than μ1.

24. The method of claim 23, wherein when mounted on the body of the subject, the at least one support element provides support and impact protection to the subject while allowing full range of motion.

25. The method of claim 23, wherein when mounted on the body of the subject, the non-Newtonian material of the at least one support element comprises:

a) a first viscosity (v1) in response to a first motion by the subject that exerts a first force (F1) upon the at least one support element; and b) a second viscosity (v2) in response to a second motion by the subject that exerts a second force (F2) upon the at least one support element, wherein F2 is greater than F1 and v2 is greater than v1, and the at least one support element produces a greater resistance to the second motion than to the first motion.

26. The method of claim 23, wherein the at least one gripping element comprises a surface that is textured in a manner configured to exert a tangential force upon the body surface of the subject when the at least one gripping element is mounted on the body of the subject.

* * * * *